US010844496B2

(12) United States Patent
Albrecht et al.

(10) Patent No.: US 10,844,496 B2
(45) Date of Patent: Nov. 24, 2020

(54) ELECTROCHEMICAL, HALOGENATION, AND OXYHALOGENATION SYSTEMS AND METHODS

(71) Applicant: Calera Corporation, Moss Landing, CA (US)

(72) Inventors: Thomas A Albrecht, Santa Clara, CA (US); Ryan J Gilliam, San Jose, CA (US); Kyle Self, San Jose, CA (US); Michael Joseph Weiss, Los Gatos, CA (US)

(73) Assignee: Calera Corporation, Moss Landing, CA (US)

( * ) Notice: Subject to any disclaimer, the term of this patent is extended or adjusted under 35 U.S.C. 154(b) by 120 days.

(21) Appl. No.: 16/286,167

(22) Filed: Feb. 26, 2019

(65) Prior Publication Data

US 2019/0203365 A1 Jul. 4, 2019

Related U.S. Application Data

(63) Continuation of application No. 15/338,235, filed on Oct. 28, 2016, now Pat. No. 10,266,954.
(Continued)

(51) Int. Cl.
*C25B 3/06* (2006.01)
*C25B 9/08* (2006.01)
(Continued)

(52) U.S. Cl.
CPC ..... *C25B 3/06* (2013.01); *C25B 9/08* (2013.01); *C25B 9/10* (2013.01); *C25B 9/20* (2013.01); *C25B 9/206* (2013.01)

(58) Field of Classification Search
CPC .... C25B 3/06; C25B 9/08; C25B 9/20; C25B 9/10; C25B 9/206
See application file for complete search history.

(56) References Cited

U.S. PATENT DOCUMENTS 2,306,222 A 12/1942 Patnode
2,358,776 A 9/1944 Goldstein et al.
(Continued)

FOREIGN PATENT DOCUMENTS

CA 1339833 C 4/1998
CA 2305980 A1 10/2000
(Continued)

OTHER PUBLICATIONS

Ballestar, et al. Basic methodology for the assessment and selection of water-repellent treatments applied on carbonatic materials. Progress in Organic Coatings. 2001; 43:258-266.
(Continued)

*Primary Examiner* — Louis J Rufo
(74) *Attorney, Agent, or Firm* — Calera Corporation; Vandana Bansal

(57) ABSTRACT

Disclosed herein are methods and systems that relate to electrochemically oxidizing metal halide with a metal ion in a lower oxidation state to a higher oxidation state; halogenating an unsaturated hydrocarbon or a saturated hydrocarbon with the metal halide with the metal ion in the higher oxidation state; and oxyhalogenating the metal halide with the metal ion from a lower oxidation state to a higher oxidation state in presence of an oxidant. In some embodiments, the oxyhalogenation is in series with the electrochemical oxidation, the electrochemical oxidation is in series with the oxyhalogenation, the oxyhalogenation is parallel to the electrochemical oxidation, and/or the oxyhalogenation is simultaneous with the halogenation.

16 Claims, 6 Drawing Sheets

Related U.S. Application Data

(60) Provisional application No. 62/247,421, filed on Oct. 28, 2015.

(51) Int. Cl.
*C25B 9/20* (2006.01)
*C25B 9/10* (2006.01)

(56) References Cited

U.S. PATENT DOCUMENTS 2,752,402 A 6/1956 Pye
2,792,342 A 5/1957 Tuwiner
2,999,887 A 9/1961 Finlay
3,079,444 A 2/1963 Jacobowsky et al.
3,214,481 A 10/1965 Heinemann et al.
3,214,482 A 10/1965 Caropreso et al.
3,397,226 A 8/1968 Fenton
3,427,235 A 2/1969 Joseph
3,437,712 A 4/1969 Robert et al.
3,461,180 A 8/1969 Heinz et al.
3,475,504 A 10/1969 Charles et al.
3,510,532 A 5/1970 Frank et al.
3,607,420 A 9/1971 Leonard
3,634,330 A 1/1972 Max et al.
3,635,803 A 1/1972 Thomas et al.
3,691,239 A 9/1972 Homer et al.
3,985,794 A 10/1976 Calcagno et al.
4,056,452 A 11/1977 Campbell
4,108,752 A 8/1978 Pohto et al.
4,111,779 A 9/1978 Seko et al.
4,180,623 A 12/1979 Adams
4,190,508 A 2/1980 Kametani et al.
4,256,719 A 3/1981 Van Andel
4,269,678 A 5/1981 Faul et al.
4,319,977 A 3/1982 Wortley
4,324,625 A 4/1982 Cumbo
4,376,019 A 3/1983 Gamlen et al.
4,379,019 A 4/1983 Pool
4,394,227 A 7/1983 Jaeger et al.
4,402,811 A 9/1983 Klotz et al.
4,409,076 A 10/1983 Seidel et al.
4,538,011 A 8/1985 Drago et al.
4,555,317 A 11/1985 Nicolas et al.
4,581,116 A 4/1986 Plowman et al.
4,595,469 A 6/1986 Foller
4,634,506 A 1/1987 Novak et al.
4,643,818 A 2/1987 Seko et al.
4,672,142 A 6/1987 Hundeck et al.
4,726,887 A 2/1988 McIntyre
4,767,519 A 8/1988 De Nora
4,810,806 A 3/1989 Krespan
4,814,420 A 3/1989 Brunelle et al.
4,834,847 A 5/1989 McIntyre
4,835,014 A 5/1989 Roth et al.
4,908,198 A 3/1990 Weinberg
4,950,268 A 8/1990 Rink
4,950,368 A 8/1990 Weinberg et al.
5,050,603 A 9/1991 Stokes et al.
5,051,129 A 9/1991 Cuthbert et al.
5,091,002 A 2/1992 Schamberg et al.
5,196,054 A 3/1993 Schmuck et al.
5,264,100 A 11/1993 Shimohira et al.
5,296,107 A 3/1994 Harrison
5,364,508 A 11/1994 Weres et al.
5,437,771 A 8/1995 Shimamune et al.
5,532,389 A 7/1996 Trent et al.
5,595,641 A 1/1997 Traini et al.
5,891,318 A 4/1999 Freire et al.
5,932,750 A 8/1999 Hayashi et al.
6,099,703 A 8/2000 Syversen et al.
6,117,286 A 9/2000 Shimamune et al.
6,146,787 A 11/2000 Harrup et al.
6,368,473 B1 4/2002 Furuya et al.
6,372,102 B1 4/2002 Sakata et al.
6,383,349 B1 5/2002 Sakata et al.
6,395,153 B1 5/2002 Matousek et al.
6,591,199 B2 7/2003 Tremblay et al.
7,404,878 B2 7/2008 Katayama et al.
7,569,083 B2 8/2009 Katayama et al.
7,616,006 B2 11/2009 Tremblay et al.
7,658,835 B2 2/2010 Gestermann et al.
7,708,867 B2 5/2010 Yamada et al.
7,717,997 B2 5/2010 Trevethick
7,735,274 B2 6/2010 Constantz et al.
7,744,761 B2 6/2010 Constantz et al.
7,749,476 B2 7/2010 Constantz et al.
7,753,618 B2 7/2010 Constantz et al.
7,754,169 B2 7/2010 Constantz et al.
7,771,684 B2 8/2010 Constantz et al.
7,790,012 B2 9/2010 Kirk et al.
7,797,137 B2 9/2010 Veillette et al.
7,815,880 B2 10/2010 Constantz et al.
7,818,276 B2 10/2010 Veillette et al.
7,829,053 B2 11/2010 Constantz et al.
7,837,842 B1 11/2010 Mayers, Sr. et al.
7,875,163 B2 1/2011 Gilliam et al.
7,887,694 B2 2/2011 Constantz et al.
7,906,028 B2 3/2011 Constantz et al.
7,914,652 B2 3/2011 Yamada et al.
7,914,685 B2 3/2011 Constantz et al.
7,922,809 B1 4/2011 Constantz et al.
7,931,809 B2 4/2011 Constantz et al.
7,933,511 B2 4/2011 Masuki
7,939,336 B2 5/2011 Constantz et al.
7,966,250 B2 6/2011 Constantz et al.
7,993,500 B2 8/2011 Gilliam et al.
7,993,511 B2 8/2011 Gilliam et al.
8,006,446 B2 8/2011 Constantz et al.
8,062,418 B2 11/2011 Constantz et al.
8,114,214 B2 2/2012 Constantz et al.
8,114,265 B2 2/2012 Berriah et al.
8,137,444 B2 3/2012 Farsad et al.
8,137,455 B1 3/2012 Constantz et al.
8,152,987 B2 4/2012 Tremblay et al.
8,197,649 B2 6/2012 Saiki et al.
8,357,270 B2 1/2013 Gilliam et al.
8,894,830 B2 11/2014 Gilliam et al.
8,940,139 B2 1/2015 Asaumi et al.
9,108,844 B2 8/2015 Huss
9,175,410 B2 11/2015 Izawa et al.
9,181,624 B2 11/2015 Sugiyama et al.
9,187,834 B2 11/2015 Albrecht et al.
9,187,835 B2 11/2015 Albrecht et al.
9,200,375 B2 12/2015 Gilliam et al.
9,273,404 B2 3/2016 Bulan et al.
9,828,313 B2 11/2017 Weiss et al.
9,957,621 B2 5/2018 Albrecht et al.
9,957,623 B2 5/2018 Gilliam et al.
10,161,050 B2 12/2018 Gilliam et al.
10,236,526 B2 3/2019 Gilliam et al.
10,266,954 B2 4/2019 Albrecht et al.
10,287,223 B2 5/2019 Weiss et al.
10,287,693 B1 5/2019 Gilliam et al.
10,480,085 B2 11/2019 Gilliam et al.
10,556,848 B2 2/2020 Leclerc et al.
10,619,254 B2 4/2020 Self et al.
2002/0045085 A1 4/2002 Formato et al.
2003/0150819 A1 8/2003 Iseki et al.
2004/0069621 A1 4/2004 Gestermann et al.
2004/0097767 A1 5/2004 Gulotty et al.
2004/0197633 A1 10/2004 Yamamoto et al.
2004/0251199 A1 12/2004 Benavides
2004/0267063 A1 12/2004 Harth et al.
2005/0244689 A1 11/2005 Horiguchi et al.
2005/0283034 A1 12/2005 Ganesan et al.
2006/0115710 A1 6/2006 Kusakabe et al.
2006/0124445 A1 6/2006 Labrecque et al.
2006/0149102 A1 7/2006 Voight et al.
2007/0014709 A1 1/2007 Moyes et al.
2007/0128425 A1 6/2007 Hadj et al.
2007/0292762 A1 12/2007 Johnson
2008/0023339 A1 1/2008 Berggren et al.
2008/0029404 A1 2/2008 Weber et al.
2008/0223727 A1 9/2008 Oloman et al.

(56) References Cited

U.S. PATENT DOCUMENTS

2008/0275279 A1 11/2008 Podkolzin et al.
2009/0001020 A1 1/2009 Constantz et al.
2009/0020044 A1 1/2009 Constantz et al.
2009/0029199 A1 1/2009 Tao
2009/0087698 A1 4/2009 Huth et al.
2009/0169452 A1 7/2009 Constantz et al.
2009/0202410 A1 8/2009 Kawatra et al.
2009/0277805 A1 11/2009 Amemiya et al.
2009/0293720 A1 12/2009 Liu
2009/0301352 A1 12/2009 Constantz et al.
2009/0325031 A1 12/2009 Sugawara et al.
2010/0000444 A1 1/2010 Constantz et al.
2010/0024686 A1 2/2010 Constantz et al.
2010/0032347 A1 2/2010 Ring et al.
2010/0041927 A1 2/2010 Olver et al.
2010/0051469 A1 3/2010 Stolberg
2010/0051859 A1 3/2010 House et al.
2010/0063902 A1 3/2010 Constantz et al.
2010/0077691 A1 4/2010 Constantz et al.
2010/0077922 A1 4/2010 Constantz et al.
2010/0083880 A1 4/2010 Constantz et al.
2010/0084280 A1 4/2010 Gilliam et al.
2010/0108537 A1 5/2010 Perego et al.
2010/0111810 A1 5/2010 Constantz et al.
2010/0116683 A1 5/2010 Gilliam et al.
2010/0132556 A1 6/2010 Constantz et al.
2010/0132591 A1 6/2010 Constantz et al.
2010/0135865 A1 6/2010 Constantz et al.
2010/0135882 A1 6/2010 Constantz et al.
2010/0140103 A1 6/2010 Gilliam et al.
2010/0144521 A1 6/2010 Constantz et al.
2010/0150802 A1 6/2010 Gilliam et al.
2010/0154679 A1 6/2010 Constantz et al.
2010/0155258 A1 6/2010 Kirk et al.
2010/0158786 A1 6/2010 Constantz et al.
2010/0170805 A1 7/2010 Krafft et al.
2010/0179302 A1 7/2010 Krafft et al.
2010/0196104 A1 8/2010 Constantz et al.
2010/0200419 A1 8/2010 Gilliam et al.
2010/0219373 A1 9/2010 Seeker et al.
2010/0224503 A1 9/2010 Kirk et al.
2010/0229725 A1 9/2010 Farsad et al.
2010/0230293 A1 9/2010 Gilliam et al.
2010/0230830 A1 9/2010 Farsad et al.
2010/0236242 A1 9/2010 Farsad et al.
2010/0239467 A1 9/2010 Constantz et al.
2010/0239487 A1 9/2010 Constantz et al.
2010/0247410 A1 9/2010 Constantz et al.
2010/0258035 A1 10/2010 Constantz et al.
2010/0258450 A1 10/2010 Burtch
2010/0258506 A1 10/2010 Berkowitz et al.
2010/0270167 A1 10/2010 McFarland
2010/0276299 A1 11/2010 Kelly et al.
2010/0290967 A1 11/2010 Detournay et al.
2010/0313793 A1 12/2010 Constantz et al.
2010/0313794 A1 12/2010 Constantz et al.
2010/0319586 A1 12/2010 Blount et al.
2010/0326328 A1 12/2010 Constantz et al.
2011/0005938 A1 1/2011 Wolf et al.
2011/0028765 A1 2/2011 Mehta
2011/0030586 A1 2/2011 Constantz et al.
2011/0030957 A1 2/2011 Constantz et al.
2011/0033239 A1 2/2011 Constantz et al.
2011/0035154 A1 2/2011 Kendall et al.
2011/0036728 A1 2/2011 Farsad
2011/0042230 A1 2/2011 Gilliam et al.
2011/0054084 A1 3/2011 Constantz et al.
2011/0059000 A1 3/2011 Constantz et al.
2011/0067600 A1 3/2011 Constantz et al.
2011/0067603 A1 3/2011 Constantz et al.
2011/0067605 A1 3/2011 Constantz et al.
2011/0071309 A1 3/2011 Constantz et al.
2011/0076587 A1 3/2011 Wang et al.
2011/0079515 A1 4/2011 Gilliam et al.
2011/0081585 A1 4/2011 Montgomery
2011/0083968 A1 4/2011 Gilliam et al.
2011/0091366 A1 4/2011 Kendall et al.
2011/0091955 A1 4/2011 Constantz et al.
2011/0120888 A1 5/2011 James et al.
2011/0132234 A1 6/2011 Constantz et al.
2011/0147227 A1 6/2011 Gilliam et al.
2011/0152580 A1 6/2011 Hook et al.
2011/0203489 A1 8/2011 Constantz et al.
2011/0226989 A9 9/2011 Seeker et al.
2011/0240916 A1 10/2011 Constantz et al.
2011/0247336 A9 10/2011 Farsad et al.
2011/0269990 A1 11/2011 Honda et al.
2011/0277474 A1 11/2011 Constantz et al.
2011/0277670 A1 11/2011 Self et al.
2011/0287336 A1 11/2011 Himeno et al.
2011/0315561 A1 12/2011 Rabaey et al.
2012/0000789 A1 1/2012 Turek et al.
2012/0003125 A1 1/2012 Madokoro et al.
2012/0152804 A1 6/2012 Koseoglu et al.
2012/0292196 A1* 11/2012 Albrecht ..... C07C 17/02
205/351
2012/0292197 A1 11/2012 Albrecht et al.
2012/0293110 A1 11/2012 Frederick et al.
2013/0036948 A1 2/2013 Fernandez et al.
2013/0206606 A1 8/2013 Gilliam et al.
2013/0240372 A1 9/2013 Bulan et al.
2014/0353146 A1 12/2014 Gilliam et al.
2015/0038750 A1 2/2015 Weiss et al.
2015/0311541 A1 10/2015 Lloyd et al.
2015/0337443 A1 11/2015 Albrecht et al.
2015/0361564 A1 12/2015 Albrecht et al.
2016/0040304 A1 2/2016 Albrecht et al.
2016/0060774 A1 3/2016 Gilliam et al.
2016/0076156 A1 3/2016 Albrecht et al.
2016/0108529 A1 4/2016 Albrecht et al.
2016/0230291 A1 8/2016 Albrecht et al.
2016/0355436 A1 12/2016 Chen et al.
2017/0073823 A1 3/2017 Albrecht et al.
2017/0121832 A1 5/2017 Albrecht et al.
2018/0044267 A1 2/2018 Weiss et al.
2018/0094355 A1 4/2018 Leddy et al.
2018/0216242 A1 8/2018 Albrecht et al.
2019/0119186 A1 4/2019 Leclerc et al.
2019/0284708 A1 9/2019 Weiss et al.

FOREIGN PATENT DOCUMENTS

CN 1076735 A 9/1993
CN 2530957 Y 1/2003
CN 101260530 A 9/2008
CN 101409358 A 4/2009
CN 101809438 A 8/2010
CN 102301037 A 12/2011
CN 102580492 A 7/2012
CN 102732910 A 10/2012
CN 103238233 A 8/2013
CN 103682389 A 3/2014
CN 103238233 B 9/2015
CN 105220174 A 1/2016
DE 19614683 A1 10/1997
EP 0039547 A1 11/1981
EP 0039547 B1 7/1984
EP 0369732 A1 5/1990
EP 1362133 A1 11/2003
EP 2253600 A1 11/2010
EP 1362133 B1 7/2011
EP 2710650 A1 3/2014
EP 2831313 A1 2/2015
EP 2697410 B1 6/2015
FR 1539499 A 9/1968
GB 812680 A 4/1959
GB 1019437 A 2/1966
GB 1063175 A 3/1967
GB 1063283 A 3/1967
GB 1063284 A 3/1967
JP 42-25045 11/1967
JP S56169631 A 12/1981
JP S5727129 A 2/1982
JP S5874624 A 5/1983

(56) References Cited

FOREIGN PATENT DOCUMENTS

| | | | |
|---|---|---|---|
| JP | S58176223 | A | 10/1983 |
| JP | S63293186 | A | 11/1988 |
| JP | H0238573 | B2 | 8/1990 |
| JP | H02290988 | A | 11/1990 |
| JP | H0356683 | A | 3/1991 |
| JP | H046290 | A | 1/1992 |
| JP | H0432594 | A | 2/1992 |
| JP | H05214573 | A | 8/1993 |
| JP | H07233267 | A | 9/1995 |
| JP | H105590 | A | 1/1998 |
| JP | H1081986 | A | 3/1998 |
| JP | H11256385 | A | 9/1999 |
| JP | 2000199093 | A | 7/2000 |
| JP | 2000355785 | A | 12/2000 |
| JP | 2001262387 | A | 9/2001 |
| JP | 2004027267 | A | 1/2004 |
| JP | 2005511670 | A | 4/2005 |
| JP | 2008546682 | A | 12/2008 |
| JP | 2009299111 | A | 12/2009 |
| MX | 2008005821 | A | 11/2009 |
| RU | 2222521 | C1 | 1/2004 |
| TW | 201313958 | A | 4/2013 |
| WO | WO-8002023 | A1 | 10/1980 |
| WO | WO-02094752 | A1 | 11/2002 |
| WO | WO-2004097073 | A1 | 11/2004 |
| WO | WO-2007058472 | A1 | 5/2007 |
| WO | WO-2008018928 | A2 | 2/2008 |
| WO | WO-2008148055 | A1 | 12/2008 |
| WO | WO-2009006295 | A2 | 1/2009 |
| WO | WO-2008018928 | A3 | 3/2009 |
| WO | WO-2009083482 | A1 | 7/2009 |
| WO | WO-2009086460 | A1 | 7/2009 |
| WO | WO-2009118162 | A1 | 10/2009 |
| WO | WO-2009006295 | A3 | 12/2009 |
| WO | WO-2009146436 | A1 | 12/2009 |
| WO | WO-2009155378 | A1 | 12/2009 |
| WO | WO-2010006242 | A1 | 1/2010 |
| WO | WO-2010008896 | A1 | 1/2010 |
| WO | WO-2010009273 | A1 | 1/2010 |
| WO | WO-2010030826 | A1 | 3/2010 |
| WO | WO-2010039903 | A1 | 4/2010 |
| WO | WO-2010039909 | A1 | 4/2010 |
| WO | WO-2010048457 | A1 | 4/2010 |
| WO | WO-2010051458 | A1 | 5/2010 |
| WO | WO-2010055152 | A1 | 5/2010 |
| WO | WO-2010068924 | A1 | 6/2010 |
| WO | WO-2010074686 | A1 | 7/2010 |
| WO | WO-2010074687 | A1 | 7/2010 |
| WO | WO-2010087823 | A1 | 8/2010 |
| WO | WO-2010091029 | A1 | 8/2010 |
| WO | WO-2010093713 | A1 | 8/2010 |
| WO | WO-2010093716 | A1 | 8/2010 |
| WO | WO-2010101953 | A1 | 9/2010 |
| WO | WO-2010104989 | A1 | 9/2010 |
| WO | WO-2010132863 | A1 | 11/2010 |
| WO | WO-2010136744 | A1 | 12/2010 |
| WO | WO-2011008223 | A1 | 1/2011 |
| WO | WO-2011017609 | A1 | 2/2011 |
| WO | WO-2011038076 | A1 | 3/2011 |
| WO | WO-2011049996 | A1 | 4/2011 |
| WO | WO-2011066293 | A1 | 6/2011 |
| WO | WO-2011073621 | A1 | 6/2011 |
| WO | WO-2011075680 | A1 | 6/2011 |
| WO | WO-2011081681 | A1 | 7/2011 |
| WO | WO-2011097468 | A2 | 8/2011 |
| WO | WO-2011102868 | A1 | 8/2011 |
| WO | WO-2011116236 | A2 | 9/2011 |
| WO | WO-2012158969 | A1 | 11/2012 |
| WO | WO-2013082811 | A1 | 6/2013 |
| WO | WO-2013148216 | A1 | 10/2013 |
| WO | WO-2014099874 | A1 | 6/2014 |
| WO | WO-2015017585 | A1 | 2/2015 |
| WO | WO-2016044279 | A1 | 3/2016 |
| WO | WO-2016149365 | A1 | 9/2016 |
| WO | WO-2017075443 | | 5/2017 |
| WO | WO-2018200785 | A1 | 11/2018 |
| WO | WO-2019060345 | A1 | 3/2019 |

OTHER PUBLICATIONS

Baranski, et al., Voltammetric determination of surface active compounds at Au and Pt ultramicroelectrodes in flowing solutions, Canadian Journal of Chemistry, 1997, 75(11): 1736-1749.

Charlotte L. Brady, The Development and Characterisation of Microelectrodes for Extreme Environments, Thesis for Degree of Doctor of Philosophy, The University of Edinburgh, pp. 1-248, Feb. 2013.

Co-pending U.S. Appl. No. 16/725,052, filed Dec. 23, 2019.

Co-pending U.S. Appl. No. 16/751,769, filed Jan. 24, 2020.

Co-pending U.S. Appl. No. 16/804,665, filed Feb. 28, 2020.

EP16860934.5 Extended European Search Report dated May 9, 2019.

Feeney et al., On-Site Analysis of Arsenic in Groundwater Using a Microfabricated Gold Ultramicroelectrode Array, Anal. Chem. 2000, 72,10, pp. 2222-2228, Publication Date: Apr. 13, 2000.

International search report and written opinion dated Jan. 27, 2016 for PCT/US2015/059986.

International search report and written opinion dated May 27, 2016 for PCT/US2016/022638.

Kralj, D. et al. 1997. Vaterite growth and dissolution in aqueous solution III. Kinetics of transformation. Journal of Crystal Growth. 177: 248-257.

Lanzon, et al. Stabilization of sodium oleate as calcium oleate in cement-based mortars made with limestone fillers. Construction and Building Materials. 2011; 25:1001-1008.

U.S. Appl. No. 15/071,648 Notice of Allowance dated Oct. 24, 2018.

Notice of allowance dated Nov. 22, 2017 for U.S. Appl. No. 14/937,751.

Office action dated Mar. 23, 2017 for U.S. Appl. No. 14/662,974.

Office action dated Apr. 6, 2018 for U.S. Appl. No. 15/071,648.

Office action dated Oct. 11, 2017 for U.S. Appl. No. 14/937,751.

PCT/US2018/051636 International Search Report and Written Opinion dated Nov. 29, 2018.

Ren, et al. Pre-sealing Concrete Blocks and Pavers Using Silicone Nanotechnology. 15th International Brick and Block Masonry Conference. 2012.

Spanos, N. et al. 1998. The transformation of vaterite to calcite: effect of the conditions of the solutions in contact with the mineral phase. Journal of Crystal Growth. 191: 783-790.

U.S. Appl. No. 14/460,697 Office Action dated Nov. 21, 2019.

U.S. Appl. No. 14/834,151 Office Action dated May 23, 2019.

U.S. Appl. No. 14/834,151 Office Action dated Nov. 27, 2019.

U.S. Appl. No. 15/071,648 Office Action dated Aug. 2, 2018.

U.S. Appl. No. 15/793,250 Notice of Allowance dated Feb. 25, 2019.

U.S. Appl. No. 15/793,250 Office Action dated Nov. 1, 2018.

U.S. Appl. No. 15/935,442 Office Action dated Aug. 15, 2019.

U.S. Appl. No. 15/963,637 Notice of Allowance dated Feb. 20, 2020.

U.S. Appl. No. 16/135,357 Notice of Allowance dated Nov. 20, 2019.

U.S. Appl. No. 16/135,357 Office Action dated Aug. 23, 2019.

U.S. Appl. No. 16/135,357 Office Action dated Oct. 17, 2019.

U.S. Appl. No. 16/364,383 Notice of Allowance dated Oct. 7, 2019.

U.S. Appl. No. 16/364,383 Notice of Allowance dated Sep. 17, 2019.

U.S. Appl. No. 16/715,527 Office Action dated Feb. 7, 2020.

U.S. Appl. No. 14/834,151 Office Action dated Sep. 26, 2019.

U.S. Appl. No. 14/460,697 Office Action dated Apr. 8, 2019.

Wikipedia "Cerium(III) chloride" Version: Jun. 28, 2017 (Jun. 28, 2017). Retrieved: Nov. 1, 2018 (Nov. 1, 2018) (https://en.wikipedia.org/w/index.php?title=Cerium(III)_chloride&oldid=787980857) p. 1, para 1.

Zhang, et al., Investigation of cupric ion extraction kinetics in a two-phase organic/water system using microelectrochemical mea-

(56) References Cited

OTHER PUBLICATIONS surements at expanding droplets (MEMED). Journal of Electroanalytical chemistry, 2002; 538-539: 277-283.
Zhao, et al. Electrochemistry of high concentration copper chloride complex. Anal. Chem. 2013; 85:7696-7703.
Acquah, et al. The electrochlorination of aliphatic hydrocarbons. J. Appl. Chem. Biotechnol. 1972; 22:1195-1200.
Andersson, et al. High power diode laser cladding. Fabricating and Metalworking. Mar. 2014; 24-26.
Benadda, B. et al. 1996. A study of Oxygen Absorption Kinetics in Ionic Cu(I) Aqueous Solutions. Chem. Eng. Technol. 19: 34-38.
Brugger, et al. Complexation of metal ions in brines: application of electronic spectroscopy in the study of the Cu(II)—LiCI—H2O system between 25 and 90° C. Geochimica et Cosmochimica Acta. 2001; 65(16):2691-2708.
Catalytical Associates, Inc. Selective Oxychlorination of Hydrocarbons: A Critical Analysis. Oct. 1982, pp. 15-20.
Constantz, B. "The Risk of Implementing New Regulations on Game-Changing Technology: Sequestering CO2 in the Built Environment" AGU, Sep. 2009; 90(22), Jt. Assem, Suppl., Abstract.
Co-pending U.S. Appl. No. 15/341,260, filed Nov. 2, 2016.
European search report and opinion dated Feb. 25, 2015 for EP Application No. 12785945.2.
European search report and opinion dated May 11, 2015 for EP Application No. 13769321.4.
"European search report with opinion dated Dec. 8, 2016 for EP14832631.7".
"European search report with written opinion dated Feb. 17, 2017 for EP16188593.4".
European search report with written opinion dated Jul. 18, 2017 for EP17150726.
Friend, L. et al. 1974. Liquid-Phase Oxychlorination of Ethylene to Produce Vinyl Chloride. Homogeneous Catalysis. American Chemical Society. Piscataway, N.J. pp. 168-176.
Georgiadou, M. et al. 1998. Modelling of copper etching in aerated chloride solutions. Journal of Applied Electrochemistry. 28: 127-134.
Hine, F. et al. 1970. Mechanism of Oxidation of Cuprous Ion in Hydrochloric Acid Solution by Oxygen. Electrochimica Acta. 15: 769-781.
International search report and written opinion dated May 23, 2013 for PCT/US2013/031064.
International search report and written opinion dated Aug. 14, 2012 for PCT/US2012/038438.
International search report and written opinion dated Oct. 15, 2014 for PCT/US2014/048976.
International search report and written opinion dated Dec. 17, 2015 for PCT/US2015/050196.
"International search report with written opinion dated Jan. 24, 2017 for PCT/US16/59455".
Jhaveri, A.S., et al. 1967. Kinetics of absorption of oxygen in aqueous solutions of cuprous chloride. Chemical Engineering Science. 22: 1-6.
Kinoshita, et al. Mass-Transfer Study of Carbon Felt, Flow-Through Electrode. J. Electrochem. Soc. 1982; 129(9):1993-1997.
Kotora, et al. Selective Additions of Polyhalognated Compounds to Chloro Substituted Ethenes Catalyzed by a Copper Complex. React. Kinet. Catal. Lett. (no month, 1991), vol. 44, No. 2, pp. 415-419.
Krishnamoorthy, et al. Chlorination of substituted aromatics on graphite anode. Asian Journal of Chemistry. 2002; 14(3-4):1801-1803.
Langer, et al. Electrogenerative and Voltameiotic Processes. Ind. Eng. Chem. Process Des. Dev. 1979; 18(4):567-579.
Langer, et al. Electrogenerative Chlorination J. Electrochem. Soc. 1970; 117(4):510-511.
Little, et al. A microstructural study of a supported liquid phase oxychlorination catalyst. Journal of Catalysis 93.1 (1985): 23-29.
Liu, et al. A spectrophotometric study of aqueous copper(I)-chloride complexes in LiCI solutions between 100° C. and 250° C. Geochimica et Cosmochimica Acta. 2002; 66(20):3615-3633.
Logager, et al. Oxidation of Ferrous Ions by Ozone in Acidic Solutions. Inorg. Chem. 1992; 31:3523-3529.
Lundstrom, et al Redox potential characteristics of cupric chloride solutions. Hydrometallurgy. 2009; 95:285-289.
Margraf, et al. Copper(II) PMDTA and Copper(II) TMEDA Complexes: Precursors for the Synthesis of Dinuclear Copper(II) Complexes. Inorgancia Chimica Acta (no month, 2005), vol. 358, pp. 1193-1203.
Muddada, et al. Ethylene oxychlorination catalysis: role of metal promoters on activity and selectivity of the process. Department of Chemistry. University of Oslo. Available at https://www.sintef.no/globalassets/project/trondheim_gts/presentasjoner/ethylene-oxychlorination-catalysis---role-of-metal-promoters-on-activity-and-selectivity-of-the-process.pdf. Nov. 3, 2011. Accessed Jan. 17, 2017.
Nijhuis, et al. The Production of Propene Oxide: Catalytic Processes and Recent Developments. Industrial & Engineering Chemistry Research 2006 45 (10), 3447-3459.
Notice of allowance dated Feb. 12, 2018 for U.S. Appl. No. 15/341,260.
Notice of allowance dated Mar. 7, 2018 for U.S. Appl. No. 14/919,281.
Notice of allowance dated Mar. 16, 2018 for U.S. Appl. No. 14/855,262.
Notice of allowance dated Sep. 16, 2015 for U.S. Appl. No. 13/474,599.
Notice of allowance dated Sep. 28, 2017 for U.S. Appl. No. 14/446,791.
Notice of allowance dated Sep. 30, 2015 for U.S. Appl. No. 13/474,598.
Notice of allowance dated Oct. 9, 2015 for U.S. Appl. No. 13/799,131.
Office action dated Feb. 5, 2018 for U.S. Appl. No. 14/855,262.
Office action dated Feb. 8, 2018 for U.S. Appl. No. 14/834,151.
"Office action dated Feb. 9, 2017 for U.S. Appl. No. 14/446,791".
Office action dated Feb. 15, 2018 for U.S. Appl. No. 14/876,760.
Office action dated Mar. 2, 2018 for U.S. Appl. No. 14/814,935.
Office action dated Mar. 4, 2015 for U.S. Appl. No. 13/474,598.
Office action dated Mar. 8, 2018 for U.S. Appl. No. 15/341,260.
Office action dated Mar. 14, 2018 for U.S. Appl. No. 14/877,329.
Office action dated Mar. 21, 2018 for U.S. Appl. No. 14/879,525.
Office action dated Apr. 18, 2017 for U.S. Appl. No. 14/460,697.
Office action dated Apr. 23, 2015 for U.S. Appl. No. 13/474,599.
Office action dated May 14, 2018 for U.S. Appl. No. 14/834,151.
Office action dated May 16, 2018 for U.S. Appl. No. 14/460,697.
Office action dated Jun. 11, 2015 for U.S. Appl. No. 13/799,131.
Office Action dated Jun. 26, 2017 for U.S. Appl. No. 14/446,791.
Office action dated Jul. 9, 2015 for U.S. Appl. No. 13/474,598.
Office action dated Jul. 19, 2017 for U.S. Appl. No. 14/814,935.
Office action dated Aug. 6, 2015 for U.S. Appl. No. 13/474,598.
Office action dated Aug. 7, 2017 for U.S. Appl. No. 14/834,151.
Office action dated Aug. 8, 2017 for U.S. Appl. No. 14/814,935.
Office action dated Aug. 8, 2017 for U.S. Appl. No. 14/876,760.
Office action dated Aug. 10, 2017 for U.S. Appl. No. 14/460,697.
Office action dated Aug. 14, 2015 for U.S. Appl. No. 13/474,599.
Office action dated Aug. 22, 2017 for U.S. Appl. No. 15/341,260.
Office action dated Aug. 26, 2016 for U.S. Appl. No. 14/460,697.
Office action dated Aug. 27, 2015 for U.S. Appl. No. 13/474,598.
Office action dated Sep. 17, 2015 for U.S. Appl. No. 13/799,131.
Office action dated Oct. 19, 2016 for U.S. Appl. No. 14/446,791.
Office action dated Nov. 7, 2017 for U.S. Appl. No. 14/834,151.
Office action dated Nov. 16, 2017 for U.S. Appl. No. 14/814,935.
Office action dated Nov. 16, 2017 for U.S. Appl. No. 15/341,260.
Office action dated Nov. 27, 2017 for U.S. Appl. No. 14/876,760.
Office action dated Dec. 12, 2017 for U.S. Appl. No. 14/460,697.
"Office action dated Dec. 19, 2016 for U.S. Appl. No. 14/460,697".
Office action dated Dec. 21, 2017 for U.S. Appl. No. 14/919,281.
PCT/US2018/029530 International Search Report and Written Opinion dated Jul. 11, 2018.
Powell, et al. Chemical speciation of environmentally significant metals with inorganic ligands. Pure Appl. Chem. 2007; 79(5):895-950.
Ralph, et al. Mass transport in an electrochemical laboratory filterpress reactor and its enhancement by turbulence promoters. Electrochemica Acta. 1996; 41(4):591-603.

(56) References Cited

OTHER PUBLICATIONS

Richey. Chlorohydrins. Kirk-Ohmer Encyclopedia of Chemical Technology. 2000.
Rollin, et al. The electrochemistry of nickel complexes with triphenylphosphine and ethylene in methylpyrrolidinone. Journal of Electroanalytical Chemistry and Interfacial Electrochemistry. 1985; 183(1-2):247-260.
Rorabacher. Electron transfer by copper centers. Chemical Centers. 2004; 104(2):651-698.
Spector, M.L. et al. 1967. Olefin Chlorination in Homogeneous Aqueous Copper Chloride Solutions. Industrial & Engineering Chemistry Process Design and Development. 6(3): 327-331.
Stanley, et al. Novel Organic Chemical Processes. Proceedings of the Royal Society of London. Series A, Mathematical and Physical Sciences 303.1474 (1968): 259-273.
Trent, D.L., Propylene Oxide. In Kirk-Othmer:Encyclopedia of chemical technology; Wiley: New York, 2001. (Online electronic edition).
U.S. Appl. No. 61/442,573, filed Feb. 14, 2011.
U.S. Appl. No. 14/460,697 Office Action dated Oct. 9, 2018.
U.S. Appl. No. 14/814,935 Office Action dated Jul. 3, 2018.
U.S. Appl. No. 14/834,151 Office Action dated Oct. 17, 2018.
U.S. Appl. No. 15/338,235 Notice of Allowance dated Jan. 24, 2019.
U.S. Appl. No. 15/338,235 Office Action dated Jun. 15, 2018.
U.S. Appl. No. 15/341,260 Office Action dated Jul. 23, 2018.
Wikipedia definition of "Aqueous Solution". Accessed Jul. 29, 2015. 2 pages.
Wikipedia definition of "Solvent". Accessed Jul. 29, 2015. 14 pages.
Yuan, et al. Direct Electrochemical Synthesis and Crystal Structure of a Copper(II) Complex with a Chiral (S)-2-(diphenylmethanol-1-(2-pyridylmethyl)pyrrolidine. Inorganic Chemistry Communications (no month, 2005), vol. 8, pp. 1014-1017.

* cited by examiner

ELECTROCHEMICAL, HALOGENATION, AND OXYHALOGENATION SYSTEMS AND METHODS

CROSS-REFERENCE TO RELATED APPLICATIONS

This application is a continuation of a U.S. patent application Ser. No. 15/338,235, filed Oct. 28, 2016, which application claims benefit to U.S. Provisional Patent Application No. 62/247,421, filed Oct. 28, 2015, which is incorporated herein by reference in its entirety in the present disclosure.

BACKGROUND

Ethylene dichloride may be made by direct chlorination of ethylene using chlorine gas made from the chlor-alkali process. In producing the caustic soda electrochemically, such as via chlor-alkali process, a large amount of energy, salt, and water is used.

The production of chlorine and caustic soda by electrolysis of aqueous solutions of sodium chloride or brine is one of the electrochemical processes demanding high-energy consumption. The total energy requirement is for instance about 2% in the USA and about 1% in Japan of the gross electric power generated, to maintain this process by the chlor-alkali industry. The high energy consumption may be related to high carbon dioxide emission owing to burning of fossil fuels. Therefore, reduction in the electrical power demand needs to be addressed to curtail environment pollution and global warming. There is a need to produce chemicals by low energy consumption.

SUMMARY

In one aspect, there is provided a method comprising (i) contacting an anode with an anode electrolyte wherein the anode electrolyte comprises metal halide and saltwater; contacting a cathode with a cathode electrolyte; applying a voltage to the anode and the cathode and oxidizing the metal halide with the metal ion in a lower oxidation state to a higher oxidation state at the anode; (ii) halogenating an unsaturated hydrocarbon or a saturated hydrocarbon with the metal halide with the metal ion in the higher oxidation state in the saltwater to result in one or more organic compounds or enantiomers thereof and the metal halide with the metal ion in the lower oxidation state; and (iii) oxyhalogenating the metal halide with the metal ion in the lower oxidation state to the higher oxidation state in presence of an oxidant. In some embodiments of the aforementioned aspect, the method further comprises delivering the anode electrolyte from the step (i) to the halogenation step (ii) and/or the oxyhalogenation step (iii); delivering the saltwater comprising the metal halide with the metal ion in the lower oxidation state from step (ii) to step (i) and/or step (iii); and/or delivering the saltwater from step (iii) comprising the metal halide with the metal ion in the higher oxidation state to step (i) and/or step (ii).

In some embodiments of the aforementioned aspect, the step (iii) is in series with the step (i). In some embodiments of the aforementioned aspect and embodiment, the step (i) is in series with the step (iii). In some embodiments of the aforementioned aspect and embodiments, the step (iii) is parallel to the step (i). In some embodiments of the aforementioned aspect and embodiments, the step (iii) is simultaneous with the step (ii).

In some embodiments of the aforementioned aspect, the step (iii) is in series with the step (i), the step (i) is in series with the step (iii), the step (iii) is parallel to the step (i), and/or the step (iii) is simultaneous with the step (ii).

In some embodiments of the aforementioned aspect and embodiments, the oxidizing, the halogenating and the oxyhalogenating steps are carried out in saltwater. In some embodiments of the aforementioned aspect and embodiments, the saltwater contains metal halide with metal ion in the lower oxidation state and the higher oxidation state. In some embodiments of the aforementioned aspect and embodiments, the saltwater comprises alkali metal halide. In some embodiments of the aforementioned aspect and embodiments, the alkali metal halide is sodium chloride or potassium chloride. In some embodiments of the aforementioned aspect and embodiments, the anode electrolyte further comprises alkali metal halide in a concentration of between about 1-5M.

In some embodiments of the aforementioned aspect and embodiments, the oxidant is HX gas or HX solution wherein X is a halogen selected from fluoro, chloro, iodo, and bromo and a gas comprising oxygen. In some embodiments of the aforementioned aspect and embodiments, the HX is HCl and the oxyhalogenation is oxychlorination.

In some embodiments of the aforementioned aspect and embodiments, when the oxyhalogenating step (iii) is in series with the step (i), the method further comprises delivering the anode electrolyte comprising the saltwater and the metal halide with the metal ion in the lower and the higher oxidation state from the step (i) to the step (iii) wherein the step (iii) oxyhalogenates the metal halide with the metal ion from the lower oxidation state to the higher oxidation state in the saltwater. In some embodiments of the aforementioned aspect and embodiments, the method further comprises delivering the metal halide with the metal ion in the higher oxidation state and the saltwater of the oxyhalogenation step (iii) to the halogenating step (ii) for the halogenation of the unsaturated hydrocarbon or the saturated hydrocarbon.

In some embodiments of the aforementioned aspect and embodiments, the method further comprises separating the one or more organic compounds or enantiomers thereof from the metal halide with the metal ion in the lower oxidation state in the saltwater after the halogenating step (ii). In some embodiments of the aforementioned aspect and embodiments, the method further comprises delivering the metal halide with the metal ion in the lower oxidation state to the anode electrolyte.

In some embodiments of the aforementioned aspect and embodiments, the concentration of the metal halide with the metal ion in the lower oxidation state exiting the electrochemical reaction and entering the oxyhalogenation reaction is between about 0.5-2M; concentration of the metal halide with the metal ion in the lower oxidation state exiting the oxyhalogenation reaction and entering the halogenation reaction is between about 0.1-1.8M; concentration of the metal halide with the metal ion in the lower oxidation state exiting the halogenation reaction and entering the electrochemical reaction is between about 0.6-2.5M; or combinations thereof.

In some embodiments of the aforementioned aspect and embodiments, when the electrochemical step (i) is in series with the step (iii), the method further comprises delivering the anode electrolyte comprising the saltwater and the metal halide with the metal ion in the lower and the higher oxidation state from the step (i) to halogenating step (ii) for the halogenation of the unsaturated hydrocarbon or the saturated hydrocarbon. In some embodiments of the aforementioned embodiments, the method further comprises delivering the metal halide with the metal ion in the lower oxidation state in the saltwater of the halogenating step (ii) to the step (iii) wherein the step (iii) oxyhalogenates the metal halide with the metal ion from the lower oxidation state to the higher oxidation state. In some embodiments of the aforementioned aspect and embodiments, the method further comprises delivering the metal halide with the metal ion in the higher oxidation state in the saltwater of the oxyhalogenation step (iii) to the anode electrolyte of step (i).

In some embodiments of the aforementioned aspect and embodiments, concentration of the metal halide with the metal ion in the lower oxidation state exiting the electrochemical reaction and entering the halogenation reaction is between about 0.5-2M; concentration of the metal halide with the metal ion in the lower oxidation state exiting the halogenation reaction and entering the oxyhalogenation reaction is between about 0.7-2.5M; concentration of the metal halide with the metal ion in the lower oxidation state exiting the oxyhalogenation reaction and entering the electrochemical reaction is between about 0.6-2.5M; or combinations thereof.

In some embodiments of the aforementioned aspect and embodiments, wherein when the oxyhalogenating step (iii) is parallel to the step (i), the method further comprises delivering both the anode electrolyte of the step (i) comprising the metal halide with the metal ion in the higher oxidation state as well as the saltwater of the step (iii) comprising the metal halide with the metal ion in the higher oxidation state to the halogenating step (ii) for the halogenation of the unsaturated or the saturated hydrocarbon. In some embodiments of the aforementioned aspect and embodiments, the method further comprises separating the metal halide solution from the one or more organic compounds after the halogenating step and delivering the metal halide solution to the electrochemical reaction. In some embodiments of the aforementioned aspect and embodiments, concentration of the metal halide with the metal ion in the lower oxidation state exiting the electrochemical reaction and entering the halogenation reaction is between about 0.5-2M; concentration of the metal halide with the metal ion in the lower oxidation state exiting the oxyhalogenation reaction and entering the halogenation reaction is between about 0.5-2.5M; concentration of the metal halide with the metal ion in the lower oxidation state exiting the halogenation reaction and entering the oxyhalogenation reaction and/or entering the electrochemical reaction is between about 0.6-2.5M; or combinations thereof.

In some embodiments of the aforementioned aspect and embodiments, wherein when the oxyhalogenating step (iii) is simultaneous with the step (ii), the method further comprises adding the oxidant to the halogenating step (ii) for the halogenation of the unsaturated hydrocarbon or the saturated hydrocarbon. In some embodiments of the aforementioned aspect and embodiments, concentration of the metal halide with the metal ion in the lower oxidation state exiting the electrochemical reaction and entering the halogenation reaction is between about 0.5-2M; concentration of the metal halide with the metal ion in the lower oxidation state exiting the halogenation reaction and entering the electrochemical reaction is between about 0.6-2.5M; or combination thereof.

In some embodiments of the aforementioned aspect and embodiments, the oxidant is $X_2$ gas. In some embodiments of the aforementioned aspect and embodiments, the oxidant is HX gas and/or HX solution in combination with gas comprising oxygen or ozone, hydrogen peroxide, HXO or salt thereof, $HXO_3$ or salt thereof, $HXO_4$ or salt thereof, or combinations thereof, wherein each X independently is a halogen selected from fluoro, chloro, iodo, and bromo. In some embodiments of the aforementioned aspect and embodiments, the oxidant is HX gas and/or HX solution in combination with gas comprising more than 1% oxygen or ozone gas or between about 1-30% oxygen or ozone gas.

In some embodiments of the aforementioned aspect and embodiments, the yield of the one or more organic compounds is more than 90 wt %.

In some embodiments of the aforementioned aspect and embodiments, the space time yield (STY) of the one or more organic compounds is more than 0.5.

In some embodiments of the aforementioned aspect and embodiments, the method further comprises forming an alkali, water, or hydrogen gas at the cathode. In some embodiments of the aforementioned aspect and embodiments, the cathode electrolyte comprises water and the cathode is an oxygen depolarizing cathode that reduces oxygen and water to hydroxide ions; the cathode electrolyte comprises water and the cathode is a hydrogen gas producing cathode that reduces water to hydrogen gas and hydroxide ions; the cathode electrolyte comprises hydrochloric acid and the cathode is a hydrogen gas producing cathode that reduces hydrochloric acid to hydrogen gas; or the cathode electrolyte comprises hydrochloric acid and the cathode is an oxygen depolarizing cathode that reacts hydrochloric acid and oxygen gas to form water.

In some embodiments of the aforementioned aspect and embodiments, metal ion in the metal halide is selected from the group consisting of iron, chromium, copper, tin, silver, cobalt, uranium, lead, mercury, vanadium, bismuth, titanium, ruthenium, osmium, europium, zinc, cadmium, gold, nickel, palladium, platinum, rhodium, iridium, manganese, technetium, rhenium, molybdenum, tungsten, niobium, tantalum, zirconium, hafnium, and combination thereof.

In some embodiments of the aforementioned aspect and embodiments, metal ion in the metal halide is selected from the group consisting of iron, chromium, copper, and tin. In some embodiments of the aforementioned aspect and embodiments, metal ion in the metal halide is copper. In some embodiments of the aforementioned aspect and embodiments, the lower oxidation state of metal ion in the metal halide is 1+, 2+, 3+, 4+, or 5+. In some embodiments of the aforementioned aspect and embodiments, the higher oxidation state of metal ion in the metal halide is 2+, 3+, 4+, 5+, or 6+. In some embodiments of the aforementioned aspect and embodiments, metal ion in the metal halide is selected from copper that is converted from $Cu^{+}$ to $Cu^{2+}$, iron that is converted from $Fe^{2+}$ to $Fe^{3+}$, tin that is converted from $Sn^{2+}$ to $Sn^{4+}$, chromium that is converted from $Cr^{2+}$ to $Cr^{3+}$, platinum that is converted from $Pt^{2+}$ to $Pt^{4+}$, or combination thereof.

In some embodiments of the aforementioned aspect and embodiments, the metal halide with the metal ion in the lower oxidation state in step (ii) is re-circulated back to the anode electrolyte of step (i).

In some embodiments of the aforementioned aspect and embodiments, the unsaturated hydrocarbon is ethylene, propylene, or butylene which reacts with the anode electrolyte comprising the metal halide with the metal ion in the higher oxidation state to form ethylene dichloride, propylene dichloride or dichlorobutane, respectively.

In some embodiments of the aforementioned aspect and embodiments, the method further comprises forming vinyl chloride monomer from the ethylene dichloride and forming poly(vinyl chloride) from the vinyl chloride monomer. In some embodiments, the vinyl chloride monomer formation from the ethylene dichloride results in formation of HCl. In such embodiments, the aforementioned methods further comprise using the HCl as the oxidant in the oxyhalogenation.

In some embodiments of the aforementioned aspect and embodiments, the saturated hydrocarbon is methane, ethane, or propane.

In some embodiments of the aforementioned aspect and embodiments, the unsaturated hydrocarbon is a C2-C10 alkene or the saturated hydrocarbon is C2-C10 alkane.

In some embodiments of the aforementioned aspect and embodiments, total amount of the metal halide in the lower oxidation state and the higher oxidation state in step (i), step (ii), and/or step (iii) is between 5-12M.

In some embodiments of the aforementioned aspect and embodiments, the metal halide with the metal ion in the higher oxidation state is in range of 4-10M and/or the metal halide with the metal ion in the lower oxidation state is in range of 0.1-3M.

In one aspect, there is provided a system comprising:

an electrochemical cell comprising an anode in contact with an anode electrolyte wherein the anode electrolyte comprises metal halide and saltwater; a cathode in contact with a cathode electrolyte; and a voltage source configured to apply a voltage to the anode and the cathode wherein the anode is configured to oxidize the metal halide with the metal ion from a lower oxidation state to a higher oxidation state;

a halogenation reactor operably connected to the electrochemical cell and an oxyhalogenation reactor wherein the halogenation reactor is configured to receive the anode electrolyte comprising the metal halide with the metal ion in the higher oxidation state from the electrochemical cell and/or configured to receive the metal halide solution with the metal ion in the higher oxidation state from the oxyhalogenation reactor and halogenate an unsaturated hydrocarbon or a saturated hydrocarbon with the metal halide with the metal ion in the higher oxidation state to result in one or more organic compounds or enantiomers thereof and the metal halide solution with the metal ion in the lower oxidation state; and the oxyhalogenation reactor operably connected to the electrochemical cell and/or the halogenation reactor and configured to oxyhalogenate the metal halide with the metal ion from the lower oxidation state to the higher oxidation state in presence of an oxidant.

In some embodiments of the aforementioned aspect, the oxyhalogenation reactor is in series with the electrochemical cell, the electrochemical cell is in series with the oxyhalogenation reactor, the oxyhalogenation reactor is parallel to the electrochemical cell, and/or the oxyhalogenation reactor is simultaneous with the halogenation reactor.

In some embodiments of the aforementioned aspect and embodiments, the electrochemical cell, the halogenation reactor and the oxyhalogenation reactor are all configured to carry out the reactions in saltwater. In some embodiments of the aforementioned aspect and embodiments, the electrochemical cell, the halogenation reactor and the oxyhalogenation reactor are made of corrosion resistant materials.

BRIEF DESCRIPTION OF THE DRAWINGS

The novel features of the invention are set forth with particularity in the appended claims. A better understanding of the features and advantages of the present invention may be obtained by reference to the following detailed description that sets forth illustrative embodiments, in which the principles of the invention are utilized, and the accompanying drawings of which:

DETAILED DESCRIPTION

Figure 1:
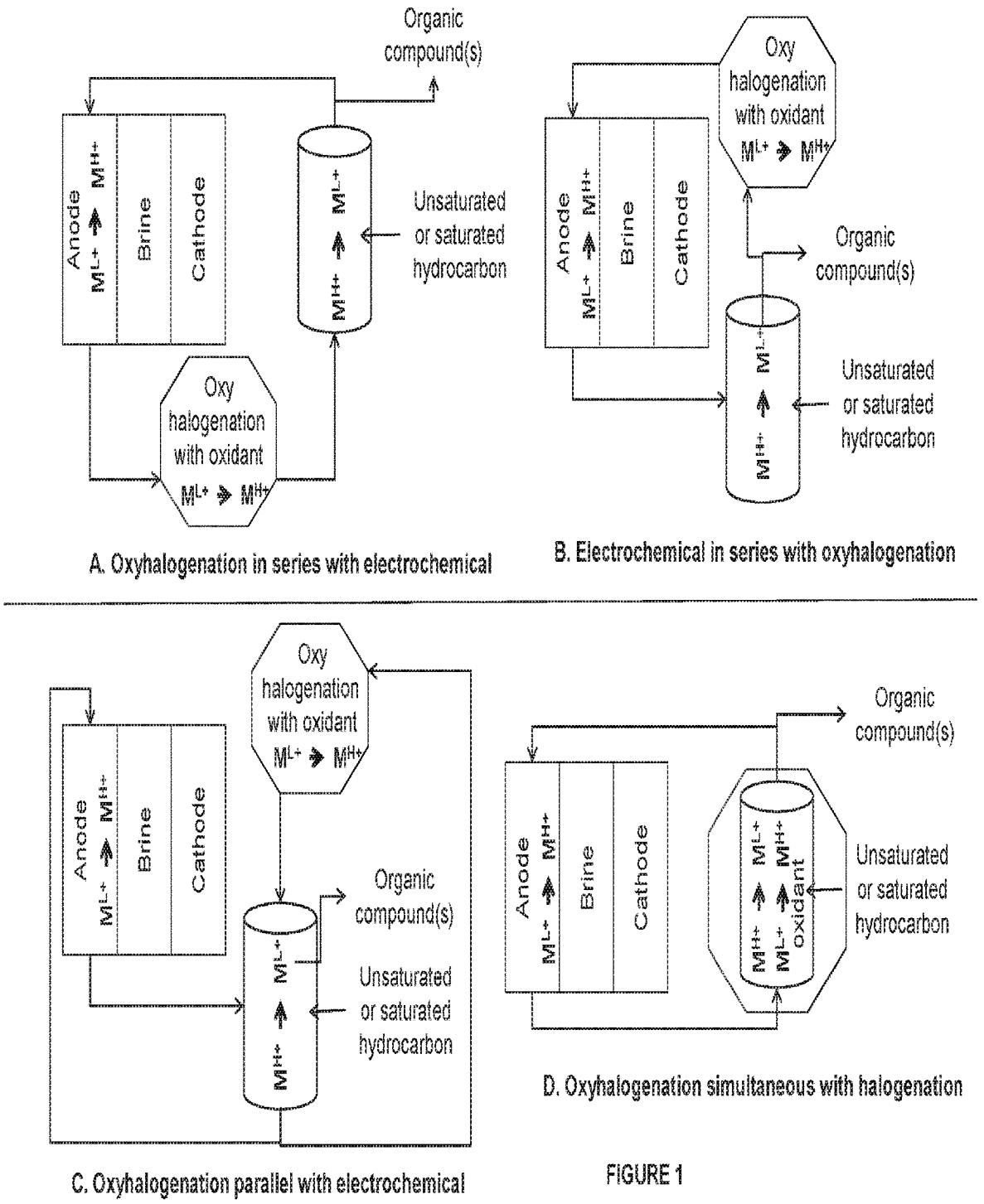
FIG. 1 is an illustration of some embodiments related to the electrochemical system, halogenation system, and the oxyhalogenation system.

Disclosed herein are systems and methods that relate to various combinations of an oxyhalogenation system with electrochemical and halogenation systems. These systems provide an efficient and low energy consuming systems that use metal halide redox shuttles to form one or more organic compounds or enantiomers thereof via halogenation of unsaturated or saturated hydrocarbons.

As can be appreciated by one ordinarily skilled in the art, the present electrochemical system and method can be configured with an alternative, equivalent salt solution, e.g., an alkali metal ion or alkaline earth metal ion solution, e.g. potassium chloride solution or sodium chloride solution or lithium chloride solution or a magnesium chloride solution or calcium chloride solution or sodium sulfate solution or ammonium chloride solution, to produce an equivalent alkaline solution, e.g., potassium hydroxide or sodium hydroxide or magnesium hydroxide in the cathode electrolyte (or other reactions at the cathode described herein). This salt solution can be used as an anode electrolyte, cathode electrolyte, and/or brine in the middle compartment. Accordingly, to the extent that such equivalents are based on or suggested by the present system and method, these equivalents are within the scope of the application.

Before the present invention is described in greater detail, it is to be understood that this invention is not limited to particular embodiments described, as such may, of course, vary. It is also to be understood that the terminology used herein is for the purpose of describing particular embodiments only and is not intended to be limiting.

Where a range of values is provided, it is understood that each intervening value, to the tenth of the unit of the lower limit unless the context clearly dictates otherwise, between the upper and lower limit of that range and any other stated or intervening value in that stated range, is encompassed within the invention. The upper and lower limits of these smaller ranges may independently be included in the smaller ranges and are also encompassed within the invention, subject to any specifically excluded limit in the stated range. Where the stated range includes one or both of the limits, ranges excluding either or both of those included limits are also included in the invention.

Certain ranges that are presented herein with numerical values may be construed as "about" numericals. The "about" is to provide literal support for the exact number that it precedes, as well as a number that is near to or approximately the number that the term precedes. In determining whether a number is near to or approximately a specifically recited number, the near or approximating unrequited number may be a number, which, in the context in which it is presented, provides the substantial equivalent of the specifically recited number.

Unless defined otherwise, all technical and scientific terms used herein have the same meaning as commonly understood by one of ordinary skill in the art to which this invention belongs. Although any methods and materials similar or equivalent to those described herein can also be used in the practice or testing of the present invention, representative illustrative methods and materials are now described.

All publications and patents cited in this specification are herein incorporated by reference as if each individual publication or patent were specifically and individually indicated to be incorporated by reference and are incorporated herein by reference to disclose and describe the methods and/or materials in connection with which the publications are cited. The citation of any publication is for its disclosure prior to the filing date and should not be construed as an admission that the present invention is not entitled to antedate such publication by virtue of prior invention. Further, the dates of publication provided may be different from the actual publication dates which may need to be independently confirmed.

It is noted that, as used herein and in the appended claims, the singular forms "a," "an," and "the" include plural references unless the context clearly dictates otherwise. It is further noted that the claims may be drafted to exclude any optional element. As such, this statement is intended to serve as antecedent basis for use of such exclusive terminology as "solely," "only" and the like in connection with the recitation of claim elements, or use of a "negative" limitation.

As will be apparent to those of skill in the art upon reading this disclosure, each of the individual embodiments described and illustrated herein has discrete components and features which may be readily separated from or combined with the features of any of the other several embodiments without departing from the scope or spirit of the present invention. Any recited method can be carried out in the order of events recited or in any other order which is logically possible.

Methods and Systems

There are provided methods and systems that relate to the integration of oxyhalogenation system with the electrochemical and halogenation systems that use metal halide redox shuttles to carry out the halogenation of the unsaturated or saturated hydrocarbons to form one or more organic compounds or enantiomers thereof. The electrochemical and halogenation methods and systems have been described in detail in U.S. patent application Ser. No. 13/474,598, filee May 17, 2012, which is incorporated herein by reference in its entirety. The coupling of the oxyhalogenation system with the electrochemical and halogenation systems results in a more efficient and low energy consuming systems to form the herein explained one or more organic compounds.

In the electrochemical system, oxidation of metal ions, such as, metal halides, from a lower oxidation state to a higher oxidation state occurs in the anode chamber of the electrochemical cell. The metal halide with the metal ion in the higher oxidation state may be then used in the halogenation systems by reaction with the unsaturated or saturated hydrocarbons such as, but not limited to, ethylene or ethane for the generation of the one or more organic compounds or enantiomers thereof, e.g. ethylene dichloride and other products described herein. The one or more organic compounds or enantiomers thereof include halohydrocarbons as well as any other side products formed in such reactions. Applicants surprisingly found that the oxyhalogenation system carrying out the oxidation of the aqueous metal halide solution by oxidizing the metal ion from the lower oxidation state to the higher oxidation state using an oxidant, can be integrated with the electrochemical and halogenation system in various combinations to enhance the yield and selectivity of the product and/or reduce the voltage of the electrochemical cell. In some embodiments, the integration of the oxyhalogenation system may also result in reuse of the side products. For example, in some embodiments, the integration of the oxyhalogenation system may also result in the use of HCl as an oxidant which is a side product formed during vinyl chloride formation from ethylene dichloride (ethylene dichloride being formed from ethylene during chlorination). The HCl may also be formed during the halogenation reaction as a side product which may optionally be separated and used in the oxyhalogenation reaction. Because of the potential corrosive effect of HCl on the systems, it may have to be separated or neutralized. It is advantageous to use this HCl generated during halogenation reaction before the aqueous stream reaches the electrochemical cell. It may be achieved by using this HCl in the oxyhalogenation reaction.

In one aspect, there are provided methods that include (i) contacting an anode with an anode electrolyte wherein the anode electrolyte comprises metal halide and saltwater; contacting a cathode with a cathode electrolyte; applying a voltage to the anode and the cathode and oxidizing the metal halide with metal ion in a lower oxidation state to a higher oxidation state at the anode; (ii) halogenating an unsaturated hydrocarbon or a saturated hydrocarbon with the metal halide with the metal ion in the higher oxidation state in the saltwater to result in one or more organic compounds or enantiomers thereof and the metal halide with the metal ion in the lower oxidation state; and (iii) oxyhalogenating the metal halide with the metal ion in the lower oxidation state to the higher oxidation state in presence of an oxidant. In some embodiments of the aforementioned aspect, the method further comprises delivering the anode electrolyte from the step (i) to the halogenation step (ii) and/or the oxyhalogenation step (iii); delivering the saltwater comprising the metal halide with the metal ion in the lower oxidation state from step (ii) to step (i) and/or step (iii); and/or delivering the saltwater from step (iii) comprising the metal halide with the metal ion in the higher oxidation state to step (i) and/or step (ii). In some embodiments of the foregoing aspect, the step (iii) is in series with the step (i) (i.e. step (iii) is downstream of step (i) as described further herein below), the step (i) is in series with the step (iii) (step (i) is downstream of step (iii) as described further herein below), the step (iii) is parallel to the step (i), and/or the step (iii) is simultaneous with the step (ii). It is to be understood that one or more combinations of these systems may be carried out together. For example, the step (iii) in series with the step (i) and the step (i) in series with the step (iii) may be both integrated in a single unit or may be two separate units running in a plant. Similarly, other combinations may be carried out in a single unit or as separate units in one plant.

In some embodiments, there are provided systems that carry out the methods described herein.

In some embodiments, there are provided systems that include an electrochemical cell comprising an anode in contact with an anode electrolyte wherein the anode electrolyte comprises metal halide and saltwater; a cathode in contact with a cathode electrolyte; and a voltage source configured to apply a voltage to the anode and the cathode wherein the anode is configured to oxidize the metal halide with the metal ion from a lower oxidation state to a higher oxidation state;

a halogenation reactor operably connected to the electrochemical cell and an oxyhalogenation reactor wherein the halogenation reactor is configured to receive the anode electrolyte comprising the metal halide with the metal ion in the higher oxidation state from the electrochemical cell and/or configured to receive the metal halide solution with the metal ion in the higher oxidation state from the oxyhalogenation reactor and halogenate an unsaturated hydrocarbon or a saturated hydrocarbon with the metal halide with the metal ion in the higher oxidation state to result in one or more organic compounds or enantiomers thereof and the metal halide solution with the metal ion in the lower oxidation state; and the oxyhalogenation reactor operably connected to the electrochemical cell and/or the halogenation reactor and configured to oxyhalogenate the metal halide with the metal ion from the lower oxidation state to the higher oxidation state in presence of an oxidant.

In some embodiments of the aforementioned system, the oxyhalogenation reactor operably connected to the halogenation reactor, includes configuration to be connected to the halogenation reactor or integrated/simultaneous with the halogenation reactor.

In some embodiments of the aforementioned systems, the oxyhalogenation reactor is in series with the electrochemical cell, the electrochemical cell is in series with the oxyhalogenation reactor, the oxyhalogenation reactor is parallel to the electrochemical cell, and/or the oxyhalogenation reactor is simultaneous with the halogenation reactor.

An illustration of the oxyhalogenation system in various combinations with the electrochemical system and halogenation system is as shown in FIG. 1. The oxyhalogenation method/system, the electrochemical method/system, and the halogenation method/system are all described in detail herein.

In FIG. 1, the electrochemical system is depicted as having an anode and a cathode separated by anion exchange membrane and cation exchange membrane creating a third middle chamber containing a third electrolyte, such as saltwater, e.g. alkali metal halide or alkaline earth metal halide including but not limited to, sodium halide such as sodium chloride, sodium bromide, sodium iodide solution; potassium halide, such as potassium chloride, potassium bromide, potassium iodide solution; lithium halide, such as lithium chloride, lithium bromide, lithium iodide solution; magnesium halide such as magnesium chloride, magnesium iodide, magnesium bromide solution; calcium halide such as calcium chloride, calcium iodide, calcium bromide solution; strontium halide solution, or barium halide solution etc. The anode chamber includes the anode and an anode electrolyte in contact with the anode. In some embodiments, the anode electrolyte comprises saltwater and metal halide. The saltwater comprises alkali metal ions such as, for example only, alkali metal halide or alkaline earth metal ions such as, for example only, alkaline earth metal halide, as described above. The cathode chamber includes the cathode and a cathode electrolyte in contact with the cathode. The cathode electrolyte may also contain saltwater containing alkali metal ions such as, for example only, alkali metal halide or alkaline earth metal ions such as, for example only, alkaline earth metal halide, as described above. A combination of the alkali metal halide and the alkaline earth metal halide may also be present in anode electrolyte, cathode electrolyte, and/or middle chamber. The cathode electrolyte may also contain alkali metal hydroxide. The metal ion of the metal halide is oxidized in the anode chamber of the electrochemical cell from the lower oxidation state $M^{L+}$ to the higher oxidation state $M^{H+}$. In FIG. 1, the oxyhalogenation system is depicted as a system with an oxidant where the oxidant oxidizes the metal ion of the metal halide from the lower oxidation state $M^{L+}$ to the higher oxidation state $M^{H+}$. Further in FIG. 1, the halogenation system is illustrated as a system that uses metal halide with the metal ion in the higher oxidation state and halogenates the unsaturated or the saturated hydrocarbon to form one or more compounds or enantiomers thereof, and the metal ion of the metal halide gets reduced from the higher oxidation state $M^{H+}$ to the lower oxidation state $M^{L+}$. It is to be understood that while the metal ion of the metal halide is oxidized from the lower to the higher oxidation state (electrochemical and oxyhalogenation reactions) or reduced from the higher to the lower oxidation state (halogenation reaction) in the systems herein, there always is a mixture of the metal halide with the metal ion in the lower oxidation state and the higher oxidation state in each of the systems. It is also to be understood that the figures presented herein are for illustration purposes only and only illustrate few modes of the systems. The detailed embodiments of each of the systems are described herein and all the combinations of such detailed embodiments can be combined to carry out the invention.

In the embodiments herein, all the methods/systems including electrochemical, halogenation, and oxyhalogenation methods/systems comprise metal halide in saltwater. Various examples of saltwater have been described herein. Further, in the embodiments herein, all the methods/systems including electrochemical, halogenation, and oxyhalogenation methods/systems comprise metal halide in lower oxidation state and higher oxidation state in saltwater. For example only, in the embodiments herein, all the methods/systems including electrochemical, halogenation, and oxyhalogenation methods/systems comprise copper halide, such as copper chloride, in saltwater. In the embodiments herein, the oxidation of the aqueous solution of the metal halide with the metal ion oxidized from the lower oxidation state to the higher oxidation state in the electrochemical reaction or the oxyhalogenation reaction or the reduction of the aqueous solution of the metal halide with the metal ion reduced from the higher oxidation state to the lower oxidation state in the halogenation reaction is all carried out in the aqueous medium such as saltwater. Examples of saltwater include water comprising alkali metal ions such as alkali metal halides or alkaline earth metal ions such as alkaline earth metal halides. Examples include, without limitation, sodium halide, potassium halide, lithium halide, calcium halide, magnesium halide etc. Halide includes any halogen from chloro, bromo, iodo, or fluoro.

In some embodiments as illustrated in FIG. 1, the oxyhalogenation method/system is in series with the electrochemical method/system (A). The "oxyhalogenation method/system in series with the electrochemical method/system" as used herein includes the oxyhalogenation method/system downstream of the electrochemical method/system where the effluent stream of the electrochemical method/system is transferred to the oxyhalogenation method/system. In embodiments where the oxyhalogenation is in series with the electrochemical reaction, the saltwater from the anode chamber of the electrochemical cell containing the metal halide with the metal ion in the higher oxidation state is transferred to the oxyhalogenation reaction where an oxidant (described in detail herein below) further oxidizes the metal halide with the metal ion from the lower to the higher oxidation state. The metal halide solution with the metal ion in the higher oxidation state is then transferred from the oxyhalogenation reaction to the halogenation reaction (halogenation method/system is downstream of the oxyhalogenation method/system) where a reaction with the unsaturated or the saturated hydrocarbon, such as, ethylene or ethane produces one or more organic compounds or enantiomers thereof and the metal halide with the metal ion in the lower oxidation state. The metal halide solution from the halogenation reaction containing the metal halide with the metal ion in the lower oxidation state is separated from the one or more organic compounds and is transferred back to the electrochemical cell.

Accordingly, in one aspect there is provided a method comprising (i) contacting an anode with an anode electrolyte wherein the anode electrolyte comprises metal halide and saltwater; contacting a cathode with a cathode electrolyte; applying a voltage to the anode and the cathode and oxidizing the metal halide with metal ion in a lower oxidation state to a higher oxidation state at the anode; (ii) halogenating an unsaturated hydrocarbon or a saturated hydrocarbon with the metal halide with the metal ion in the higher oxidation state in the saltwater to result in one or more organic compounds or enantiomers thereof and the metal halide with the metal ion in the lower oxidation state; and (iii) oxyhalogenating the metal halide with the metal ion in the lower oxidation state to the higher oxidation state in presence of an oxidant, wherein the step (iii) is in series with the step (i). In some embodiments of the aforementioned aspect, when the oxyhalogenating step (iii) is in series with the step (i) (when the oxyhalogenating step (iii) is downstream of the electrochemical step (i)), the method further comprises delivering the anode electrolyte comprising the saltwater and the metal halide with the metal ion in the lower and the higher oxidation state from the step (i) to the step (iii) wherein the step (iii) oxyhalogenates the metal halide with the metal ion in the lower oxidation state to the higher oxidation state in the saltwater. In some embodiments, the method further comprises delivering the metal halide with the metal ion in the higher oxidation state and the saltwater of the oxyhalogenation step (iii) to the halogenating step (ii) for the halogenation of the unsaturated hydrocarbon or the saturated hydrocarbon. In some embodiments, the method further comprises separating the one or more organic compounds or enantiomers thereof from the metal halide solution with the metal ion in the lower oxidation state after the halogenating step (ii). In some embodiments, the method further comprises recirculating back the metal halide with the metal ion in the lower oxidation state in the saltwater after the halogenating step (ii) to the anode electrolyte of the step (i).

In another aspect, there is provided a system comprising an electrochemical cell comprising an anode in contact with an anode electrolyte wherein the anode electrolyte comprises metal halide and saltwater; a cathode in contact with a cathode electrolyte; and a voltage source configured to apply a voltage to the anode and the cathode wherein the anode is configured to oxidize the metal halide with the metal ion from a lower oxidation state to a higher oxidation state; an oxyhalogenation reactor operably connected to the electrochemical cell and a halogenation reactor and configured to receive the anode electrolyte from the electrochemical cell and oxyhalogenate the metal halide with the metal ion in the lower oxidation state to the higher oxidation state in presence of an oxidant; and a halogenation reactor operably connected to the electrochemical cell and the oxyhalogenation reactor wherein the halogenation reactor is configured to receive the metal halide solution with the metal ion in the higher oxidation state from the oxyhalogenation reactor and halogenate an unsaturated hydrocarbon or a saturated hydrocarbon with the metal halide with the metal ion in the higher oxidation state to result in one or more organic compounds or enantiomers thereof and the metal halide solution with the metal ion in the lower oxidation state, wherein the oxyhalogenation reactor is in series with the electrochemical cell.

In some embodiments of the aforementioned aspect, when the oxyhalogenating reactor is in series with the electrochemical cell, the system further comprises a conduit or a pipe or a delivery system (fitted with valves etc.) operably connected between the electrochemical cell and the oxyhalogenation reactor configured to deliver the anode electrolyte comprising the saltwater and the metal halide with the metal ion in the lower and the higher oxidation state from the electrochemical cell to the oxyhalogenation reactor wherein the oxyhalogenation reactor is configured to oxyhalogenate the metal halide with the metal ion in the lower oxidation state to the higher oxidation state in the saltwater. In some embodiments, the system further comprises a conduit or a pipe or a delivery system (fitted with valves etc.) operably connected between the oxyhalogenation reactor and the halogenation reactor and configured to deliver the metal halide solution containing the metal ion in the higher oxidation state and the saltwater of the oxyhalogenation reactor to the halogenating reactor for the halogenation of the unsaturated hydrocarbon or the saturated hydrocarbon to form one or more organic compounds or enantiomers thereof. In some embodiments, the system further comprises a separator operably connected to the halogenation reactor and the electrochemical cell and configured to separate the one or more organic compounds or enantiomers thereof from the metal halide with the metal ion in the lower oxidation state in the saltwater after the halogenating reactor. In some embodiments, the separator is further configured to deliver the metal halide solution with the metal ion in the lower oxidation state to the electrochemical cell. In some embodiments, the system further comprises a conduit or a pipe or a delivery system (fitted with valves etc.) operably connected between the halogenation reactor and the electrochemical cell and configured to recirculate back the saltwater after the halogenating reactor to the anode electrolyte of the electrochemical cell. The examples of conduits include, without limitation, pipes, tubes, tanks, and other means for transferring the liquid solutions. In some embodiments, the conduits attached to the systems also include means for transferring gases such as, but not limited to, pipes, tubes, tanks, and the like. The gases include, for example only, ethylene or ethane gas to the halogenation reactor, oxygen or ozone gas to the oxyhalogenation reactor, or the oxygen gas to the cathode chamber of the electrochemical cell etc.

In some embodiments of the method and system aspects and embodiments provided herein, Applicants surprisingly found that the concentration of the metal halide with the metal ion in the lower oxidation state, the concentration of the metal halide with the metal ion in the higher oxidation state, and the concentration of the salt in the water (e.g. alkali metal halide), each individually or collectively may affect the performance of each of the electrochemical cell/reaction, oxyhalogenation reactor/reaction, and halogenation reactor/reaction. Since the electrochemical cell/reaction, oxyhalogenation reactor/reaction, and halogenation reactor/reaction are interconnected in various combinations in the present invention, it was found that the concentrations of the metal halide with lower and higher oxidation state and the salt concentration exiting the systems/reactions and entering the systems/reactions may affect the performance, yield, selectivity, STY, and/or voltage as applicable to the systems.

In some embodiments of the aforementioned method and system aspects and embodiments, when the oxyhalogenation is in series with the electrochemical reaction, the concentration of the metal halide with the metal ion in the lower oxidation state (also containing metal halide with the metal ion in the higher oxidation state) exiting the electrochemical cell/reaction and entering the oxyhalogenation reactor/reaction is greater than 0.4M; or between 0.4-2.4M; or between 0.4-2M; or between 0.4-1.5M; or between 0.4-1M; or between 0.5-2.4M; or between 0.5-2M; or between 0.5-1.5M; or between 0.5-1M; or between 0.6-2.4M; or between 0.6-2M; or between 0.6-1.5M; or between 0.6-1M; or between 1-2.4M; or between 1-2M; or between 1-1.5M; or between 1.5-2.4M; or between 1.5-2M. In some embodiments of the aforementioned method and system aspects and embodiments, the concentration of the metal halide with the metal ion in the lower oxidation state exiting the electrochemical cell/reaction and entering the oxyhalogenation reactor/reaction is between 0.5-2M; or between 0.5-1.5M; or between 0.5-1M.

In some embodiments of the aforementioned method and system aspects and embodiments, the concentration of the metal halide with the metal ion in the lower oxidation state exiting the oxyhalogenation reactor/reaction and entering the halogenation reactor/reaction is greater than 0M; or greater than 0.1M; or between 0-2M; or between 0-1.8M; or between 0-1.5M; or between 0-1M; or between 0.1-2M; or between 0.1-1.8M; or between 0.1-1.5M; or between 0.1-1M; or between 0.5-2M; or between 0.5-1.8M; or between 0.5-1.5M; or between 0.5-1M; or between 1-2M; or between 1-1.8M; or between 1-1.5M. In some embodiments of the aforementioned method and system aspects and embodiments, the concentration of the metal halide with the metal ion in the lower oxidation state exiting the oxyhalogenation reactor/reaction and entering the halogenation reactor/reaction is between 0.1-1.8M; or between 0.1-1.5M; or between 0.1-1M.

In some embodiments of the aforementioned method and system aspects and embodiments, the concentration of the metal halide with the metal ion in the lower oxidation state exiting the halogenation reactor/reaction and entering the electrochemical cell/reaction is between 0.5-2.5M; or between 0.5-2M; or between 0.5-1.5M; or between 0.5-1M; 0.6-2.5M; or between 0.6-2M; or between 0.6-1.5M; or between 0.6-1M; or between 1-2.5M; or between 1-2M; or between 1-1.5M; or between 1-1.2M; or between 1.5-2M. In some embodiments of the aforementioned method and system aspects and embodiments, the concentration of the metal halide with the metal ion in the lower oxidation state exiting the halogenation reactor/reaction and entering the electrochemical cell/reaction is between 0.6-2.5M; or between 0.6-2M; or between 0.6-1.5M; or between 1-1.5M; or between 1-1.2M.

In some embodiments of the aforementioned method and system aspects and embodiments, when the oxyhalogenation is in series with the electrochemical, the concentration ranges provided above for various systems may be combined in any combination.

In some embodiments of the aforementioned method and system aspects and embodiments, when the oxyhalogenation is in series with the electrochemical reaction, the concentration of the metal halide with the metal ion in the lower oxidation state exiting the electrochemical cell/reaction and entering the oxyhalogenation reactor/reaction is between 0.5-2M; or between 0.5-1.5M; or between 0.5-1M; the concentration of the metal halide with the metal ion in the lower oxidation state exiting the oxyhalogenation reactor/reaction and entering the halogenation reactor/reaction is between 0.1-1.8M; or between 0.1-1.5M; or between 0.1-1M; the concentration of the metal halide with the metal ion in the lower oxidation state exiting the halogenation reactor/reaction and entering the electrochemical cell/reaction is between 0.6-2.5M; or between 0.6-2M; or between 0.6-1.5M; or between 1-1.5M; or between 1-1.2M, or combinations thereof.

Figure 2:
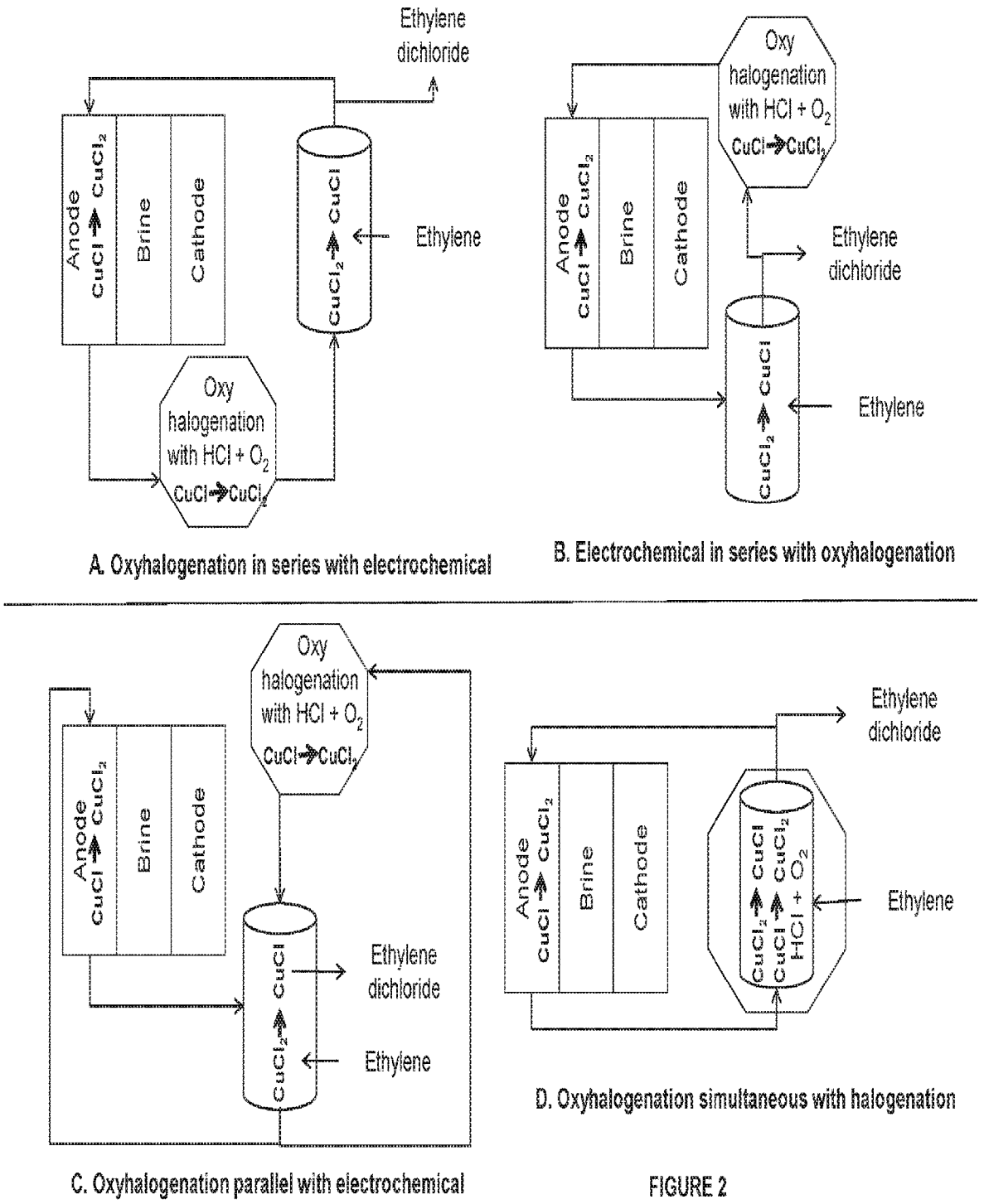
FIG. 2 is an illustration of some embodiments related to the electrochemical system, halogenation system, and the oxyhalogenation system.

An example of the oxyhalogenation in series with the electrochemical reaction is as illustrated in FIG. 2. In A in FIG. 2, CuCl is oxidized to $CuCl_2$ in the anode chamber of the electrochemical cell. The saltwater from the anode chamber of the electrochemical cell containing the $CuCl_2$ is transferred to the oxyhalogenation reaction where the oxidant further oxidizes the CuCl to $CuCl_2$. The $CuCl_2$ solution is then transferred from the oxyhalogenation reaction to the halogenation reaction where a reaction with the unsaturated or the saturated hydrocarbon, such as, ethylene or ethane produces one or more organic compounds or enantiomers thereof, e.g. ethylene dichloride (EDC) and CuCl. The aqueous solution from the halogenation reaction containing the CuCl (also containing $CuCl_2$) is separated from the EDC and is transferred back to the electrochemical cell.

The integration of the oxyhalogenation with the electrochemical reaction in series may have several benefits, including, but not limited to, reduced load on electrochemical reaction to convert the metal halide with the metal ion from the lower oxidation state to the higher oxidation state since the oxyhalogenation can supplement the metal halide oxidation step. Further, a higher concentration of the metal halide with the metal ion in the lower oxidation state can be used in the electrochemical cell as the downstream oxyhalogenation supplements the metal halide oxidation. This may in turn result in voltage savings in the electrochemical cell. Furthermore, the feed to the halogenation reaction will have a higher concentration of the metal halide with the metal ion in the higher oxidation state than can economically be generated using electrochemical reaction alone. This in turn may enhance the yield and selectivity of the product. Additionally, the oxychlorination reaction is exothermic. In some embodiments, the anolyte may have to be cooled down to around 100° C. for the electrochemical cell and heated up to around 160° C. before entering the halogenation reactor. Placing the oxychlorination unit downstream of the electrochemical cell and before the halogenation reactor, can lower steam consumption that may be needed to heat up the anolyte by directly integrating the oxychlorination reaction heat.

In some embodiments as illustrated in FIG. 1, the electrochemical method/system is in series with the oxyhalogenation method/system (B). The "electrochemical method/system in series with the oxyhalogenation method/system" as used herein includes the electrochemical method/system downstream of the oxyhalogenation method/system where the effluent stream of the oxyhalogenation method/system is transferred to the electrochemical method/system.

In embodiments where the electrochemical is in series with the oxyhalogenation reaction, the saltwater from the anode chamber of the electrochemical cell containing the metal halide with the metal ion in the higher oxidation state is transferred to the halogenation reaction (halogenation method/system is downstream of the electrochemical method/system) where a reaction with the unsaturated or the saturated hydrocarbon, such as, ethylene or ethane produces one or more organic compounds or enantiomers thereof and the metal halide with the metal ion in the lower oxidation state. The aqueous solution/saltwater from the halogenation reaction containing the metal halide with the metal ion in the lower oxidation state is separated from the one or more organic compounds (using the separator as described herein) and is transferred to the oxyhalogenation reaction where the oxidant oxidizes the metal halide with the metal ion from the lower to the higher oxidation state. The metal halide solution is then transferred from the oxyhalogenation reaction back to the electrochemical cell for further oxidation of the metal ion of the metal halide.

Accordingly, in one aspect there is provided a method comprising (i) contacting an anode with an anode electrolyte wherein the anode electrolyte comprises metal halide and saltwater; contacting a cathode with a cathode electrolyte; applying a voltage to the anode and the cathode and oxidizing the metal halide with metal ion in a lower oxidation state to a higher oxidation state at the anode; (ii) halogenating an unsaturated hydrocarbon or a saturated hydrocarbon with the metal halide with the metal ion in the higher oxidation state in the saltwater to result in one or more organic compounds or enantiomers thereof and the metal halide with the metal ion in the lower oxidation state; and (iii) oxyhalogenating the metal halide with the metal ion in the lower oxidation state to the higher oxidation state in presence of an oxidant, wherein the step (i) is in series with the step (iii) (when the electrochemical step (i) is downstream of the oxyhalogenating step (iii)). In some embodiments of the aforementioned aspect, when the electrochemical step (i) is in series with the step (iii), the method further comprises delivering the anode electrolyte comprising the saltwater and the metal halide with the metal ion in the lower and the higher oxidation state from the step (i) to halogenating step (ii) for the halogenation of the unsaturated hydrocarbon or the saturated hydrocarbon. In some embodiments, the method further comprises delivering the metal halide with the metal ion in the lower oxidation state in the saltwater of the halogenating step (ii) to the step (iii) wherein the step (iii) oxyhalogenates the metal halide with the metal ion from the lower oxidation state to the higher oxidation state. In some embodiments, the method further comprises delivering the metal halide with the metal ion in the higher oxidation state in the saltwater of the oxyhalogenation step (iii) to the anode electrolyte of step (i). In some embodiments, the method further comprises separating the one or more organic compounds or enantiomers thereof from the metal halide with the metal ion in the lower oxidation state in the saltwater after the halogenating step (ii).

In another aspect, there is provided a system comprising an electrochemical cell comprising an anode in contact with an anode electrolyte wherein the anode electrolyte comprises metal halide and saltwater; a cathode in contact with a cathode electrolyte; and a voltage source configured to apply a voltage to the anode and the cathode wherein the anode is configured to oxidize the metal halide with the metal ion from a lower oxidation state to a higher oxidation state; a halogenation reactor operably connected to the electrochemical cell and an oxyhalogenation reactor wherein the halogenation reactor is configured to receive the anode electrolyte from the electrochemical cell and halogenate an unsaturated hydrocarbon or a saturated hydrocarbon with the metal halide with the metal ion in the higher oxidation state to result in one or more organic compounds or enantiomers thereof and the metal halide with the metal ion in the lower oxidation state; and the oxyhalogenation reactor operably connected to the electrochemical cell and the halogenation reactor and configured to receive the metal halide solution with the metal ion in the lower oxidation state from the halogenation reactor and oxyhalogenate the metal halide with the metal ion from the lower oxidation state to the higher oxidation state in presence of an oxidant, wherein the electrochemical cell is in series with the oxyhalogenation reactor.

In some embodiments of the aforementioned aspect, when the electrochemical step (i) is in series with the oxyhalogenation step (iii), the system further comprises a conduit or a pipe or a delivery system (fitted with valves etc.) operably connected between the electrochemical cell and the halogenation reactor configured for delivering the anode electrolyte comprising the saltwater and the metal halide with the metal ion in the lower and the higher oxidation state from the electrochemical cell to the halogenating reactor for the halogenation of the unsaturated hydrocarbon or the saturated hydrocarbon. In some embodiments, the system further comprises a conduit or a pipe or a delivery system (fitted with valves etc.) operably connected between the halogenation reactor and the oxyhalogenation reactor configured for delivering the metal halide with the metal ion in the lower oxidation state in the saltwater of the halogenation reactor to the oxyhalogenation reactor wherein the oxyhalogenation reactor oxyhalogenates the metal halide with the metal ion from the lower oxidation state to the higher oxidation state. In some embodiments, the system further comprises a conduit or a pipe or a delivery system (fitted with valves etc.) operably connected between the oxyhalogenation reactor and the electrochemical cell configured for delivering the metal halide with the metal ion in the higher oxidation state in the saltwater of the oxyhalogenation reactor to the anode electrolyte of the electrochemical cell. In some embodiments, the system further comprises a separator operably connected to the halogenation reactor and the oxyhalogenation reactor configured to receive the solution of the one or more organic compounds or enantiomers thereof and the metal halide with the metal ion in the lower oxidation state from the halogenation reactor, and to separate the one or more organic compounds or enantiomers thereof from the metal halide with the metal ion in the lower oxidation state in the saltwater after the halogenating reactor. In some embodiments, the separator is further configured to deliver the metal halide with the metal ion in the lower oxidation state to the oxyhalogenation reactor.

The examples of conduits include, without limitation, pipes, tubes, tanks, and other means for transferring the liquid solutions. In some embodiments, the conduits attached to the systems also include means for transferring gases such as, but not limited to, pipes, tubes, tanks, and the like. The gases include, for example only, ethylene or ethane gas to the halogenation reactor, oxygen or ozone gas to the oxyhalogenation reactor, or the oxygen gas to the cathode chamber of the electrochemical cell etc.

In some embodiments of the aforementioned method and system aspects and embodiments, when the electrochemical reaction is in series with the oxyhalogenation, the concentration of the metal halide with the metal ion in the lower oxidation state exiting the electrochemical cell/reaction and entering the halogenation reactor/reaction is greater than 0.4M; or between 0.4-2.4M; or between 0.4-2M; or between 0.4-1.5M; or between 0.4-1M; or between 0.5-2.4M; or between 0.5-2M; or between 0.5-1.5M; or between 0.5-1M; or between 0.6-2.4M; or between 0.6-2M; or between 0.6-1.5M; or between 0.6-1M; or between 1-2.4M; or between 1-2M or between 1-1.5M; or between 1.5-2.4M; or between 1.5-2M. In some embodiments of the aforementioned method and system aspects and embodiments, the concentration of the metal halide with the metal ion in the lower oxidation state exiting the electrochemical cell/reaction and entering the halogenation reactor/reaction is between 0.5-2M; or between 0.5-1.5M; or between 0.5-1M.

In some embodiments of the aforementioned method and system aspects and embodiment, the concentration of the metal halide with the metal ion in the lower oxidation state exiting the halogenation reactor/reaction and entering the oxyhalogenation reactor/reaction is greater than 0.7M; or between 0.7-3M; or between 0.7-2.5M; or between 0.7-2M; or between 0.7-1.5M; or between 0.7-1M; or between 1-3M; or between 1-2.5M; or between 1-2M; or between 1-1.5M; or between 1.5-3M; or between 1.5-2.5M; or between 1.5-2M; or between 2-3M; or between 2-2.5M; or between 2.5-3M. In some embodiments of the aforementioned method and system aspects and embodiments, the concentration of the metal halide with the metal ion in the lower oxidation state exiting the halogenation reactor/reaction and entering the oxyhalogenation reactor/reaction is between 0.7-2.5M; or between 0.7-2M; or between 0.7-1.5M; or between 0.7-1M.

In some embodiments of the aforementioned method and system aspects and embodiments, the concentration of the metal halide with the metal ion in the lower oxidation state exiting the oxyhalogenation reactor/reaction and entering the electrochemical cell/reaction is between 0.5-2.5M; or between 0.5-2M; or between 0.5-1.5M; or between 0.5-1M; between 0.6-2.5M; or between 0.6-2M; or between 0.6-1.5M; or between 0.6-1M; or between 1-2.5M; or between 1-2M; or between 1-1.5M; or between 1-1.2M; or between 1.5-2M. In some embodiments of the aforementioned method and system aspects and embodiments, the concentration of the metal halide with the metal ion in the lower oxidation state exiting the oxyhalogenation reactor/reaction and entering the electrochemical cell/reaction is between 0.6-2.5M; or between 0.6-2M; or between 0.6-1.5M; or between 1-1.5M; or between 1-1.2M.

In some embodiments of the aforementioned method and system aspects and embodiments, when the electrochemical reaction is in series with the oxyhalogenation, the concentration ranges provided above for various systems may be combined in any combination.

In some embodiments of the aforementioned method and system aspects and embodiments, when the electrochemical reaction is in series with the oxyhalogenation, the concentration of the metal halide with the metal ion in the lower oxidation state exiting the electrochemical cell/reaction and entering the halogenation reactor/reaction is between 0.5-2M; or between 0.5-1.5M; or between 0.5-1M; the concentration of the metal halide with the metal ion in the lower oxidation state exiting the halogenation reactor/reaction and entering the oxyhalogenation reactor/reaction is between 0.7-2.5M; or between 0.7-2M; or between 0.7-1.5M; or between 0.7-1M; the concentration of the metal halide with the metal ion in the lower oxidation state exiting the oxyhalogenation reactor/reaction and entering the electrochemical cell/reaction is between 0.6-2.5M; or between 0.6-2M; or between 0.6-1.5M; or between 1-1.5M; or between 1-1.2M; or combinations thereof.

An example of the electrochemical in series with the oxyhalogenation reaction is as illustrated in FIG. 2. In B in FIG. 2, CuCl is oxidized to $CuCl_2$ in the anode chamber of the electrochemical cell. The saltwater from the anode chamber of the electrochemical cell containing the $CuCl_2$ is transferred to the halogenation reaction where a reaction with the unsaturated or the saturated hydrocarbon, such as, ethylene or ethane produces one or more organic compounds or enantiomers thereof, e.g. ethylene dichloride (EDC) and CuCl. The aqueous solution from the halogenation reaction containing the CuCl (also containing $CuCl_2$) is separated from the EDC and is transferred to the oxyhalogenation reaction where the oxidant oxidizes the CuCl to $CuCl_2$. The $CuCl_2$ solution (also containing CuCl) is then transferred from the oxyhalogenation reaction to the electrochemical cell.

The integration of the electrochemical in series with the oxyhalogenation may result in several benefits including, but not limited to, allow higher concentration of the metal halide in the lower oxidation state to come out of the halogenation reaction and be oxidized in the oxyhalogenation reaction before being administered into the electrochemical cell. In some embodiments, higher concentrations of the metal halides in the lower oxidation state such as e.g. CuCl are insoluble in the electrochemical cell at certain temperatures. Therefore, oxidation of the CuCl to $CuCl_2$ in the oxyhalogenation step before electrochemical step may reduce the amount of CuCl in the electrochemical system thereby reducing the solubility issues. The inclusion of oxyhalogenation may also result in reduced recirculation rate of the metal halide solution (and build up of imputrities and side products) between the halogenation reaction and electrochemical reaction. Furthermore, the integration of the oxyhalogenation may reduce the steps to remove organic compounds from the aqueous solution before the solution is administered from the halogenation reactor into the electrochemical cell.

In some embodiments illustrated in FIG. 1, the oxyhalogenation method/system may be parallel with the electrochemical method/system (C). The "oxyhalogenation method/system parallel with the electrochemical method/system" as used herein includes the halogenation method/system downstream of the oxyhalogenation method/system as well as downstream of the electrochemical method/system where the effluent stream of the oxyhalogenation method/system as well as effluent stream of the electrochemical method/system is transferred to the halogenation method/system.

In embodiments where the oxyhalogenation is parallel with the electrochemical reaction, the saltwater from the anode chamber of the electrochemical cell containing the metal halide with the metal ion in the higher oxidation state is transferred to the halogenation reaction where a reaction with the unsaturated or the saturated hydrocarbon, such as, ethylene or ethane produces one or more organic compounds or enantiomers thereof and the metal halide with the metal ion in the lower oxidation state. The aqueous solution or the saltwater from the halogenation reaction containing the metal halide with the metal ion in the lower oxidation state is separated from the one or more organic compounds and is transferred back to the electrochemical cell. Additionally, the solution from the oxyhalogenation reaction where the oxidant oxidizes the metal halide with the metal ion in the lower to the higher oxidation state is transferred to the same halogenation reaction where a reaction of the metal halide with the metal ion in the higher oxidation state with the unsaturated or the saturated hydrocarbon, such as, ethylene or ethane produces one or more organic compounds or enantiomers thereof and the metal halide with the metal ion in the lower oxidation state. The aqueous solution from the halogenation reaction containing the metal halide with the metal ion in the lower oxidation state is separated from the one or more organic compounds and is transferred back to the oxyhalogenation reaction. Therefore, in this system, the saltwater containing the metal halide from both the electrochemical cell as well as the oxyhalogenation reactor (system) are administered to the halogenation reactor (system) and the saltwater from the halogenation reactor (system) after separation from the organic products, is recirculated back to both the electrochemical cell as well as the oxyhalogenation reactor.

Accordingly, in one aspect there is provided a method comprising (i) contacting an anode with an anode electrolyte wherein the anode electrolyte comprises metal halide and saltwater; contacting a cathode with a cathode electrolyte; applying a voltage to the anode and the cathode and oxidizing the metal halide with metal ion in a lower oxidation state to a higher oxidation state at the anode; (ii) halogenating an unsaturated hydrocarbon or a saturated hydrocarbon with the metal halide with the metal ion in the higher oxidation state in the saltwater to result in one or more organic compounds or enantiomers thereof and the metal halide with the metal ion in the lower oxidation state; and (iii) oxyhalogenating the metal halide with the metal ion in the lower oxidation state to the higher oxidation state in presence of an oxidant, wherein the step (iii) is parallel to the step (i). In some embodiments of the aforementioned aspect, when the oxyhalogenation step (iii) is parallel with the electrochemical step (i), the method further comprises delivering both the anode electrolyte of the step (i) comprising the metal halide with the metal ion in the higher oxidation state as well as the saltwater of the step (iii) comprising the metal halide with the metal ion in the higher oxidation state to the halogenating step (ii). In some embodiments of the aforementioned embodiment, both the anode electrolyte of the step (i) comprising the metal halide with the metal ion in the higher oxidation state as well as the saltwater of the step (iii) comprising the metal halide with the metal ion in the higher oxidation state may be mixed or blended before delivering the solution to the halogenating step (ii). In some embodiments, the method further comprises separating the one or more organic compounds or enantiomers thereof from the metal halide with the metal ion in the lower oxidation state in the saltwater (using the separator as described herein) after the halogenating step (ii) and transferring the saltwater comprising the metal halide with the metal ion in the lower oxidation state back to the electrochemical reaction as well as the oxyhalogenation reaction.

In another aspect, there is provided a system comprising an electrochemical cell comprising an anode in contact with an anode electrolyte wherein the anode electrolyte comprises metal halide and saltwater; a cathode in contact with a cathode electrolyte; and a voltage source configured to apply a voltage to the anode and the cathode wherein the anode is configured to oxidize the metal halide with the metal ion from a lower oxidation state to a higher oxidation state; an oxyhalogenation reactor configured to oxyhalogenate metal halide with metal ion in lower oxidation state to higher oxidation state in presence of an oxidant; a halogenation reactor operably connected to the electrochemical cell and the oxyhalogenation reactor wherein the halogenation reactor is configured to receive the anode electrolyte comprising the metal halide with the metal ion in the higher oxidation state from the electrochemical cell and configured to receive the metal halide with the metal ion in the higher oxidation state from the oxyhalogenation reactor and halogenate an unsaturated hydrocarbon or a saturated hydrocarbon with the metal halide with the metal ion in the higher oxidation state to result in one or more organic compounds or enantiomers thereof and the metal halide with the metal ion in the lower oxidation state, wherein the oxyhalogenation reactor is parallel to the electrochemical cell.

In some embodiments of the aforementioned aspect, when the oxyhalogenation reactor is parallel to the electrochemical cell, the system may further comprise a tank, pipe, conduit, column or the like configured to receive both the anode electrolyte from the electrochemical cell as well as the metal halide solution from the oxyhalogenation reactor before delivering the mixed solution to the halogenation reactor. In some embodiments, the blending of the anode electrolyte from the electrochemical cell as well as the metal halide solution from the oxyhalogenation reactor before delivering to the halogenation reactor may avoid disproportionate metal ion concentrations in the halogenation reactor.

In some embodiments of the aforementioned aspect, when the oxyhalogenation reactor is parallel to the electrochemical cell, the system further comprises a conduit operably connected between the electrochemical cell and the halogenation reactor configured for delivering the anode electrolyte comprising the saltwater and the metal halide with the metal ion in the lower and the higher oxidation state from the electrochemical cell to halogenating reactor for the halogenation of the unsaturated hydrocarbon or the saturated hydrocarbon. In some embodiments, the system further comprises a conduit operably connected between the oxyhalogenation reactor and the halogenation reactor configured for delivering the metal halide with the metal ion in the higher oxidation state in the saltwater of the oxyhalogenating reactor to the halogenation reactor for the halogenation of the unsaturated hydrocarbon or the saturated hydrocarbon. In some embodiments, the system further comprises a separator operably connected to the halogenation reactor and configured to separate the one or more organic compounds or enantiomers thereof from the metal halide with the metal ion in the lower oxidation state in the saltwater after the halogenating reactor. In some embodiments, the separator is further configured to deliver the metal halide solution with the metal ion in the lower oxidation state to the oxyhalogenation reactor and/or the electrochemical cell.

The examples of conduits include, without limitation, pipes, tubes, tanks, and other means for transferring the liquid solutions. In some embodiments, the conduits also include means for transferring gases such as, but not limited to, pipes, tubes, tanks, and the like. The gases include, for example only, ethylene or ethane gas to the halogenation reactor, oxygen or ozone gas to the oxyhalogenation reactor, or the oxygen gas to the cathode chamber of the electrochemical cell etc.

In some embodiments of the aforementioned method and system aspects and embodiments, when the oxyhalogenation reactor/reaction is parallel to the electrochemical cell/reaction, the concentration of the metal halide with the metal ion in the lower oxidation state exiting the electrochemical cell/reaction and entering the halogenation reactor/reaction is greater than 0.4M; or between 0.4-2.4M; or between 0.4-2M; or between 0.4-1.5M; or between 0.4-1M; or between 0.5-2.4M; or between 0.5-2M; or between 0.5-1.5M; or between 0.5-1M; or between 0.6-2.4M; or between 0.6-2M; or between 0.6-1.5M; or between 0.6-1M; or between 1-2.4M; or between 1-2M or between 1-1.5M; or between 1.5-2.4M; or between 1.5-2M. In some embodiments of the aforementioned method and system aspects and embodiments, the concentration of the metal halide with the metal ion in the lower oxidation state exiting the electrochemical cell/reaction and entering the halogenation reactor/reaction is between 0.5-2M; or between 0.5-1.5M; or between 0.5-1M.

In some embodiments of the aforementioned method and system aspects and embodiments, the concentration of the metal halide with the metal ion in the lower oxidation state exiting the oxyhalogenation reactor/reaction and entering the halogenation reactor/reaction is greater than 0M; or greater than 0.1M; or between 0-2M; or between 0-1.5M; or between 0-1M; or between 0.1-2M; or between 0.1-1.5M; or between 0.1-1M; or between 0.5-2M; or between 0.5-1.5M; or between 0.5-1M; or between 1-2M; or between 1-1.5M; or between 1.5-2M. In some embodiments of the aforementioned method and system aspects and embodiments, the concentration of the metal halide with the metal ion in the lower oxidation state exiting the oxyhalogenation reactor/reaction and entering the halogenation reactor/reaction is between 0.5-2.5M; or between 0.5-2M; or between 0.5-1.5M; or between 1-1.5M; or between 1-1.2M.

In some embodiments of the aforementioned method and system aspects and embodiments, the concentration of the metal halide with the metal ion in the lower oxidation state exiting the halogenation reactor/reaction and entering the oxyhalogenation reactor/reaction and/or entering the electrochemical cell/reaction is greater than 0.5M; or between 0.5-2.5M; or between 0.5-2M; or between 0.5-1.5M; or between 0.5-1M; or between 0.6-2.5M; or between 0.6-2M; or between 0.6-1.5M; or between 0.6-1M; or between 1-2.5M; or between 1-2M; or between 1-1.5M; or between 1.5-2.5M; or between 1.5-2M; or between 2-2.5M. In some embodiments of the aforementioned method and system aspects and embodiments, the concentration of the metal halide with the metal ion in the lower oxidation state exiting the halogenation reactor/reaction and entering the oxyhalogenation reactor/reaction and/or entering the electrochemical cell/reaction may be between 0.6-2.5M; or between 0.6-2M; or between 0.6-1.5M; or between 0.6-1M.

In some embodiments of the aforementioned method and system aspects and embodiments, when the oxyhalogenation reactor/reaction is parallel to the electrochemical cell/reaction, the concentration ranges provided above for various systems may be combined in any combination.

In some embodiments of the aforementioned method and system aspects and embodiments, when the oxyhalogenation reactor/reaction is parallel to the electrochemical cell/reaction, the concentration of the metal halide with the metal ion in the lower oxidation state exiting the electrochemical cell/reaction and entering the halogenation reactor/reaction is between 0.5-2M; or between 0.5-1.5M; or between 0.5-1M; the concentration of the metal halide with the metal ion in the lower oxidation state exiting the oxyhalogenation reactor/reaction and entering the halogenation reactor/reaction is between 0.5-2.5M; or between 0.5-2M; or between 0.5-1.5M; or between 1-1.5M; or between 1-1.2M; the concentration of the metal halide with the metal ion in the lower oxidation state exiting the halogenation reactor/reaction and entering the oxyhalogenation reactor/reaction and/or entering the electrochemical cell/reaction is between 0.6-2.5M; or between 0.6-2M; or between 0.6-1.5M; or between 0.6-1M, or combinations thereof.

An example of the oxyhalogenation parallel with the electrochemical reaction is as illustrated in FIG. 2. In C in FIG. 2, CuCl is oxidized to $CuCl_2$ in the anode chamber of the electrochemical cell. The saltwater from the anode chamber of the electrochemical cell containing the $CuCl_2$ is transferred to the halogenation reaction where a reaction with the unsaturated or the saturated hydrocarbon, such as, ethylene or ethane produces one or more organic compounds or enantiomers thereof, e.g. ethylene dichloride (EDC) and CuCl. The aqueous solution from the halogenation reaction containing the CuCl (also containing $CuCl_2$) is separated from the EDC and is transferred back to the electrochemical cell for metal oxidation. In the oxyhalogenation reaction, the oxidant oxidizes the CuCl to $CuCl_2$ which is transferred to the same halogenation reaction where the reaction with the unsaturated or the saturated hydrocarbon, such as, ethylene or ethane produces one or more organic compounds or enantiomers thereof, e.g. ethylene dichloride (EDC) and CuCl. The aqueous solution from the halogenation reaction containing the CuCl (also containing $CuCl_2$) is separated from the EDC and is transferred back to the oxyhalogenation reaction.

The integration of the oxyhalogenation in parallel with the electrochemical reaction may result in reduced number of electrochemical cells required to oxidize the metal halide from the lower to the higher oxidation state thereby improving the economics of the system.

In some embodiments as illustrated in FIG. 1, the oxyhalogenation method/system is simultaneous with the halogenation method/system (D). The "oxyhalogenation method/system simultaneous with the halogenation method/system" as used herein includes the oxyhalogenation reaction taking place simultaneously or in the same reactor as the halogenation reaction.

In embodiments where the oxyhalogenation is simultaneous with the halogenation reaction, both the oxyhalogenation as well as the halogenation reactions are run together in the same reactor. The oxidation of the metal halide with the metal ion from the lower to the higher oxidation state using the oxidant as well as the halogenation of the unsaturated or the saturated hydrocarbon with the metal halide with the metal ion in the higher oxidation state, occur in the same reactor. The saltwater from the anode chamber of the electrochemical cell containing the metal halide with the metal ion in the higher oxidation state is transferred to the halogenation reaction where a reaction with the unsaturated or the saturated hydrocarbon, such as, ethylene or ethane produces one or more organic compounds or enantiomers thereof and the metal halide with the metal ion in the lower oxidation state. The oxidant is also administered in the halogenation reactor to oxidize the metal halide with the metal ion from the lower to the higher oxidation state. The aqueous solution from the halogenation reaction containing the metal halide with the metal ion in the lower and the higher oxidation state is separated from the one or more organic compounds and is transferred back to the electrochemical reaction.

Accordingly, in one aspect there is provided a method comprising (i) contacting an anode with an anode electrolyte wherein the anode electrolyte comprises metal halide and saltwater; contacting a cathode with a cathode electrolyte; applying a voltage to the anode and the cathode and oxidizing the metal halide with metal ion in a lower oxidation state to a higher oxidation state at the anode; (ii) halogenating an unsaturated hydrocarbon or a saturated hydrocarbon with the metal halide with the metal ion in the higher oxidation state in the saltwater to result in one or more organic compounds or enantiomers thereof and the metal halide with the metal ion in the lower oxidation state; and (iii) oxyhalogenating the metal halide with the metal ion in the lower oxidation state to the higher oxidation state in presence of an oxidant, wherein the step (iii) is simultaneous to the step (ii). In some embodiments of the aforementioned aspect, when the oxyhalogenation step (iii) is simultaneous to the halogenation step (ii), the method comprises adding the oxidant to the halogenating step (ii) to simultaneously carry out the halogenation of the unsaturated hydrocarbon or the saturated hydrocarbon with the metal halide with the metal ion in the higher oxidation state and oxyhalogenation of the metal halide with the metal ion from the lower oxidation state to the higher oxidation state in the presence of the oxidant. In some embodiments, the method further comprises separating the one or more organic compounds or enantiomers thereof from the metal halide with the metal ion in the lower oxidation state in the saltwater after the halogenating step (ii) and transferring the saltwater comprising the metal halide with the metal ion in the lower oxidation state back to the electrochemical reaction.

In another aspect, there is provided a system comprising: an electrochemical cell comprising an anode in contact with an anode electrolyte wherein the anode electrolyte comprises metal halide and saltwater; a cathode in contact with a cathode electrolyte; and a voltage source configured to apply a voltage to the anode and the cathode wherein the anode is configured to oxidize the metal halide with the metal ion from a lower oxidation state to a higher oxidation state; and a halogenation reactor operably connected to the electrochemical cell wherein the halogenation reactor is configured to receive the anode electrolyte from the electrochemical cell and halogenate an unsaturated hydrocarbon or a saturated hydrocarbon with the metal halide with the metal ion in the higher oxidation state to result in one or more organic compounds or enantiomers thereof and the metal halide with the metal ion in the lower oxidation state and wherein the halogenation reactor is configured to receive an oxidant to oxyhalogenate the metal halide with the metal ion from the lower oxidation state to the higher oxidation state.

In some embodiments of the aforementioned aspect, the system further comprises a conduit operably connected between the electrochemical cell and the halogenation reactor and configured to deliver the anode electrolyte from the electrochemical cell to the halogenation reactor. In some embodiments of the aforementioned aspect, when the oxyhalogenation reactor is simultaneous to the halogenation reactor, the system further comprises a conduit operably connected to the halogenation reactor and configured to deliver the oxidant to the halogenating reactor.

The examples of conduits include, without limitation, pipes, tubes, tanks, and other means for transferring the liquid solutions. In some embodiments, the conduits also include means for transferring gases such as, but not limited to, pipes, tubes, tanks, and the like. The gases include, for example only, ethylene or ethane gas to the halogenation reactor, oxygen or ozone gas to the oxyhalogenation reactor, or the oxygen gas to the cathode chamber of the electrochemical cell etc.

In some embodiments of the aforementioned method and system aspects and embodiments, when the oxyhalogenation reactor/reaction is simultaneous to the halogenation reactor/reaction, the concentration of the metal halide with the metal ion in the lower oxidation state exiting the electrochemical cell/reaction and entering the halogenation reactor/reaction is greater than 0.4M; or between 0.4-2.4M; or between 0.4-2M; or between 0.4-1.5M; or between 0.4-1M; or between 0.5-2.4M; or between 0.5-2M; or between 0.5-1.5M; or between 0.5-1M; or between 0.6-2.4M; or between 0.6-2M; or between 0.6-1.5M; or between 0.6-1M; or between 1-2M or between 1-1.5M. In some embodiments of the aforementioned method and system aspects and embodiments, when the oxyhalogenation reactor/reaction is simultaneous to the halogenation reactor/reaction, the concentration of the metal halide with the metal ion in the lower oxidation state exiting the electrochemical cell/reaction and entering the halogenation reactor/reaction is between 0.5-2M; or between 0.5-1.5M; or between 0.5-1M.

In some embodiments of the aforementioned embodiment, the concentration of the metal halide with the metal ion in the lower oxidation state exiting the halogenation reactor/reaction and entering the electrochemical cell/reaction is greater than 0.5M; or between 0.5-2.5M; or between 0.5-2M; or between 0.5-1.5M; or between 0.5-1M; or between 0.6-2.5M; or between 0.6-2M; or between 0.6-1.5M; or between 0.6-1M; or between 1-2.5M; or between 1-2M; or between 1-1.5M; or between 1.5-2.5M; or between 1.5-2M; or between 2-2.5M. In some embodiments of the aforementioned embodiment, the concentration of the metal halide with the metal ion in the lower oxidation state exiting the halogenation reactor/reaction and entering the electrochemical cell/reaction is between 0.6-2.5M; or between 0.6-2M; or between 0.6-1.5M; or between 0.6-1M.

In some embodiments of the aforementioned method and system aspects and embodiments, when the oxyhalogenation reactor/reaction is simultaneous to the halogenation reactor/reaction, the concentration ranges provided above for various systems may be combined in any combination.

In some embodiments of the aforementioned method and system aspects and embodiments, when the oxyhalogenation reactor/reaction is simultaneous to the halogenation reactor/reaction, the concentration of the metal halide with the metal ion in the lower oxidation state exiting the electrochemical cell/reaction and entering the halogenation reactor/reaction is between 0.5-2M; or between 0.5-1.5M; or between 0.5-1M; the concentration of the metal halide with the metal ion in the lower oxidation state exiting the halogenation reactor/reaction and entering the electrochemical cell/reaction is between 0.6-2.5M; or between 0.6-2M; or between 0.6-1.5M; or between 0.6-1M; or combination thereof.

An example of the oxyhalogenation simultaneous with the halogenation reaction is as illustrated in FIG. 2. In D in FIG. 2, CuCl is oxidized to $CuCl_2$ in the anode chamber of the electrochemical cell. The saltwater from the anode chamber of the electrochemical cell containing the $CuCl_2$ is transferred to the halogenation reaction where a reaction with the unsaturated or the saturated hydrocarbon, such as, ethylene or ethane produces one or more organic compounds or enantiomers thereof, e.g. ethylene dichloride (EDC) and $CuCl_2$ is reduced to CuCl. The oxidant is also added to the halogenation reaction where the oxidant oxidizes the CuCl to $CuCl_2$. The CuCl and $CuCl_2$ solution is then transferred from the halogenation reaction to the electrochemical cell.

The integration of the oxyhalogenation simultaneously with the halogenation reaction may allow halogenation of the unsaturated or the saturated hydrocarbon from both the metal halide in the higher oxidation state coming from the electrochemical cell as well as the metal halide in the higher oxidation state produced by oxyhalogenation in the same reactor.

In some embodiments, the temperature of the anode electrolyte in the electrochemical cell/reaction is between 70-90° C., the temperature of the solution in the halogenation reactor/reaction is between 150-200° C., and/or the temperature of the solution in the oxyhalogenation reactor/reaction is between 70-200° C. depending on the configuration of the electrochemical cell/reaction, the halogenation reactor/reaction, and the oxyhalogenation reactor/reaction. In some embodiments, the lower temperature of the liquid or liquid/gas phase oxyhalogenation provided herein as compared to high temperatures of solid/gas phase oxyhalogenation, may provide economic benefits such as, but not limited to lower capital and operating expenses.

In all the systems provided herein, the solution in and out of the systems may be recirculated multiple times before sending the solution to the next system. For example, when the oxyhalogenation is in series with the electrochemical cell, the saltwater from the oxyhalogenation reaction may be sent back to the electrochemical cell or is circulated between the oxyhalogenation and the electrochemical reaction before the solution is taken out of the oxyhalogenation system and sent to the halogenation reaction.

In all the systems provided herein, the use of oxyhalogenation may be varied with time throughout the day. For example, the oxyhalogenation may be run during peak power price times as compared to electrochemical reaction thereby reducing the energy use. For example, oxyhalogenation may be run in the day time while the electrochemical cell may be run in the night time in order to save the cost of energy.

Oxyhalogenation and Halogenation

The "oxyhalogenation" or its grammatical equivalent, as used herein, includes a reaction in which an oxidant oxidizes a metal ion of a metal halide from a lower oxidation state to a higher oxidation state in an aqueous medium. The "oxidant" as used herein, includes one or more oxidizing agents that oxidize the metal ion of the metal halide from the lower to the higher oxidation state. Examples of oxidants include, without limitation, $X_2$ gas alone; or HX gas and/or HX solution in combination with gas comprising oxygen or ozone, hydrogen peroxide, HXO or salt thereof, $HXO_3$ or salt thereof, $HXO_4$ or salt thereof, or combinations thereof, wherein each X independently is a halogen selected from fluoro, chloro, iodo, and bromo. Applicants unexpectedly found that the metal ion of the metal halide can be oxidized from the lower oxidation state to the higher oxidation state in the aqueous medium using the oxidant. In some embodiments, the oxidant comprised a gas such that the oxyhalogenation reaction included using a gaseous oxidant to oxidize the metal ion of the metal halide in the aqueous solution.

In some embodiments, the oxidant is $X_2$ gas wherein X is a halogen selected from fluoro, chloro, iodo, and bromo. For example, chlorine gas may be used to oxidize the metal halide from the lower to the higher oxidation state. For example, CuCl may be oxidized to $CuCl_2$ in the presence of chlorine gas as follows:

$$2CuCl+Cl_2 \rightarrow 2CuCl_2$$

In some embodiments, the oxidant is HX gas and/or HX solution in combination with gas comprising oxygen or ozone, hydrogen peroxide, HXO or salt thereof, $HXO_3$ or salt thereof, $HXO_4$ or salt thereof, or combinations thereof, wherein each X independently is a halogen selected from fluoro, chloro, iodo, and bromo.

In some embodiments, the oxidant is HX gas and/or HX solution in combination with gas comprising oxygen or ozone. In some embodiments, the oxidant is HCl gas and/or HCl solution in combination with gas comprising oxygen. An example is as follows:

$$2CuCl+2\ HCl+\tfrac{1}{2}O_2 \rightarrow 2CuCl_2+H_2O$$

The gas comprising oxygen can be any gas comprising more than 1% oxygen; or more than 5% oxygen; or more than 10% oxygen; or more than 15% oxygen; or more than 20% oxygen; or more than 25% oxygen; or more than 30% oxygen; or more than 40% oxygen; or more than 50% oxygen; or between 1-30% oxygen; or between 1-25% oxygen; or between 1-20% oxygen; or between 1-15% oxygen; or between 1-10% oxygen; or is atmospheric air (about 21% oxygen). In some embodiments, when oxygen depolarizing cathode (ODC) is used in the cathode chamber of the electrochemical cell (described in detail below), then the oxygen introduced in the cathode chamber may also be used for the oxyhalogenation reaction. In some embodiments, the oxygen that exits the cathode chamber after being used at the ODC, may be collected and transferred to the oxyhalogenation reactor for the oxyhalogenation reaction. In some embodiments, the cathode chamber may be operably connected to the oxyhalogenation reactor for the circulation of the oxygen gas.

In some embodiments, when the oxidant is HX gas and/or HX solution in combination with air, the air deprived of the oxygen (after reaction in the oxyhalogenation reactor) and rich in nitrogen may be collected, optionally compressed, and sold in the market.

In some embodiments, the gas may comprise ozone alone or in combination with oxygen gas. In some embodiments, the gas comprising ozone can be any gas comprising more than 0.1% ozone; or more than 1% ozone; or more than 5% ozone; or more than 10% ozone; or more than 15% ozone; or more than 20% ozone; or more than 25% ozone; or more than 30% ozone; or more than 40% ozone; or more than 50% ozone; or between 0.1-30% ozone; or between 0.1-25% ozone; or between 0.1-20% ozone; or between 0.1-15% ozone; or between 0.1-10% ozone.

In some embodiments, the oxidant is HX gas and/or HX solution in combination with hydrogen peroxide, wherein X is a halogen selected from fluoro, chloro, iodo, and bromo. One example is as follows:

$$2CuCl+H_2O_2+2\ HCl \rightarrow 2CuCl_2+2\ H_2O$$

In some embodiments, the oxidant is HX gas and/or HX solution in combination with HXO or salt thereof, wherein each X independently is a halogen selected from fluoro, chloro, iodo, and bromo. In some embodiments, X is chloro. One example is as follows:

$$2CuCl+HClO+HCl \rightarrow 2CuCl_2+H_2O$$

In some embodiments, a salt of HXO such as a sodium salt of HXO may be used. For example only:

$$2CuCl+NaClO+2\ HCl \rightarrow 2CuCl_2+NaCl+H_2O$$

In some embodiments, the oxidant is HX gas and/or HX solution in combination with $HXO_3$ or salt thereof, wherein each X independently is a halogen selected from fluoro, chloro, iodo, and bromo.

$$6CuCl+HClO_3+5\ HCl \rightarrow 6CuCl_2+3\ H_2O$$

In some embodiments, the oxidant is HX gas and/or HX solution in combination with $HXO_4$ or salt thereof, wherein each X independently is a halogen selected from fluoro, chloro, iodo, and bromo.

$$8CuCl+HClO_4+7\ HCl \rightarrow 8CuCl_2+4\ H_2O$$

In some embodiments, the concentration of the oxidant solution (e.g. HC1) is between about 0.1-10M; or 0.1-5M; or 0.1-1M; or 5-10M; or 1-5M.

In some embodiments, the ratio of the HX gas and/or HX solution (I) and the gas comprising oxygen or ozone, the hydrogen peroxide, the HXO or salt thereof, the $HXO_3$ or salt thereof, or $HXO_4$ or salt thereof (II), i.e. I:II is 1:1 or 2:1 or 3:1 or 2:0.5 or 2:0.1 or 1:0.1 or 1:0.5. In some embodiments when the oxyhalogenation is simultaneous with the halogenation reaction, the oxidant is added to the halogenation reactor along with the anode electrolyte from the electrochemical cell comprising the metal halide with the metal ion in the higher oxidation state. In such embodiments, the ratio of I:II may be about 2:0.5 or 2:0.1 or 1:0.1 or 1:0.5.

In some embodiments, the HCl gas or HCl solution used as an oxidant is obtained from the vinyl chloride monomer (VCM) process. In some embodiments, when the unsaturated hydrocarbon is ethylene, it may react with the metal halide with the metal ion in the higher oxidation state to form ethylene dichloride (halogenation reaction). The EDC thus formed, may be used in the cracking process to form VCM which may also produce HCl. The HCl may be separated from the VCM using techniques, such as, but not limited to, distillation to separate VCM from HCl. The HCl may then be used in the oxychlorination process of the invention.

In some embodiments, the HCl gas or HCl solution used as an oxidant is obtained from the halogenation process. For example, when ethylene is chlorinated with $CuCl_2$ to form EDC, the EDC may undergo side product formation to result in the formation of chloroethanol, monochloroacetaldehyde, dichloroacetaldehyde, and trichloroacetaldehyde, each of these steps may result in the formation of HCl. The HCl thus formed may optionally be separated from the organics and may be used in the oxychlorination reaction.

In some embodiments, when the oxidant is HX gas and/or HX solution in combination with gas comprising oxygen or ozone, the HX gas and/or HX solution as well as the gas comprising oxygen or ozone may be administered to the oxyhalogenation reactor. The reactor may also receive the aqueous solution of metal halide with the metal ion in the lower oxidation state. The solution may be the anode electrolyte comprising saltwater and the metal halide or the solution may be the saltwater from the halogenation reactor. The oxyhalogenation reactor may be any column, tube, tank, pipe, or reactors that can carry out the oxyhalogenation reaction. The reactor may be fitted with various probes including temperature probe, pH probe, pressure probe, etc. to monitor the reaction. The reaction may be heated with means to heat the reaction mixture. The temperature of the reactor may be between about 40-160° C. or between about 100-150° C. and/or the pressure in the oxyhalogenation reactor may be between about 100-300 psig or between about 150-250 psig or between about 150-300 psig. The oxyhalogenaion reaction may be carried out for between about 5 min-120 min to few hours. The oxyhalogenation reactor may also be fitted with conduits for the entry and/or exit of the solutions and the gases. Other detailed descriptions of the reactor are provided herein. Example 4 provided herein illustrates effects of HCl concentration (an example of an oxidant), the reaction times, the temperature in the reactor, and the pressure on the oxidation of the metal ion from the lower oxidation state to the higher oxidation state.

The "halogenation" or its grammatical equivalent, as used herein, includes a reaction of the unsaturated or the saturated hydrocarbon with the metal halide with the metal ion in the higher oxidation state to form one or more organic compounds or enantiomers thereof.

The "unsaturated hydrocarbon" as used herein, includes a hydrocarbon with unsaturated carbon or hydrocarbon with at least one double and/or at least one triple bond between adjacent carbon atoms. The unsaturated hydrocarbon may be linear, branched, or cyclic (aromatic or non-aromatic). For example, the hydrocarbon may be olefinic, acetylenic, non-aromatic such as cyclohexene, aromatic group or a substituted unsaturated hydrocarbon such as, but not limited to, halogenated unsaturated hydrocarbon. The hydrocarbons with at least one double bond may be called olefins or alkenes and may have a general formula of an unsubstituted alkene as $C_nH_{2n}$ where n is 2-20 or 2-10 or 2-8, or 2-5 e.g. $C_{2-20}$ alkene or $C_{2-10}$ alkene or $C_{2-8}$ alkene etc. In some embodiments, one or more hydrogens on the alkene may be further substituted with other functional groups such as but not limited to, halogen (including chloro, bromo, iodo, and fluoro), carboxylic acid (—COOH), hydroxyl (—OH), amines, etc. The unsaturated hydrocarbons include all the isomeric forms of unsaturation, such as, but not limited to, cis and trans isomers, E and Z isomers, positional isomers etc. Examples of unsaturated hydrocarbon includes substituted or unsubstituted alkenes, including but not limited to, ethylene, chloro ethylene, bromo ethylene, iodo ethylene, propylene, chloro propylene, hydroxyl propylene, 1-butylene, 2-butylene (cis or trans), isobutylene, 1,3-butadiene, pentylene, hexene, cyclopropylene, cyclobutylene, cyclohexene, benzene, toluene, etc. The hydrocarbons with at least one triple bond maybe called alkynes and may have a general formula of an unsubstituted alkyne as $C_nH_{2n-2}$ where n is 2-10 or 2-8, or 2-5. In some embodiments, one or more hydrogens on the alkyne may be further substituted with other functional groups such as but not limited to, halogen, carboxylic acid, hydroxyl, etc. Examples of alkynes include acetylene, or vinyl group substituted chains etc.

The "saturated hydrocarbon" as used herein, includes a hydrocarbon with no unsaturated carbon or hydrocarbon. The hydrocarbon may be linear, branched, or cyclic. For example, the hydrocarbon may be substituted or unsubstituted alkanes and/or substituted or unsubstituted cycloalkanes. The hydrocarbons may have a general formula of an unsubstituted alkane as $C_nH_{2n+2}$ where n is 2-20 or 2-10 or 2-8, or 2-5 e.g. $C_{2-20}$ alkane or $C_{2-10}$ alkane or $C_{2-8}$ alkane etc. In some embodiments, one or more hydrogens on the alkane or the cycloalkanes may be further substituted with other functional groups such as but not limited to, halogen (including chloro, bromo, iodo, and fluoro), carboxylic acid (—COOH), hydroxyl (—OH), amines, etc. Examples of saturated hydrocarbon includes substituted or unsubstituted alkanes, e.g. but not limited to, methane, ethane, chloroethane, bromoethane, iodoethane, propane, chloropropane, hydroxypropane, butane, chlorobutane, hydroxybutane, pentane, hexane, cyclohexane, cyclopentane, chlorocyclopentane, etc.

The "one or more organic compounds" used herein, include one or more of the organic compounds that are formed by the reaction of the unsaturated or the saturated hydrocarbon with the metal halide with the metal ion in the higher oxidation state. The one or more organic compounds include halohydrocarbons and any side product formed from/with them. The "enantiomers thereof" as used herein includes chiral molecules or mirror images of the one or more organic compounds. The enatiomers are conventionally known in the art.

The "halohydrocarbon" or "halogenated hydrocarbon" as used herein, includes halo substituted hydrocarbons where halo may be any number of halogens that can be attached to the hydrocarbon based on permissible valency. The halogens include fluoro, chloro, bromo, and iodo. The examples of halohydrocarbons include fluorohydrocarbons, chlorohydrocarbons, bromohydrocarbons, and iodohydrocarbons. The chlorohydrocarbons include, but not limited to, monochlorohydrocarbons, dichlorohydrocarbons, trichlorohydrocarbons, etc. Examples of the halohydrocarbons include ethylene dichloride, chloroethanol, propyl dichloride, chloropropanol, butyl chloride, butyl dichloride, dichlorobutane, chlorobutanol, allyl chloride, chloroprene, etc. The side products of the one or more organic compounds include without limitation, propylene oxide, monochloroacetaldehyde, dichloroacetaldehyde, trichloroacetaldehyde, etc.

For example, the halogenation of ethylene or ethane may result first in the formation of ethylene dichloride (EDC) (may also be known as 1,2-dichloroethane, dichloroethane, 1,2-ethylene dichloride, glycol dichloride, etc). The EDC may undergo reactions to form series of intermediates such as chloroethanol (CE or 2-chloroethanol), monochloroacetaldehyde (MCA), dichloroacetaldehyde (DCA), trichloroacetaldehyde (TCA), etc. For example, EDC is produced via a reaction with ethylene and copper(II) chloride as follows:

$$C_2H_4+2CuCl_2 \rightarrow C_2H_4Cl_2+2CuCl$$

Ethylene may be supplied under pressure in the gas phase and metal halide, for example only, copper(II) chloride (also containing copper(I) chloride) is supplied in an aqueous solution originating from the outlet of the anode chamber of the electrochemical cell and/or originating from the outlet of the oxyhalogenation reactor. The reaction may occur in the liquid phase where the dissolved ethylene reacts with the copper(II) chloride. The reaction may be carried out at pressures between 270 psig and 530 psig to improve ethylene solubility in the aqueous phase. Since the reaction takes place in the aqueous medium, the EDC may further react with the water to form 2-chloroethanol (CE):

$$C_2H_4Cl_2+H_2O \rightarrow CH_2ClCH_2OH+HCl$$

After the reaction of the unsaturated or the saturated hydrocarbon with the metal halide with metal ion in the higher oxidation state, the metal ion in the higher oxidation state is reduced to metal ion in the lower oxidation state. The metal ion solution is separated from the one or more organic compounds or enantiomers thereof (organics) in a separator before the metal ion solution is recirculated back to the anode electrolyte of the electrochemical system or to the solution in the oxyhalogenation reactor. It is to be understood that the metal halide solution going into the anode electrolyte and the metal halide solution coming out of the anode electrolyte contains a mix of the metal halide in the lower oxidation state and the higher oxidation state except that the metal halide solution coming out of the anode chamber has higher amount of metal halide in the higher oxidation state than the metal halide solution going into the anode electrolyte. In some embodiments, the metal halide exiting the anode chamber may be used as is or may be purified before reacting with unsaturated or the saturated hydrocarbons such as, ethylene or ethane for the generation of the one or more organic compounds or enantiomers thereof.

In the systems and methods provided herein the metal ion solutions may be separated and/or purified before and after the reaction in the halogenation reactor or oxyhalogenation reactor. Similarly, the products made in the reactor may also be subjected to organic separation and/or purification before their commercial use. In some embodiments, the solution containing the one or more organic compounds and the metal halide may be subjected to washing step which may include rinsing with an organic solvent or passing the organic product through a column to remove the metal ions. In some embodiments, the organic products may be purified by distillation. In the methods and systems provided herein, the separation and/or purification may include one or more of the separation and purification of the organic compounds from the metal ion solution; the separation and purification of the organic compounds from each other; and separation and purification of the metal ion in the lower oxidation state from the metal ion in the higher oxidation state, to improve the overall yield of the organic product, improve selectivity of the organic product, improve purity of the organic product, improve efficiency of the systems, improve ease of use of the solutions in the overall process, improve reuse of the metal solution in the electrochemical and reaction process, and to improve the overall economics of the process. Various methods of separation/purification have been described in US Patent Application Publication No. 2015/0038750, filed Jul. 30, 2014, which is incorporated herein by reference in its entirety.

In some embodiments of the foregoing embodiments, the one or more reaction conditions for the halogenation mixture or reaction mixture in the halogenation reactor are selected from temperature of between about 120-250° C.; incubation time of between about 10 min-3 hour; concentration of the metal halide in the higher oxidation state at more than 4M or between 4.5-8M, and combinations thereof.

In some embodiments of the foregoing aspects and embodiments, the yield of the one or more organic compounds or the enatiomers thereof obtained by using one or more aforementioned combinations of the electrochemical method/system, halogenation method/system, and oxyhalogenation method/system is more than 30 wt % yield; or more than 40 wt % yield; or more than 50 wt % yield; or more than 60 wt % yield; or more than 70 wt % yield; or more than 80 wt % yield; or more than 90 wt % yield; or more than 95 wt % yield; or between 20-90 wt % yield; or between 40-90 wt % yield; or between 50-90 wt % yield, or between 50-99 wt % yield.

In some embodiments of the foregoing aspects and embodiments, the STY (space time yield) of the one or more organic compounds or enantiomers thereof from the unsaturated or the saturated hydrocarbon such as, e.g. ethylene or ethane, e.g. the STY of EDC from ethylene or ethane using the metal ions, obtained by using one or more aforementioned combinations of the electrochemical method/system, halogenation method/system, and oxyhalogenation method/system is more than 0.1, or more than 0.5, or is 1, or more than 1, or more than 2, or more than 3, or more than 4, or more than 5, or between 0.1-3, or between 0.5-3, or between 0.5-2, or between 0.5-1, or between 3-5, or between 3-6, or between 3-8. As used herein the STY is yield per time unit per reactor volume. For example, the yield of product may be expressed in mol, the time unit in hour and the volume in liter. The volume may be the nominal volume of the reactor, e.g. in a packed bed reactor, the volume of the vessel that holds the packed bed is the volume of the reactor. The STY may also be expressed as STY based on the consumption of the ethylene or ethane consumed to form the product. For example only, in some embodiments, the STY of the product may be deduced from the amount of ethylene consumed during the reaction. The selectivity may be the mol of product/mol of the ethylene or ethane consumed (e.g. only, mol EDC made/mol ethylene consumed). The yield may be the amount of the product isolated. The purity may be the amount of the product/total amount of all products (e.g. only, amount of EDC/all the organic products formed).

In some embodiments, the system provided herein further comprises a recirculation system to recirculate the separated metal halide solution comprising metal halide in the lower oxidation state and optionally comprising metal halide in the higher oxidation state, from the halogenation reactor back to the anode electrolyte of the electrochemical cell and/or the oxyhalogenation reactor.

The systems provided herein include the reactor operably connected to the anode chamber that carries out the halogenation, oxyhalogenation or combination thereof. The "reactor" as used herein is any vessel or unit in which the halogenation or oxyhalogenation reaction provided herein, is carried out. The halogenation reactor is configured to contact the metal halide in the anode electrolyte or the metal halide in the saltwater from the oxyhalogenation reaction, with the unsaturated or the saturated hydrocarbon such as, e.g. ethylene or ethane to form the one or more organic compounds or enantiomers thereof. The oxyhalogenation reactor is configured to contact the metal halide with the metal ion in the lower oxidation state with the oxidant to form the metal halide with the metal ion in the higher oxidation state. The reactor may be any means for contacting the contents as mentioned above. Such means or such reactor are well known in the art and include, but not limited to, pipe, column, duct, tank, series of tanks, container, tower, conduit, and the like. The reactor may be equipped with one or more of controllers to control temperature sensor, pressure sensor, control mechanisms, inert gas injector, etc. to monitor, control, and/or facilitate the reaction.

In some embodiments, the reactor system may be a series of reactors connected to each other. The reaction vessel may be a stirred tank. The stirring may increase the mass transfer rate of the unsaturated or the saturated hydrocarbon into the aqueous anolyte phase accelerating the reaction to form the one or more organic compounds or enantiomers thereof. In some embodiments, the formation of the one or more organic compounds or enantiomers thereof, all take place in separate reactors where the reactors are operably connected to each other for the flow of liquids and gases in and out of the reactors.

The reactors for the halogenation reaction as well as the oxyhalogenation reaction need to be made of material that is compatible with the aqueous or the saltwater streams containing metal ions flowing between the systems. In some embodiments, the electrochemical system, the halogenation reactor and/or the oxyhalogenation reactor are made of corrosion resistant materials that are compatible with metal ion containing water, such materials include, titanium, steel etc.

In some embodiments, the anode chamber of the electrochemical system (electrochemical system can be any electrochemical system described herein) is connected to the reactor which is also connected to a source of the unsaturated or the saturated hydrocarbon e.g. ethylene or ethane. In some embodiments, the electrochemical system and the reactor(s) may be inside the same unit and are connected inside the unit. For example, the anode electrolyte containing the metal ion in the higher oxidation state optionally with the metal ion in the lower oxidation state, along with ethylene are fed to a corrosion resistant (e.g., made of titanium) reactor (in the embodiment where the oxyhalogenation is simultaneous with the halogenation, the oxidant may also be added to the same reactor). The chlorination of ethylene takes place inside the reactor to form ethylene dichloride (EDC or dichloroethane DCE) and the metal ion in the lower oxidation state.

The reactor effluent gases may be quenched with water in the prestressed (e.g., brick-lined) packed tower. The liquid leaving the tower maybe cooled further and separated into the aqueous phase and organic phase. The aqueous phase may be split part being recycled to the tower as quench water and the remainder may be recycled to the reactor or the electrochemical system. The organic product may be cooled further and flashed to separate out more water and dissolved ethylene. This dissolved ethylene may be recycled back to the reactor. The uncondensed gases from the quench tower may be recycled to the reactor, except for the purge stream to remove inerts. The purge stream may go through the ethylene recovery system to keep the over-all utilization of ethylene high, e.g., as high as 95%. Experimental determinations may be made of flammability limits for ethylene gas at actual process temperature, pressure and compositions. The construction material of the plant or the systems may include prestressed brick linings, Hastealloys B and C, inconel, dopant grade titanium (e.g. AKOT, Grade II), tantalum, Kynar, Teflon, PEEK, glass, or other polymers or plastics. The reactor may also be designed to continuously flow the anode electrolyte in and out of the reactor.

The reaction conditions in the electrochemical, halogenation, and oxyhalogenation systems described herein, including the concentration of the metal ions, may be selected in such a way that the one or more organic compounds or enantiomers thereof are produced with high selectivity, high yield, and/or high STY. In some embodiments, the reaction between the metal chloride with metal ion in higher oxidation state and the unsaturated or the saturated hydrocarbon, e.g. ethylene or ethane, is carried out in the reactor provided herein under reaction conditions including, but not limited to, the temperature of between 120-200° C. or between 120-175° C. or between 150-185° C. or between 150-175° C.; pressure of between 100-500 psig or between 100-400 psig or between 100-300 psig or between 150-350 psig or between 200-300 psig, or combinations thereof depending on the desired product. The reactor provided herein is configured to operate at the temperature of between 120-200° C. or between 120-185° C. or between 150-200° C. or between 150-175° C.; pressure of between 100-500 psig or between 100-400 psig or between 100-300 psig or between 150-350 psig or between 200-300 psig, or combinations thereof depending on the desired product. In some embodiments, the components of the reactor are lined with Teflon to prevent corrosion of the components. In some embodiments, the reactor provided herein may operate under reaction conditions including, but not limited to, the temperature and pressure in the range of between 135-180° C., or between 135-175° C., or between 140-180° C., or between 140-170° C., or between 140-160° C., or between 150-180° C., or between 150-170° C., or between 150-160° C., or between 155-165° C., or 140° C., or 150° C., or 160° C., or 170° C. and 200-300 psig depending on the desired product. In some embodiments, the reactor provided herein may operate under reaction conditions including, but not limited to, the temperature and pressure in the range of between 135-180° C., or between 135-175° C., or between 140-180° C., or between 140-170° C., or between 140-160° C., or between 150-180° C. and 200-300 psig depending on the desired product.

One or more of the reaction conditions include, such as, but not limited to, temperature of the halogenation mixture, incubation time, total halide concentration in the halogenation mixture, and/or concentration of the metal halide in the higher oxidation state can be set to assure high selectivity, high yield, and/or high STY operation.

Reaction heat may be removed by vaporizing water or by using heat exchange units. In some embodiments, a cooling surface may not be required in the reactor and thus no temperature gradients or close temperature control may be needed.

In some embodiments, the aforementioned combinations of the electrochemical method/system, halogenation method/system, and oxyhalogenation method/system produce the one or more organic compounds or enantiomers thereof with more than about 0.1 STY or more than about 0.5 STY or between 0.1-5 STY, or between 0.5-3 STY, or more than about 80% selectivity or between 80-99% selectivity. In some embodiments of the aforementioned embodiments, the reaction conditions produce the one or more organic compounds or enantiomers thereof with selectivity of more than 80%; or between about 80-99%; or between about 80-99.9%; or between about 90-99.9%; or between about 95-99.9%.

In some embodiments, the design and configuration of the reactor may be selected in such a way that the one or more organic compounds or enantiomers thereof are produced with high selectivity, high yield, high purity, and/or high STY. Similarly, the design of the oxyhalogenation reactor may also be selected in such a way that the metal halide is oxidized from the lower to the higher oxidation state in the presence of the oxidant. The reactor configuration (for halogenation and/or oxyhalogenation) includes, but not limited to, design of the reactor such as, e.g. length/diameter ratio, flow rates of the liquid and gases, material of construction, packing material and type if reactor is packed column or trickle-bed reactor, or combinations thereof. In some embodiments, the systems may include one reactor or a series of multiple reactors connected to each other or operating separately. The reactor may be a packed bed such as, but not limited to, a hollow tube, pipe, column or other vessel filled with packing material. The reactor may be a trickle-bed reactor. In some embodiments, the packed bed reactor includes a reactor configured such that the aqueous medium containing the metal ions and the unsaturated or the saturated hydrocarbon, such as e.g. ethylene or ethane (e.g. ethylene gas) flow counter-currently in the reactor or includes the reactor where the saltwater containing the metal ions flows in from the top of the reactor and the ethylene gas is pressured in from the bottom at e.g., but not limited to, 200 psi or above, such as, for example, 250 psi, 300 psi or 600 psi. In some embodiments, in the latter case, the ethylene gas may be pressured in such a way that only when the ethylene gas gets consumed and the pressure drops, that more ethylene gas flows into the reactor. The trickle-bed reactor includes a reactor where the saltwater containing the metal ions and the unsaturated or the saturated hydrocarbon, such as e.g. ethylene or ethane (e.g. ethylene gas) flow co-currently in the reactor. In some embodiments, the reactor may be a tray column or a spray tower. Any of the configurations of the reactor described herein may be used to carry out the methods of the invention.

In some embodiments, the unsaturated or the saturated hydrocarbon, such as e.g. ethylene or ethane feedstock may be fed to the halogenation vessel or the reactor continuously or intermittently. Efficient halogenation may be dependent upon achieving intimate contact between the feedstock and the metal ion in solution and the halogenation reaction may be carried out by a technique designed to improve or maximize such contact. The metal ion solution may be agitated by stirring or shaking or any desired technique, e.g. the reaction may be carried out in a column, such as a packed column, or a trickle-bed reactor or reactors described herein. For example, where the unsaturated or the saturated hydrocarbon, such as e.g. ethylene or ethane is gaseous, a counter-current technique may be employed wherein the ethylene or ethane is passed upwardly through a column or reactor and the metal ion solution is passed downwardly through the column or reactor. In addition to enhancing contact of the unsaturated or the saturated hydrocarbon, such as e.g. ethylene or ethane and the metal ion in the solution, the techniques described herein may also enhance the rate of dissolution of the ethylene or ethane in the solution, as may be desirable in the case where the solution is aqueous and the water-solubility of the ethylene or ethane is low. Dissolution of the feedstock may also be assisted by higher pressures.

In some embodiments, the reactor (may be a trickle bed or packed bed reactor) is configured in such a way that the length (or the height)/diameter ratio of the reactor is between 2-40 (e.g. 2:1 to 40:1); or between 2-35; or between 2-30; or between 2-20; or between 2-15; or between 2-10; or between 2-5; or between 3-40; or between 3-35; or between 3-30; or between 3-20; or between 3-10; or between 3-5; or between 4-40; or between 4-35; or between 4-30; or between 4-20; or between 4-10; or between 4-5; or between 6-40; or between 6-35; or between 6-30; or between 6-20; or between 6-10; or between 10-40; or between 10-35; or between 10-30; or between 10-25; or between 10-20; or between 10-15; or between 15-40; or between 15-35; or between 15-30; or between 15-25; or between 20-40; or between 20-35; or between 20-30; or between 20-25; or between 25-40; or between 25-35; or between 25-30; or between 30-40. In some embodiments, the foregoing diameter is the outside diameter of the reactor. In some embodiments, the foregoing diameter is the inside diameter of the reactor. For example, in some embodiments, the length/diameter ratio of the reactor is between about 2-15; or 2-20; or 2-25; or 10-15; or 10-25; or 20-25; or 20-30; or 30-40; or 35-40; or 4-25; or 6-15; or between 2:1-40:1; or between 2:1-10:1 or about 3:1 or about 4:1.

A variety of packing material of various shapes, sizes, structure, wetting characteristics, form, and the like may be used in the packed bed or trickle bed reactor, described herein. The packing material includes, but not limited to, polymer (e.g. only Teflon PTFE), ceramic, glass, metal, natural (wood or bark), or combinations thereof. In some embodiments, the packing can be structured packing or loose or unstructured or random packing or combination thereof. The structured packing includes unflowable corrugated metal plates or gauzes. In some embodiments, the structured packing material individually or in stacks fits fully in the diameter of the reactor. The unstructured packing or loose packing or random packing includes flowable void filling packing material.

Examples of loose or unstructured or random packing material include, but not limited to, Raschig rings (such as in ceramic material), pall rings (e.g. in metal and plastic), lessing rings, Michael Bialecki rings (e.g. in metal), berl saddles, intalox saddles (e.g. in ceramic), super intalox saddles, Tellerette® ring (e.g. spiral shape in polymeric material), etc.

In some embodiments, the size of the unstructured packing material may vary and may be between about 2 mm to about 5 inches or between about ¼ of an inch to about 5 inches. In some embodiments, the size of the packing material is between about 2 mm to about 5 inches; or about 2 mm to about 4 inches; or about 2 mm to about 3 inches; or about 2 mm to about 2 inches; or about 2 mm to about 1 inch; or about 2 mm to about ½ inch; or about 2 mm to about ¼ inch; or about ¼ of an inch to about 5 inches; or about ¼ of an inch to about 4 inches; or about ¼ of an inch to about 3 inches; or about ¼ of an inch to about 2 inches; or about ¼ of an inch to about 1 inch; or about ¼ of an inch to about ½ inch; or about ⅓ of an inch to about 5 inches; or about ⅓ of an inch to about 2 inches; or about ½ of an inch to about 5 inches; or about ½ of an inch to about 4 inches; or about ½ of an inch to about 3 inches; or about ½ of an inch to about 2 inches; or about ½ of an inch to about 1 inch; or about 1 inch to about 5 inches; or about 1 inch to about 4 inches; or about 1 inch to about 3 inches; or about 1 inch to about 2 inches; or about 1 inch to about ½ inches; or about 1 inch to about ¼ inches; or about 2 inch to about 5 inches; or about 3 inch to about 5 inches; or about 4 inch to about 5 inches. In some embodiments, the size of the packing material is between about ¼ of an inch to about 4 inches; or about ½ of an inch to about 3 inches; or about 1 inch to about 2 inches.

Examples of structured packing material include, but not limited to, thin corrugated metal plates or gauzes (honeycomb structures) in different shapes with a specific surface area. The structured packing material may be used as a ring or a layer or a stack of rings or layers that have diameter that may fit into the diameter of the reactor. The ring may be an individual ring or a stack of rings fully filling the reactor. In some embodiments, the voids left out by the structured packing in the reactor are filled with the unstructured packing material.

Examples of structured packing material includes, without limitation, Flexipac®, Intalox®, Flexipac® HC®, etc. In a structured packing material, corrugated sheets may be arranged in a crisscross pattern to create flow channels for the vapor phase. The intersections of the corrugated sheets may create mixing points for the liquid and vapor phases. The structured packing material may be rotated about the column (reactor) axis to provide cross mixing and spreading of the vapor and liquid streams in all directions. The structured packing material may be used in various corrugation sizes and the packing configuration may be optimized to attain the highest efficiency, capacity, and pressure drop requirements of the reactor. The structured packing material may be made of a material of construction including, but not limited to, titanium, stainless steel alloys, carbon steel, aluminum, nickel alloys, copper alloys, zirconium, thermoplastic, etc. The corrugation crimp in the structured packing material may be of any size, including, but not limited to, Y designated packing having an inclination angle of 45° from the horizontal or X designated packing having an inclination angle of 60° from the horizontal. The X packing may provide a lower pressure drop per theoretical stage for the same surface area. The specific surface area of the structured packing may be between 50-800 $m^2/m^3$; or between 75-350 $m^2/m^3$; or between 200-800 $m^2/m^3$; or between 150-800 $m^2/m^3$; or between 500-800 $m^2/m^3$.

In some embodiments, the structured or the unstructured packing material as described above is used in the distillation or flash column described herein for separation and purification of the products.

In some embodiments, the reactor may be configured for both the reaction and separation of the products. The processes and systems described herein may be batch processes or systems or continuous flow processes or systems.

All the electrochemical and reactor systems and methods described herein are carried out in more than 5 wt % water or more than 6 wt % water or saltwater. In one aspect, the methods and systems provide an advantage of conducting the metal oxidation reaction in the electrochemical cell and the oxyhalogenation reaction as well as the reduction reaction outside the cell in the halogenation reactor, all in an aqueous medium or all in saltwater. The use of aqueous medium or water containing salt, in the halogenation of the unsaturated or the saturated hydrocarbon, such as e.g. ethylene or ethane, not only results in high yield and high selectivity of the product but also results in the generation of the reduced metal ion with lower oxidation state in the aqueous medium which could be re-circulated back to the electrochemical system or to the oxyhalogenation reactor. In some embodiments, since the electrochemical cell runs efficiently in the aqueous medium, no removal or minimal removal of water (such as through azeotropic distillation) is required from the anode electrolyte containing the metal ion in the higher oxidation state which is reacted with the unsaturated or the saturated hydrocarbon in the aqueous medium. In some embodiments, the aqueous medium is saltwater comprising alkali metal ions or alkaline earth metal ions. The saltwater has been described further herein.

In some embodiments, the reaction of the metal ion in the higher oxidation state with the unsaturated or the saturated hydrocarbon, such as e.g. ethylene or ethane may take place when the reaction temperature is above 120° C. up to 350° C. In saltwater, the reaction may be carried out under a super atmospheric pressure of up to 1000 psi or less to maintain the reaction medium in liquid phase at a temperature of from 120° C. to 200° C., typically from about 120° C. to about 180° C.

Electrochemical Cell

The systems and methods of the invention use an electrochemical cell that produces various products, such as, but not limited to, metal salts formed at the anode, the metal salts used to form various other chemicals, alkali formed at the cathode, alkali used to form various other products, and/or hydrogen gas formed at the cathode. All of such products have been defined herein and may be called green chemicals since such chemicals are formed using the electrochemical cell that runs at low voltage or energy and high efficiency. The low voltage or less energy intensive process described herein would lead to lesser emission of carbon dioxide as compared to conventional methods of making similar chemicals or products.

The electrochemical cell provided herein may be any electrochemical cell where the metal ion in the lower oxidation state is converted to the metal ion in the higher oxidation state in the anode chamber. In such electrochemical cells, cathode reaction may be any reaction that does or does not form an alkali in the cathode chamber. Such cathode consumes electrons and carries out any reaction including, but not limited to, the reaction of water to form hydroxide ions and hydrogen gas or reaction of oxygen gas and water to form hydroxide ions or reduction of protons from an acid such as hydrochloric acid to form hydrogen gas or reaction of protons from hydrochloric acid and oxygen gas to form water.

In some embodiments, the electrochemical cells may include production of alkali in the cathode chamber of the cell. The alkali generated in the cathode chamber may be used as is for commercial purposes or may be treated with divalent cations to form divalent cation containing carbonates/bicarbonates. In some embodiments, the alkali generated in the cathode chamber may be used to sequester or capture carbon dioxide. The carbon dioxide may be present in flue gas emitted by various industrial plants. The carbon dioxide may be sequestered in the form of carbonate and/or bicarbonate products. Therefore, both the anode electrolyte as well as the cathode electrolyte can be used for generating products that may be used for commercial purposes thereby providing a more economical, efficient, and less energy intensive process.

The electrochemical systems and methods described herein provide one or more advantages over conventional electrochemical systems known in the art, including, but not limited to, no requirement of gas diffusion anode; higher cell efficiency; lower voltages; platinum free anode; sequestration of carbon dioxide; green and environment friendly chemicals; and/or formation of various commercially viable products. In some method and system embodiments, the anode does not produce chlorine gas.

Some embodiments of the electrochemical cells used in the methods and systems provided herein are as illustrated in the figures and as described herein. It is to be understood that the figures are for illustration purposes only and that variations in the reagents and set up are well within the scope of the invention. All the electrochemical methods and systems described herein do not produce a gas at the anode such as chlorine gas, as is found in the chlor-alkali systems.

Figure 3:
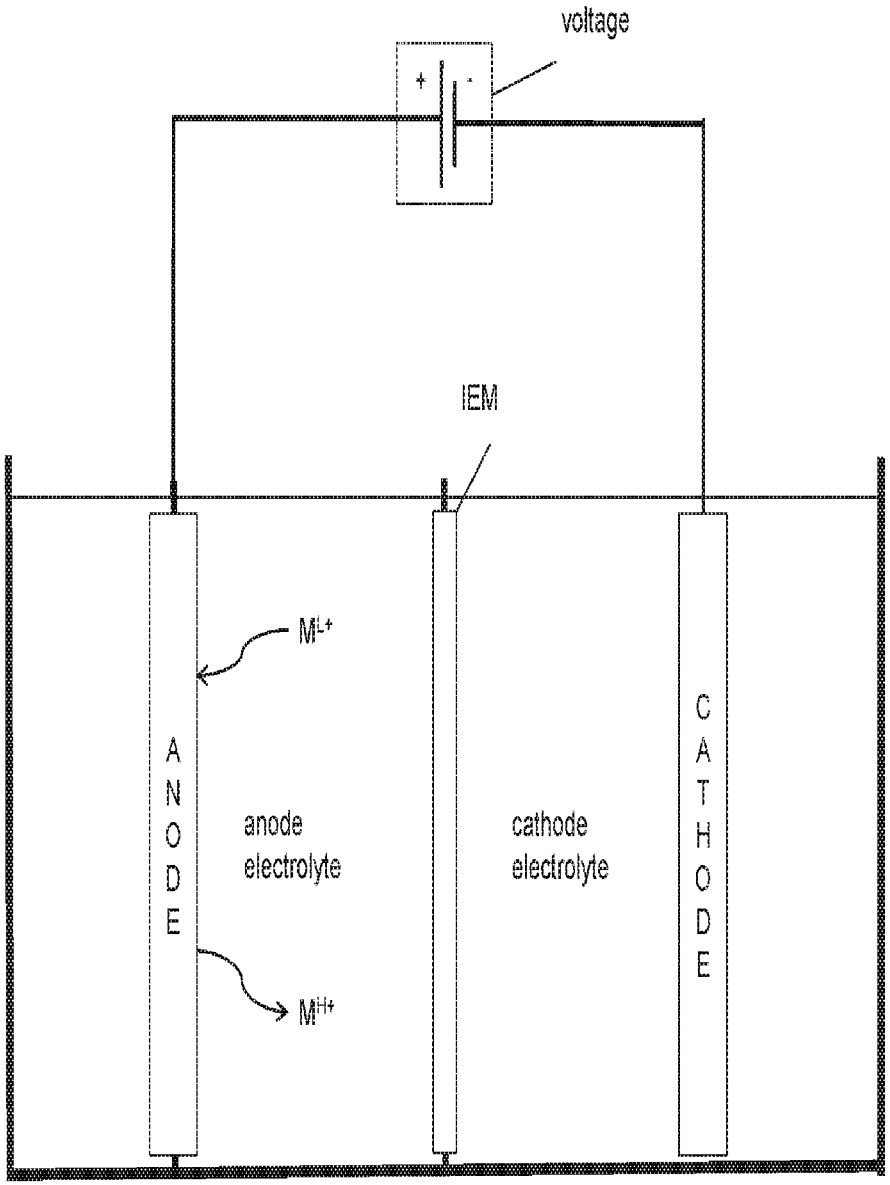
FIG. 3 is an illustration of some embodiments of the electrochemical system.

As illustrated in FIG. 3, the electrochemical system includes an anode chamber with an anode in contact with an anode electrolyte where the anode electrolyte contains metal ions in the lower oxidation state (represented as $M^{L+}$) which are converted by the anode to metal ions in the higher oxidation state (represented as $M^{H+}$). The metal ion may be in the form of a metal halide, such as, but not limited to, fluoride, chloride, bromide, or iodide.

As used herein "lower oxidation state" represented as L+ in $M^{L+}$ includes the lower oxidation state of the metal. For example, lower oxidation state of the metal ion may be 1+, 2+, 3+, 4+, or 5+. As used herein "higher oxidation state" represented as H+ in $M^{H+}$ includes the higher oxidation state of the metal. For example, higher oxidation state of the metal ion may be 2+, 3+, 4+, 5+, or 6+.

The electron(s) generated at the anode are used to drive the reaction at the cathode. The cathode reaction may be any reaction known in the art. The anode chamber and the cathode chamber may be separated by an ion exchange membrane (IEM) that may allow the passage of ions, such as, but not limited to, sodium ions in some embodiments to the cathode electrolyte if the anode electrolyte also comprises saltwater such as, alkali metal ions (in addition to the metal ions such as metal halide), such as, sodium chloride, sodium bromide, sodium iodide, sodium sulfate, or ammonium ions; if the anode electrolyte is ammonium chloride or alkaline earth metal ions; if the anode electrolyte comprises alkaline earth metal ions such as, calcium, magnesium, strontium, barium, etc. or an equivalent solution containing metal halide. Some reactions that may occur at the cathode include, but not limited to, when cathode electrolyte comprises water then reaction of water to form hydroxide ions and hydrogen gas; when cathode electrolyte comprises water then reaction of oxygen gas and water to form hydroxide ions; when cathode electrolyte comprises HCl then reduction of HCl to form hydrogen gas; or when cathode electrolyte comprises HCl then reaction of HCl and oxygen gas to form water.

In some embodiments, the electrochemical system includes a cathode chamber with a cathode in contact with the cathode electrolyte that forms hydroxide ions in the cathode electrolyte. In some embodiments, the ion exchange membrane allows the passage of anions, such as, but not limited to, fluoride ions, chloride ions, bromide ions, or iodide ions to the anode electrolyte if the cathode electrolyte is e.g., sodium chloride, sodium bromide, sodium iodide, or sodium sulfate or an equivalent solution. The sodium ions combine with hydroxide ions in the cathode electrolyte to form sodium hydroxide. The anions combine with metal ions to form metal halide. It is to be understood that other cathodes such as, cathode reducing HCl to form hydrogen gas or cathode reacting both HCl and oxygen gas to form water, are equally applicable to the systems. Such cathodes have been described herein.

In some embodiments, the electrochemical systems of the invention include one or more ion exchange membranes. In some embodiments, the ion exchange membrane is a cation exchange membrane (CEM), an anion exchange membrane (AEM); or combination thereof.

Figure 4:
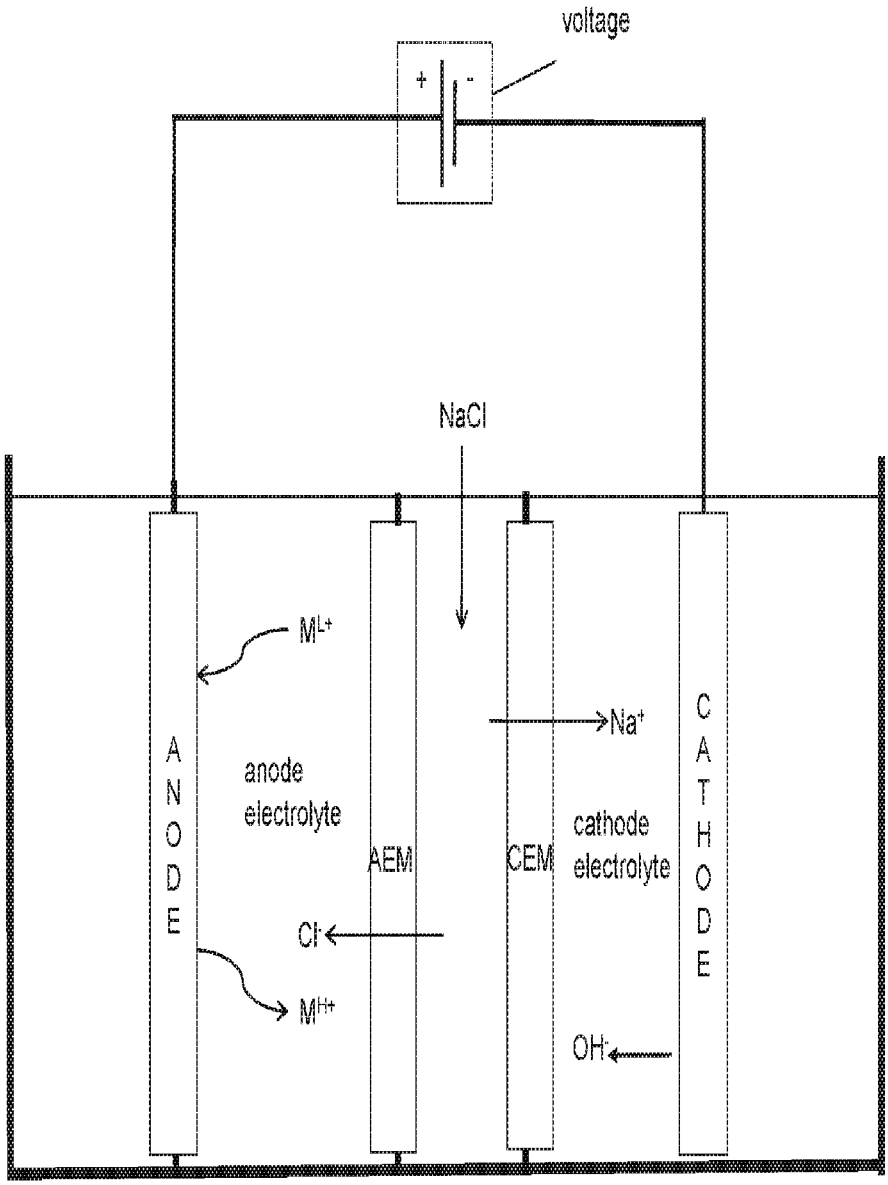
FIG. 4 is an illustration of some embodiments of the electrochemical system.

As illustrated in FIG. 4 (or also illustrated in FIG. 3), the electrochemical system includes a cathode in contact with a cathode electrolyte and an anode in contact with an anode electrolyte. The cathode forms hydroxide ions in the cathode electrolyte and the anode converts metal ions from lower oxidation state ($M^{L+}$) to higher oxidation state ($M^{H+}$). The anode and the cathode are separated by an anion exchange membrane (AEM) and a cation exchange membrane (CEM). A third electrolyte (e.g., sodium fluoride, sodium chloride, sodium bromide, sodium iodide, ammonium chloride, or combinations thereof or an equivalent solution) is disposed between the AEM and the CEM. The sodium ions from the third electrolyte pass through CEM to form sodium hydroxide in the cathode chamber and the halide anions such as, chloride, bromide or iodide ions, from the third electrolyte pass through the AEM to form a solution for metal halide in the anode chamber. It is to be understood that such embodiments may further include the anode electrolyte and/or the cathode electrolyte to also comprise alkali metal ions such as alkali metal halide or alkaline earth metal ions such as alkaline earth metal halide. The metal halide formed in the anode electrolyte of saltwater is then delivered to a reactor for reaction with the unsaturated hydrocarbon or the saturated hydrocarbon to generate one or more organic compounds or enantiomers thereof or is delivered to the oxyhalogenation reactor. The third electrolyte, after the transfer of the ions, can be withdrawn from the middle chamber as depleted ion solution. For example, in some embodiments when the third electrolyte is sodium chloride solution, then after the transfer of the sodium ions to the cathode electrolyte and transfer of chloride ions to the anode electrolyte, the depleted sodium chloride solution may be withdrawn from the middle chamber. The depleted salt solution may be used for commercial purposes or may be transferred to the anode and/or cathode chamber as an electrolyte or concentrated for reuse as the third electrolyte. In some embodiments, the depleted salt solution may be useful for preparing desalinated water. It is to be understood that the hydroxide forming cathode, as illustrated in FIG. 4 is for illustration purposes only and other cathodes such as, cathode reducing HCl to form hydrogen gas or cathode reacting both HCl and oxygen gas to form water, are equally applicable to the systems and have been described further herein.

In some embodiments, the ion exchange membrane described herein, is an anion exchange membrane. In such embodiments, the cathode electrolyte (or the third electrolyte in the third chamber) may be a sodium halide, ammonium halide, or an equivalent solution and the AEM is such that it allows the passage of anions to the anode electrolyte but prevents the passage of metal ions from the anode electrolyte to the cathode electrolyte (or to the third electrolyte in the third chamber). In some embodiments, the ion exchange membrane described herein, is a cation exchange membrane. In such embodiments, the anode electrolyte (or the third electrolyte in the third chamber) may be a sodium halide (or other alkali or alkaline earth metal halide), ammonium halide, or an equivalent solution containing the metal halide solution or an equivalent solution and the CEM is such that it allows the passage of alkali metal ions such as, sodium cations or alkaline earth metal ions, such as calcium ions to the cathode electrolyte but prevents the passage of metal ions from the anode electrolyte to the cathode electrolyte. In some embodiments, both the AEM and CEM may be joined together in the electrochemical system. In some embodiments, the use of one ion exchange membrane instead of two ion exchange membranes may reduce the resistance offered by multiple IEMs and may facilitate lower voltages for running the electrochemical reaction. Some examples of the suitable anion exchange membranes are provided further herein.

The electrochemical cells in the methods and systems provided herein are membrane electrolyzers. The electrochemical cell may be a single cell or may be a stack of cells connected in series or in parallel. The electrochemical cell may be a stack of 5 or 6 or 50 or 100 or more electrolyzers connected in series or in parallel. Each cell comprises an anode, a cathode, and an ion exchange membrane.

In some embodiments, the electrolyzers provided herein are monopolar electrolyzers. In the monopolar electrolyzers, the electrodes may be connected in parallel where all anodes and all cathodes are connected in parallel. In such monopolar electrolyzers, the operation takes place at high amperage and low voltage. In some embodiments, the electrolyzers provided herein are bipolar electrolyzers. In the bipolar electrolyzers, the electrodes may be connected in series where all anodes and all cathodes are connected in series. In such bipolar electrolyzers, the operation takes place at low amperage and high voltage. In some embodiments, the electrolyzers are a combination of monopolar and bipolar electrolyzers and may be called hybrid electrolyzers.

In some embodiments of the bipolar electrolyzers as described above, the cells are stacked serially constituting the overall electrolyzer and are electrically connected in two ways. In bipolar electrolyzers, a single plate, called bipolar plate, may serve as base plate for both the cathode and anode. The electrolyte solution may be hydraulically connected through common manifolds and collectors internal to the cell stack. The stack may be compressed externally to seal all frames and plates against each other which is typically referred to as a filter press design. In some embodiments, the bipolar electrolyzer may also be designed as a series of cells, individually sealed, and electrically connected through back-to-back contact, typically known as a single element design. The single element design may also be connected in parallel in which case it would be a monopolar electrolyzer.

In some embodiments, the cell size may be denoted by the active area dimensions. In some embodiments, the active area of the electrolyzers used herein may range from 0.5-1.5 meters tall and 0.4-3 meters wide. The individual compartment thicknesses may range from 0.5 mm-50 mm.

The electrolyzers used in the methods and systems provided herein, are made from corrosion resistant materials. Variety of materials was tested in metal solutions such as copper and at varying temperatures, for corrosion testing. The materials include, but not limited to, polyvinylidene fluoride, viton, polyether ether ketone, fluorinated ethylene propylene, fiber-reinforced plastic, halar, ultem (PEI), perfluoroalkoxy, tefzel, tyvar, fibre-reinforced plastic-coated with derakane 441-400 resin, graphite, akot, tantalum, hastelloy C2000, titanium Gr.7, titanium Gr.2, or combinations thereof. In some embodiments, these materials can be used for making the electrochemical cells and/or it components including, but not limited to, tank materials, piping, heat exchangers, pumps, reactors, cell housings, cell frames, electrodes, instrumentation, valves, and all other balance of plant materials. In some embodiments, the material used for making the electrochemical cell and its components include, but not limited to, titanium Gr.2.

Metal

The "metal ion" or "metal" or "metal ion of the metal halide" as used herein, includes any metal ion capable of being converted from lower oxidation state to higher oxidation state. Examples of metal ions in the corresponding metal halide include, but not limited to, iron, chromium, copper, tin, silver, cobalt, uranium, lead, mercury, vanadium, bismuth, titanium, ruthenium, osmium, europium, zinc, cadmium, gold, nickel, palladium, platinum, rhodium, iridium, manganese, technetium, rhenium, molybdenum, tungsten, niobium, tantalum, zirconium, hafnium, and combination thereof. In some embodiments, the metal ions in the corresponding metal halide include, but not limited to, iron, copper, tin, chromium, or combination thereof. In some embodiments, the metal ion in the corresponding metal halide is copper. In some embodiments, the metal ion in the corresponding metal halide is tin. In some embodiments, the metal ion in the corresponding metal halide is iron. In some embodiments, the metal ion in the corresponding metal halide is chromium. In some embodiments, the metal ion in the corresponding metal halide is platinum. The "oxidation state" as used herein, includes degree of oxidation of an atom in a substance. For example, in some embodiments, the oxidation state is the net charge on the ion. Some examples of the reaction of the metal ions at the anode are as shown in Table I below (SHE is standard hydrogen electrode). The theoretical values of the anode potential are also shown. It is to be understood that some variation from these voltages may occur depending on conditions, pH, concentrations of the electrolytes, etc and such variations are well within the scope of the invention.

TABLE I

| Anode Reaction | Anode Potential (V vs. SHE) |
|---|---|
| $Ag^{+} \rightarrow Ag^{2+} + e^{-}$ | −1.98 |
| $Co^{2+} \rightarrow Co^{3+} + e-$ | −1.82 |
| $Pb^{2+} \rightarrow Pb^{4+} + 2e^{-}$ | −1.69 |
| $Ce^{3+} \rightarrow Ce^{4+} + e^{-}$ | −1.44 |
| $2Cr^{3+} + 7H_2O \rightarrow Cr_2O_7^{2-} + 14H^{+} + 6e^{-}$ | −1.33 |
| $Tl^{+} \rightarrow Tl^{3+} + 2e^{-}$ | −1.25 |
| $Hg_2^{2+} \rightarrow 2Hg^{2+} + 2e^{-}$ | −0.91 |
| $Fe^{2+} \rightarrow Fe^{3+} + e^{-}$ | −0.77 |
| $V^{3+} + H_2O \rightarrow VO^{2+} + 2H^{+} + e^{-}$ | −0.34 |
| $U^{4+} + 2H_2O \rightarrow UO^{2+} + 4H^{+} + e^{-}$ | −0.27 |
| $Bi^{+} \rightarrow Bi^{3+} + 2e^{-}$ | −0.20 |
| $Ti^{3+} + H_2O \rightarrow TiO^{2+} + 2H^{+} + e^{-}$ | −0.19 |
| $Cu^{+} \rightarrow Cu^{2+} + e^{-}$ | −0.16 |
| $UO_2^{+} \rightarrow UO_2^{2+} + e^{-}$ | −0.16 |
| $Sn^{2+} \rightarrow Sn^{4+} + 2e^{-}$ | −0.15 |
| $Ru(NH_3)_6^{2+} \rightarrow Ru(NH_3)_6^{3+} + e^{-}$ | −0.10 |
| $V^{2+} \rightarrow V^{3+} + e^{-}$ | +0.26 |
| $Eu^{2+} \rightarrow Eu^{3+} + e^{-}$ | +0.35 |
| $Cr^{2+} \rightarrow Cr^{3+} + e^{-}$ | +0.42 |
| $U^{3+} \rightarrow U^{4+} + e^{-}$ | +0.52 |

The metal halide may be present as a compound of the metal or an alloy of the metal or combination thereof. In some embodiments, the anion attached to the metal is same as the anion of the electrolyte. For example, for sodium or potassium chloride used as an electrolyte, a metal chloride, such as, but not limited to, iron chloride, copper chloride, tin chloride, chromium chloride etc. is used as the metal compound. For example, for sodium or potassium bromide used as an electrolyte, a metal bromide, such as, but not limited to, iron bromide, copper bromide, tin bromide etc. is used as the metal compound.

In some embodiments, the anion of the electrolyte may be partially or fully different from the anion of the metal. For example, in some embodiments, the anion of the electrolyte may be a sulfate whereas the anion of the metal may be a chloride. In such embodiments, it may be desirable to have less concentration of the chloride ions in the electrochemical cell. In some embodiments, the anode electrolyte may be a combination of ions similar to the metal anion and anions different from the metal ion. For example, the anode electrolyte may be a mix of sulfate ions as well as chloride ions when the metal anion is chloride. In such embodiments, it may be desirable to have sufficient concentration of chloride ions in the electrolyte to dissolve the metal salt but not high enough to cause undesirable ionic speciation.

In some embodiments, the electrolyte and/or the metal compound are chosen based on the desired end product. For example, if a brominated product is desired from the reaction between the metal compound and the ethylene or ethane, then a metal bromide is used as the metal compound and the sodium or potassium bromide is used as the electrolyte. In some embodiments, the metal ions of the metal halide used in the electrochemical systems described herein, may be chosen based on the solubility of the metal in the anode electrolyte and/or cell voltages desired for the metal oxidation from the lower oxidation state to the higher oxidation state.

It is to be understood that the metal halide with the metal ion in the lower oxidation state and the metal halide with the metal ion in the higher oxidation state are both present in the anode electrolyte. The anode electrolyte exiting the anode chamber contains higher amount of the metal halide in the higher oxidation state than the amount of the metal halide in the higher oxidation state entering the anode chamber. Owing to the oxidation of the metal halide from the lower oxidation state to the higher oxidation state at the anode, the ratio of the metal halide in the lower and the higher oxidation state is different in the anode electrolyte entering the anode chamber and exiting the anode chamber. Suitable ratios of the metal ion in the lower and higher oxidation state in the anode electrolyte have been described herein. The mixed metal ion in the lower oxidation state with the metal ion in the higher oxidation state may assist in lower voltages in the electrochemical systems and high yield and selectivity in corresponding catalytic reactions with the ethylene or ethane.

In some embodiments, the metal ion in the anode electrolyte is a mixed metal ion. For example, the anode electrolyte containing the copper ion in the lower oxidation state and the copper ion in the higher oxidation state may also contain another metal ion such as, but not limited to, iron. In some embodiments, the presence of a second metal ion in the anode electrolyte may be beneficial in lowering the total energy of the electrochemical reaction in combination with the catalytic reaction.

Some examples of the metal compounds or metal halides that may be used in the systems and methods of the invention include, but are not limited to, copper (I) chloride, copper (I) bromide, copper (I) iodide, iron (II) chloride, iron (II) bromide, iron (II) iodide, tin (II) chloride, tin (II) bromide, tin (II) iodide, chromium (II) chloride, chromium (II) bromide, chromium (II) iodide, zinc (II) chloride, zinc (II) bromide, etc.

Ligand

In some embodiments, an additive such as a ligand is used in conjunction with the metal ion to improve the efficiency of the metal ion oxidation inside the anode chamber and/or improve the catalytic reactions of the metal ion inside/outside the anode chamber such as, but not limited to reactions with the unsaturated hydrocarbon or the saturated hydrocarbon. In some embodiments, the ligand is added along with the metal halide in the anode electrolyte. In some embodiments, the ligand interacts with the metal ion in the higher oxidation state, or with the metal ion in the lower oxidation state, or both. In some embodiments, the ligand is attached to the metal ion of the metal halide. In some embodiments, the ligand is attached to the metal ion by covalent, ionic and/or coordinate bonds. In some embodiments, the ligand is attached to the metal ion of the metal halide through vanderwaal attractions.

In some embodiments, the ligand results in one or more of the following: enhanced reactivity of the metal ion towards the ethylene or ethane, enhanced selectivity of the metal ion towards halogenation of the unsaturated hydrocarbon or the saturated hydrocarbon, enhanced transfer of the halogen from the metal halide to the unsaturated hydrocarbon or the saturated hydrocarbon, reduced redox potential of the electrochemical cell, enhanced solubility of the metal halide in the aqueous medium, reduced membrane cross-over of the metal halide to the cathode electrolyte in the electrochemical cell, reduced corrosion of the electrochemical cell and/or the reactor, enhanced separation of the metal ion from the organic solution after reaction with the unsaturated hydrocarbon or the saturated hydrocarbon, enhanced separation of the metal ion from the one or more organic compounds (such as adsorbents), and combination thereof.

In some embodiments, the attachment of the ligand to the metal ion increases the size of the metal ion sufficiently higher to prevent its migration through the ion exchange membranes in the cell. In some embodiments, the anion exchange membrane in the electrochemical cell is such that the migration of the metal ion attached to the ligand from the anode electrolyte to the cathode electrolyte, is prevented. Such membranes are described herein below. In some embodiments, the anion exchange membrane in the electrochemical cell may be used in conjunction with the size exclusion membrane such that the migration of the metal ion attached to the ligand from the anode electrolyte to the cathode electrolyte, is prevented. In some embodiments, the attachment of the ligand to the metal ion increases the solubility of the metal ion in the aqueous medium. In some embodiments, the attachment of the ligand to the metal ion reduces the corrosion of the metals in the electrochemical cell as well as the reactor. In some embodiments, the attachment of the ligand to the metal ion increases the size of the metal ion sufficiently higher to facilitate separation of the metal ion from the one or more organic compounds or enantiomers thereof after the reaction. In some embodiments, the presence and/or attachment of the ligand to the metal ion may prevent formation of various halogenated species of the metal ion in the solution and favor formation of only the desired species. For example, the presence of the ligand in the copper ion solution may limit the formation of the various halogenated species of the copper ion, such as, but not limited to, $[CuCl_3]^{2-}$ or $CuCl_2^0$ but favor formation of $Cu^{2+}/Cu^{+}$ ion. In some embodiments, the presence and/or attachment of the ligand in the metal ion solution reduces the overall voltage of the cell by providing one or more of the advantages described above.

The "ligand" as used herein includes any ligand capable of enhancing the properties of the metal ion. In some embodiments, ligands include, but not limited to, substituted or unsubstituted aliphatic phosphine, substituted or unsubstituted aromatic phosphine, substituted or unsubstituted amino phosphine, substituted or unsubstituted crown ether, substituted or unsubstituted aliphatic nitrogen, substituted or unsubstituted cyclic nitrogen, substituted or unsubstituted aliphatic sulfur, substituted or unsubstituted cyclic sulfur, substituted or unsubstituted heterocyclic, and substituted or unsubstituted heteroaromatic.

The ligands are described in detail in U.S. patent application Ser. No. 13/799,131, filed Mar. 13, 2013, which is incorporated herein by reference in its entirety.

In some embodiments, the concentration of the ligand in the electrochemical cell is dependent on the concentration of the metal ion in the lower and/or the higher oxidation state. In some embodiments, the concentration of the ligand is between 0.25M-5M; or between 0.25M-4M; or between 0.25M-3M; or between 0.5M-5M; or between 0.5M-4M; or between 0.5M-3M; or between 0.5M-2.5M; or between 0.5M-2M; or between 0.5M-1.5M; or between 0.5M-1M; or between 1M-2M; or between 1.5M-2.5M; or between 1.5M-2M.

In some embodiments, the ratio of the concentration of the ligand and the concentration of the metal ion such as, Cu(I) ion is between 1:1 to 4:1; or between 1:1 to 3:1; or between 1:1 to 2:1; or is 1:1; or 2:1, or 3:1, or 4:1.

In some embodiments, the solution used in the catalytic reaction, i.e., the reaction of the metal ion in the higher oxidation state with the unsaturated hydrocarbon or the saturated hydrocarbon, and the solution used in the electrochemical reaction, contain the concentration of the metal ion in the higher oxidation state, such as Cu(II), between 4M-8M, the concentration of the metal ion in the lower oxidation state, such as Cu(I), between 0.25M-2M, and the concentration of the ligand between 0.25M-6M. In some embodiments, the concentration of the alkali metal ions, such as, but not limited to, sodium chloride in the solution may affect the solubility of the ligand and/or the metal ion; the yield and selectivity of the catalytic reaction; and/or the efficiency of the electrochemical cell. Accordingly, in some embodiments, the concentration of sodium chloride in the solution is between 1M-5M or between 1-3M. In some embodiments, the solution used in the catalytic reaction, i.e., the reaction of the metal ion in the higher oxidation state with the unsaturated hydrocarbon or the saturated hydrocarbon, and the solution used in the electrochemical reaction, contain the concentration of the metal ion in the higher oxidation state, such as Cu(II), between 4M-8M, the concentration of the metal ion in the lower oxidation state, such as Cu(I), between 0.25M-2M, the concentration of the ligand between 0.25M-6M, and the concentration of sodium chloride between 1M-5M.

Anode

In some embodiments, the anode may contain a corrosion stable, electrically conductive base support. Such as, but not limited to, amorphous carbon, such as carbon black, fluorinated carbons like the specifically fluorinated carbons described in U.S. Pat. No. 4,908,198 and available under the trademark SFC™ carbons. Other examples of electrically conductive base materials include, but not limited to, sub-stoichiometric titanium oxides, such as, Magneli phase sub-stoichiometric titanium oxides having the formula $TiO_x$ wherein x ranges from about 1.67 to about 1.9. Some examples of titanium sub-oxides include, without limitation, titanium oxide $Ti_4O_7$. The electrically conductive base materials also include, without limitation, metal titanates such as $M_xTi_yO_z$ such as $M_xTi_4O_7$, etc. In some embodiments, carbon based materials provide a mechanical support or as blending materials to enhance electrical conductivity but may not be used as catalyst support to prevent corrosion.

In some embodiments, the anode is not coated with an electrocatalyst. In some embodiments, the gas-diffusion electrodes or general electrodes described herein (including anode and/or cathode) contain an electrocatalyst for aiding in electrochemical dissociation, e.g. reduction of oxygen at the cathode or the oxidation of the metal ion at the anode. Examples of electrocatalysts include, but not limited to, highly dispersed metals or alloys of the platinum group metals, such as platinum, palladium, ruthenium, rhodium, iridium, or their combinations such as platinum-rhodium, platinum-ruthenium, titanium mesh coated with PtIr mixed metal oxide or titanium coated with galvanized platinum; electrocatalytic metal oxides, such as, but not limited to, $IrO_2$; gold, tantalum, carbon, graphite, organometallic macrocyclic compounds, and other electrocatalysts well known in the art for electrochemical reduction of oxygen or oxidation of metal.

In some embodiments, the electrodes described herein, relate to porous homogeneous composite structures as well as heterogeneous, layered type composite structures wherein each layer may have a distinct physical and compositional make-up, e.g. porosity and electroconductive base to prevent flooding, and loss of the three phase interface, and resulting electrode performance.

In some embodiments, the electrodes provided herein may include anodes and cathodes having porous polymeric layers on or adjacent to the anolyte or catholyte solution side of the electrode which may assist in decreasing penetration and electrode fouling. Stable polymeric resins or films may be included in a composite electrode layer adjacent to the anolyte comprising resins formed from non-ionic polymers, such as polystyrene, polyvinyl chloride, polysulfone, etc., or ionic-type charged polymers like those formed from polystyrenesulfonic acid, sulfonated copolymers of styrene and vinylbenzene, carboxylated polymer derivatives, sulfonated or carboxylated polymers having partially or totally fluorinated hydrocarbon chains and aminated polymers like polyvinylpyridine. Stable microporous polymer films may also be included on the dry side to inhibit electrolyte penetration. In some embodiments, the gas-diffusion cathodes includes such cathodes known in the art that are coated with high surface area coatings of precious metals such as gold and/or silver, precious metal alloys, nickel, and the like.

In some embodiments, the methods and systems provided herein include anode that allows increased diffusion of the electrolyte in and around the anode. The shape and/or geometry of the anode may have an effect on the flow or the velocity of the anode electrolyte around the anode in the anode chamber which in turn may improve the mass transfer and reduce the voltage of the cell. In some embodiments, the methods and systems provided herein include anode that is a "diffusion enhancing" anode. The "diffusion enhancing" anode as used herein includes anode that enhances the diffusion of the electrolyte in and/or around the anode thereby enhancing the reaction at the anode. In some embodiments, the diffusion enhancing anode is a porous anode. The "porous anode" as used herein includes an anode that has pores in it. The diffusion enhancing anode such as, but not limited to, the porous anode used in the methods and systems provided herein, may have several advantages over the non-diffusing or non-porous anode in the electrochemical systems including, but not limited to, higher surface area;

increase in active sites; decrease in voltage; decrease or elimination of resistance by the anode electrolyte; increase in current density; increase in turbulence in the anode electrolyte; and/or improved mass transfer.

The diffusion enhancing anode such as, but not limited to, the porous anode may be flat, unflat, or combinations thereof. For example, in some embodiments, the diffusion enhancing anode such as, but not limited to, the porous anode is in a flat form including, but not limited to, an expanded flattened form, a perforated plate, a reticulated structure, etc. In some embodiments, the diffusion enhancing anode such as, but not limited to, the porous anode includes an expanded mesh or is a flat expanded mesh anode.

In some embodiments, the diffusion enhancing anode such as, but not limited to, the porous anode is unflat or has a corrugated geometry. In some embodiments, the corrugated geometry of the anode may provide an additional advantage of the turbulence to the anode electrolyte and improve the mass transfer at the anode. The "corrugation" or "corrugated geometry" or "corrugated anode" as used herein includes an anode that is not flat or is unflat. The corrugated geometry of the anode includes, but not limited to, unflattened, expanded unflattened, staircase, undulations, wave like, 3-D, crimp, groove, pleat, pucker, ridge, niche, ruffle, wrinkle, woven mesh, punched tab style, etc.

In some embodiments of the foregoing methods and embodiments, the use of the diffusion enhancing anode such as, but not limited to, the porous anode results in the voltage savings of between 10-500 mV, or between 50-250 mV, or between 100-200 mV, or between 200-400 mV, or between 25-450 mV, or between 250-350 mV, or between 100-500 mV, as compared to the non-diffusing or the non-porous anode.

In some embodiments of the foregoing methods and embodiments, the use of the corrugated anode results in the voltage savings of between 10-500 mV, or between 50-250 mV, or between 100-200 mV, or between 200-400 mV, or between 25-450 mV, or between 250-350 mV, or between 100-500 mV, as compared to the flat porous anode.

In some embodiments, the porous anode is a combination of flat and corrugated anode.

The diffusion enhancing anode such as, but not limited to, the porous anode may be characterized by various parameters including, but not limited to, mesh number which is a number of lines of mesh per inch; pore size; thickness of the wire or wire diameter; percentage open area; amplitude of the corrugation; repetition period of the corrugation, etc. These characteristics of the diffusion enhancing anode such as, but not limited to, the porous anode may affect the properties of the porous anode, such as, but not limited to, increase in the surface area for the anode reaction; reduction of solution resistance; reduction of voltage applied across the anode and the cathode; enhancement of the electrolyte turbulence across the anode; and/or improved mass transfer at the anode.

In some embodiments of the foregoing methods and embodiments, the diffusion enhancing anode such as, but not limited to, the porous anode may have a pore opening size anging between 2×1 mm to 20×10 mm; or between 2×1 mm to 10×5 mm; or between 2×1 mm to 5×5 mm; or between 1×1 mm to 20×10 mm; or between 1×1 mm to 10×5 mm; or between 1×1 mm to 5×5 mm; or between 5×1 mm to 10×5 mm; or between 5×1 mm to 20×10 mm; between 10×5 mm to 20×10 mm and the like. It is to be understood that the pore size of the porous anode may also be dependent on the geometry of the pore. For example, the geometry of the pore may be diamond shaped or square shaped. For the diamond shaped geometry, the pore size may be, e.g., 3×10 mm with 3 mm being widthwise and 10 mm being lengthwise of the diamond, or vice versa. For the square shaped geometry, the pore size would be, e.g., 3 mm each side. The woven mesh may be the mesh with square shaped pores and the expanded mesh may be the mesh with diamond shaped pores.

In some embodiments of the foregoing methods and embodiments, the diffusion enhancing anode such as, but not limited to, the porous anode may have a pore wire thickness or mesh thickness ranging between 0.5 mm to 5 mm; or between 0.5 mm to 4 mm; or between 0.5 mm to 3 mm; or between 0.5 mm to 2 mm; or between 0.5 mm to 1 mm; or between 1 mm to 5 mm; or between 1 mm to 4 mm; or between 1 mm to 3 mm; or between 1 mm to 2 mm; or between 2 mm to 5 mm; or between 2 mm to 4 mm; or between 2 mm to 3 mm; or between 0.5 mm to 2.5 mm; or between 0.5 mm to 1.5 mm; or between 1 mm to 1.5 mm; or between 1 mm to 2.5 mm; or between 2.5 mm to 3 mm; or 0.5 mm; or 1 mm; or 2 mm; or 3 mm.

In some embodiments of the foregoing methods and embodiments, when the diffusion enhancing anode such as, but not limited to, the porous anode is the corrugated anode, then the corrugated anode may have a corrugation amplitude ranging between 1 mm to 8 mm; or between 1 mm to 7 mm; or between 1 mm to 6 mm; or between 1 mm to 5 mm; or between 1 mm to 4 mm; or between 1 mm to 4.5 mm; or between 1 mm to 3 mm; or between 1 mm to 2 mm; or between 2 mm to 8 mm; or between 2 mm to 6 mm; or between 2 mm to 4 mm; or between 2 mm to 3 mm; or between 3 mm to 8 mm; or between 3 mm to 7 mm; or between 3 mm to 5 mm; or between 3 mm to 4 mm; or between 4 mm to 8 mm; or between 4 mm to 5 mm; or between 5 mm to 7 mm; or between 5 mm to 8 mm.

In some embodiments of the foregoing methods and embodiments, when the diffusion enhancing anode such as, but not limited to, the porous anode is the corrugated anode, then the corrugated anode may have a corrugation period ranging between 2 mm to 35 mm; or between 2 mm to 32 mm; or between 2 mm to 30 mm; or between 2 mm to 25 mm; or between 2 mm to 20 mm; or between 2 mm to 16 mm; or between 2 mm to 10 mm; or between 5 mm to 35 mm; or between 5 mm to 30 mm; or between 5 mm to 25 mm; or between 5 mm to 20 mm; or between 5 mm to 16 mm; or between 5 mm to 10 mm; or between 15 mm to 35 mm; or between 15 mm to 30 mm; or between 15 mm to 25 mm; or between 15 mm to 20 mm; or between 20 mm to 35 mm; or between 25 mm to 30 mm; or between 25 mm to 35 mm; or between 25 mm to 30 mm.

In some embodiments, the diffusion enhancing anode such as, but not limited to, the porous anode is made of an electro conductive base metal such as titanium coated with or without electrocatalysts. Some examples of electrically conductive base materials include, but not limited to, sub-stoichiometric titanium oxides, such as, Magneli phase sub-stoichiometric titanium oxides having the formula $TiO_x$ wherein x ranges from about 1.67 to about 1.9. Some examples of titanium sub-oxides include, without limitation, titanium oxide $Ti_4O_7$. The electrically conductive base materials also include, without limitation, metal titanates such as $M_xTi_yO_z$ such as $M_xTi_4O_7$, etc. Examples of electrocatalysts have been described herein and include, but not limited to, highly dispersed metals or alloys of the platinum group metals, such as platinum, palladium, ruthenium, rhodium, iridium, or their combinations such as platinum-rhodium, platinum-ruthenium, titanium mesh coated with PtIr mixed metal oxide or titanium coated with galvanized platinum;

electrocatalytic metal oxides, such as, but not limited to, $IrO_2$; gold, tantalum, carbon, graphite, organometallic macrocyclic compounds, and other electrocatalysts well known in the art. The diffusion enhancing anode such as, but not limited to, the porous anode may be commercially available or may be fabricated with appropriate metals. The electrodes may be coated with electrocatalysts using processes well known in the art. For example, the metal may be dipped in the catalytic solution for coating and may be subjected to processes such as heating, sand blasting etc. Such methods of fabricating the anodes and coating with catalysts are well known in the art.

In some embodiments of the methods and systems described herein, a turbulence promoter is used in the anode compartment to improve mass transfer at the anode. For example, as the current density increases in the electrochemical cell, the mass transfer controlled reaction rate at the anode is achieved. The laminar flow of the anolyte may cause resistance and diffusion issues. In order to improve the mass transfer at the anode and thereby reduce the voltage of the cell, a turbulence promoter may be used in the anode compartment. A turbulence promoter includes a component in the anode compartment of the electrochemical cell that provides turbulence. In some embodiments, the turbulence promoter may be provided at the back of the anode, i.e. between the anode and the wall of the electrochemical cell and/or in some embodiments, the turbulence promoter may be provided between the anode and the anion exchange membrane. For example only, the electrochemical systems provided herein, may have a turbulence promoter between the anode and the ion exchange membrane such as the anion exchange membrane and/or have the turbulence promoter between the anode and the outer wall of the cell.

An example of the turbulence promoter is bubbling of the gas in the anode compartment. The gas can be any inert gas that does not react with the constituents of the anolyte. For example, the gas includes, but not limited to, air, nitrogen, argon, and the like. The bubbling of the gas at the anode can stir up the anode electrolyte and improve the mass transfer at the anode. The improved mass transfer can result in the reduced voltage of the cell. Other examples of the turbulence promoter include, but not limited to, incorporating a carbon cloth next to the anode, incorporating a carbon/graphite felt next to the anode, an expanded plastic next to the anode, a fishing net next to the anode, a combination of the foregoing, and the like.

Cathode

Any of the cathodes provided herein can be used in combination with any of the anodes described above. In some embodiments, the cathode used in the electrochemical systems of the invention, is a hydrogen gas producing cathode.

Following are the reactions that take place at the cathode and the anode:

$H_2O+e^- \rightarrow \frac{1}{2}H_2+OH^-$ (cathode)

$M^{L+} \rightarrow M^{H+}+xe^-$ (anode where $x$=1-3)

For example, $Fe^{2+} \rightarrow Fe^{3+}+e^-$ (anode)

$Cr^{2+} \rightarrow Cr^{3+}+e^-$ (anode)

$Sn^{2+} \rightarrow Sn^{4+}+2e^-$ (anode)

$Cu^{+} \rightarrow Cu^{2+}+e^-$ (anode)

The hydrogen gas formed at the cathode may be vented out or captured and stored for commercial purposes. The $M^{H+}$ formed at the anode combines with halide ions, e.g. chloride ions to form metal chloride in the higher oxidation state such as, but not limited to, $FeCl_3$, $CrCl_3$, $SnCl_4$, or $CuCl_2$ etc. The hydroxide ion formed at the cathode combines with sodium ions to form sodium hydroxide. It is to be understood that chloride ions in this application are for illustration purposes only and that other equivalent ions such as, but not limited to, fluoride, bromide or iodide are also well within the scope of the invention and would result in corresponding metal halide in the anode electrolyte.

In some embodiments, the cathode used in the electrochemical systems of the invention, is a hydrogen gas producing cathode that does not form an alkali. Following are the reactions that take place at the cathode and the anode:

$2H^+ + 2e^- \rightarrow H_2$ (cathode)

$M^{L+} \rightarrow M^{H+}+xe^-$ (anode where $x$=1-3)

For example, $Fe^{2+} \rightarrow Fe^{3+}+e^-$ (anode)

$Cr^{2+} \rightarrow Cr^{3+}+e^-$ (anode)

$Sn^{2+} \rightarrow Sn^{4+}+2e^-$ (anode)

$Cu^{+} \rightarrow Cu^{2+}+e^-$ (anode)

The hydrogen gas may be vented out or captured and stored for commercial purposes. The $M^{H+}$ formed at the anode combines with halide ions, e.g. chloride ions to form metal chloride in the higher oxidation state such as, but not limited to, $FeCl_3$, $CrCl_3$, $SnCl_4$, or $CuCl_2$ etc.

In some embodiments, the cathode in the electrochemical systems of the invention may be a gas-diffusion cathode. In some embodiments, the cathode in the electrochemical systems of the invention may be a gas-diffusion cathode forming an alkali at the cathode. As used herein, the "gas-diffusion cathode," or "gas-diffusion electrode," or other equivalents thereof include any electrode capable of reacting a gas to form ionic species. In some embodiments, the gas-diffusion cathode, as used herein, is an oxygen depolarized cathode (ODC). Such gas-diffusion cathode may be called gas-diffusion electrode, oxygen consuming cathode, oxygen reducing cathode, oxygen breathing cathode, oxygen depolarized cathode, and the like.

Following are the reactions that may take place at the anode and the cathode.

$H_2O+\frac{1}{2}O_2+2e^- \rightarrow 2OH^-$ (cathode)

$M^{L+} \rightarrow M^{H+}+xe^-$ (anode where $x$=1-3)

For example, $2Fe^{2+} \rightarrow 2Fe^{3+}+2e^-$ (anode)

$2Cr^{2+} \rightarrow 2Cr^{3+}+2e^-$ (anode)

$Sn^{2+} \rightarrow Sn^{4+}+2e^-$ (anode)

$2Cu^{+} \rightarrow 2Cu^{2+}+2e^-$ (anode)

The $M^{H+}$ formed at the anode combines with halide ions, e.g. chloride ions to form metal chloride $MCl_n$ such as, but not limited to, $FeCl_3$, $CrCl_3$, $SnCl_4$, or $CuCl_2$ etc. The hydroxide ion formed at the cathode reacts with sodium ions to form sodium hydroxide. The oxygen at the cathode may be atmospheric air or any commercial available source of oxygen.

The methods and systems containing the gas-diffusion cathode or the ODC, as described herein may result in voltage savings as compared to methods and systems that include the hydrogen gas producing cathode. The voltage savings in-turn may result in less electricity consumption and less carbon dioxide emission for electricity generation.

While the methods and systems containing the gas-diffusion cathode or the ODC result in voltage savings as compared to methods and systems containing the hydrogen gas producing cathode, both the systems i.e. systems containing the ODC and the systems containing hydrogen gas producing cathode of the invention, show significant voltage savings as compared to chlor-alkali system conventionally known in the art. The voltage savings in-turn may result in less electricity consumption and less carbon dioxide emission for electricity generation. In some embodiments, the electrochemical system of the invention (2 or 3-compartment cells with hydrogen gas producing cathode or ODC) has a theoretical voltage savings of more than 0.5V, or more than 1V, or more than 1.5V, or between 0.5-3V, as compared to chlor-alkali process. In some embodiments, this voltage saving is achieved with a cathode electrolyte pH of between 7-15, or between 7-14, or between 6-12, or between 7-12, or between 7-10.

For example, theoretical $E_{anode}$ in the chlor-alkali process is about 1.36V undergoing the reaction as follows:

$$2Cl^- \rightarrow Cl_2 + 2e^-,$$

Theoretical $E_{cathode}$ in the chlor-alkali process is about −0.83V (at pH>14) undergoing the reaction as follows:

$$2H_2O + 2e^- = H_2 + 2OH^-$$

Theoretical $E_{total}$ for the chlor-alkali process then is 2.19V. Theoretical $E_{total}$ for the hydrogen gas producing cathode in the system of the invention is between 0.989 to 1.53V and $E_{total}$ for ODC in the system of the invention then is between −0.241 to 0.3V, depending on the concentration of copper ions in the anode electrolyte. Therefore, the electrochemical systems of the invention bring the theoretical voltage savings in the cathode chamber or the theoretical voltage savings in the cell of greater than 3V or greater than 2V or between 0.5-2.5V or between 0.5-2.0V or between 0.5-1.5V or between 0.5-1.0V or between 1-1.5V or between 1-2V or between 1-2.5V or between 1.5-2.5V, as compared to the chlor-alkali system.

In some embodiments, the cathode in the electrochemical systems of the invention may be a gas-diffusion cathode that reacts HCl and oxygen gas to form water.

Following are the reactions that may take place at the anode and the cathode.

$$2H^+ + \tfrac{1}{2}O_2 + 2e^- \rightarrow H_2O \text{ (cathode)}$$

$$M^{L+} \rightarrow M^{H+} + xe^- \text{ (anode where } x=1\text{-}3)$$

For example, $2Fe^{2+} \rightarrow 2Fe^{3+} + 2e^-$ (anode)

$$2Cr^{2+} \rightarrow 2Cr^{3+} + 2e^- \text{ (anode)}$$

$$Sn^{2+} \rightarrow Sn^{4+} + 2e^- \text{ (anode)}$$

$$2Cu^+ \rightarrow 2Cu^{2+} + 2e^- \text{ (anode)}$$

The $M^{H+}$ formed at the anode combines with chloride ions to form metal chloride $MCl_n$ such as, but not limited to, $FeCl_3$, $CrCl_3$, $SnCl_4$, or $CuCl_2$ etc. The oxygen at the cathode may be atmospheric air or any commercial available source of oxygen.

Alkali in the Cathode Chamber

The cathode electrolyte containing the alkali maybe withdrawn from the cathode chamber. In some embodiments, the alkali produced in the methods and systems provided herein is used as is commercially or is used in commercial processes known in the art. The purity of the alkali formed in the methods and systems may vary depending on the end use requirements. For example, methods and systems provided herein that use an electrochemical cell equipped with membranes may form a membrane quality alkali which may be substantially free of impurities. In some embodiments, a less pure alkali may also be formed by avoiding the use of membranes or by adding the carbon to the cathode electrolyte. In some embodiments, the alkali may be separated from the cathode electrolyte using techniques known in the art, including but not limited to, diffusion dialysis. In some embodiments, the alkali formed in the cathode electrolyte is more than 2% w/w or more than 5% w/w or between 5-50% w/w.

In some embodiments, the systems include a collector configured to collect the alkali from the cathode chamber and connect it to the appropriate process which may be any means to collect and process the alkali including, but not limited to, tanks, collectors, pipes etc. that can collect, process, and/or transfer the alkali produced in the cathode chamber for use in the various commercial processes.

In some embodiments, the alkali formed in the cathode electrolyte is used in making products such as, but not limited to carbonates and/or bicarbonates by contacting the carbon dioxide with the alkali. Such contact of the carbon dioxide, the sources of the carbon dioxide, and the formation of carbonate and/or bicarbonate products, is fully described in U.S. patent application Ser. No. 13/799,131, filed Mar. 13, 2013, which is incorporated herein by reference in its entirety.

Ion Exchange Membrane

In some embodiments, the cathode electrolyte and the anode electrolyte are separated in part or in full by an ion exchange membrane. In some embodiments, the ion exchange membrane is an anion exchange membrane or a cation exchange membrane. In some embodiments, the cation exchange membranes in the electrochemical cell, as disclosed herein, are conventional and are available from, for example, Asahi Kasei of Tokyo, Japan; or from Membrane International of Glen Rock, N.J., or DuPont, in the USA. Examples of CEM include, but are not limited to, N2030WX (Dupont), F8020/F8080 (Flemion), and F6801 (Aciplex). CEMs that are desirable in the methods and systems of the invention have minimal resistance loss, greater than 90% selectivity, and high stability in concentrated caustic. AEMs, in the methods and systems of the invention are exposed to concentrated metallic salt anolytes and saturated brine stream. It is desirable for the AEM to allow passage of salt ion such as chloride ion to the anolyte but reject the metallic ion species from the anolyte. In some embodiments, metallic salts may form various ion species (cationic, anionic, and/or neutral) including but not limited to, $MCl^+$, $MCl_2^-$, $MCl_2^0$, $M^{2+}$ etc. and it is desirable for such complexes to not pass through AEM or not foul the membranes.

In some embodiments, the AEM used in the methods and systems provided herein, is also substantially resistant to the organic compounds such that AEM does not interact with the organics and/or the AEM does not react or absorb metal ions. In some embodiments, this can be achieved, for example only, by using a polymer that does not contain a free radical or anion available for reaction with organics or with metal ions. For example only, a fully quarternized amine containing polymer may be used as an AEM.

In some embodiments, the membranes used in the methods and systems provided herein are ionomer membranes reinforced with a material for reinforcement and are of a certain thickness. For example, in some embodiments, the thickness of the membrane is between 20-130 um; or between 20-110 um; or between 20-110 um; or between 20-80 um; or between 20-75 um; or between 20-60 um; or between 20-50 um; or between 20-40 um; or between 20-35 um. In some embodiments, the membrane may be reinforced with materials such as, but not limited to, polymers, such as, polyethylene (PET), polypropylene (PP), and polyether ether ketone (PK), and glass fibers (GF). It is understood that other polymers that may be used for reinforcement of the AEM are well within the scope of the invention. In some embodiments, the membranes used in the methods and systems provided herein can withstand high temperatures, such as, but not limited to, temperatures higher than 70° C., for example between 70-200° C.; or between 70-175° C.; or between 70-150° C.; or between 70-100° C.

In some embodiments of the aforementioned methods and embodiments, the anion exchange membrane rejects more than 80%, or more than 90%, or more than 99%, or about 99.9% of all metal ions from the anode electrolyte passing into the third electrolyte or the brine compartment or the cathode electrolyte. In some embodiments, the anion exchange membrane operates at temperatures greater than 70° C.

Examples of cationic exchange membranes include, but not limited to, cationic membrane consisting of a perfluorinated polymer containing anionic groups, for example sulphonic and/or carboxylic groups. However, it may be appreciated that in some embodiments, depending on the need to restrict or allow migration of a specific cation or an anion species between the electrolytes, a cation exchange membrane that is more restrictive and thus allows migration of one species of cations while restricting the migration of another species of cations may be used as, e.g., a cation exchange membrane that allows migration of sodium ions into the cathode electrolyte from the anode electrolyte while restricting migration of other ions from the anode electrolyte into the cathode electrolyte, may be used. Similarly, in some embodiments, depending on the need to restrict or allow migration of a specific anion species between the electrolytes, an anion exchange membrane that is more restrictive and thus allows migration of one species of anions while restricting the migration of another species of anions may be used as, e.g., an anion exchange membrane that allows migration of chloride ions into the anode electrolyte from the cathode electrolyte while restricting migration of hydroxide ions from the cathode electrolyte into the anode electrolyte, may be used. Such restrictive cation exchange membranes are commercially available and can be selected by one ordinarily skilled in the art.

In some embodiments, the membranes may be selected such that they can function in an acidic and/or basic electrolytic solution as appropriate. Other desirable characteristics of the membranes include high ion selectivity, low ionic resistance, high burst strength, and high stability in an acidic electrolytic solution in a temperature range of room temperature to 150° C. or higher, or a alkaline solution in similar temperature range may be used. In some embodiments, it is desirable that the ion exchange membrane prevents the transport of the metal ion from the anolyte to the catholyte. In some embodiments, a membrane that is stable in the range of 0° C. to 150° C.; 0° C. to 90° C.; or 0° C. to 80° C.; or 0° C. to 70° C.; or 0° C. to 60° C.; or 0° C. to 50° C.; or 0° C. to 40° C., or 0° C. to 30° C., or 0° C. to 20° C., or 0° C. to 10° C., or higher may be used. For other embodiments, it may be useful to utilize an ion-specific ion exchange membranes that allows migration of one type of cation but not another; or migration of one type of anion and not another, to achieve a desired product or products in an electrolyte. In some embodiments, the membrane may be stable and functional for a desirable length of time in the system, e.g., several days, weeks or months or years at temperatures in the range of 0° C. to 90° C. In some embodiments, for example, the membranes may be stable and functional for at least 1 day, at least 5 days, 10 days, 15 days, 20 days, 100 days, 1000 days, 5-10 years, or more in electrolyte temperatures at 100° C., 90° C., 80° C., 70° C., 60° C., 50° C., 40° C., 30° C., 20° C., 10° C., 5° C. and more or less.

The ohmic resistance of the membranes may affect the voltage drop across the anode and cathode, e.g., as the ohmic resistance of the membranes increase, the voltage across the anode and cathode may increase, and vice versa. Membranes that can be used include, but are not limited to, membranes with relatively low ohmic resistance and relatively high ionic mobility; and membranes with relatively high hydration characteristics that increase with temperatures, and thus decreasing the ohmic resistance. By selecting membranes with lower ohmic resistance known in the art, the voltage drop across the anode and the cathode at a specified temperature can be lowered.

Scattered through membranes may be ionic channels including acid groups. These ionic channels may extend from the internal surface of the matrix to the external surface and the acid groups may readily bind water in a reversible reaction as water-of-hydration. This binding of water as water-of-hydration may follow first order reaction kinetics, such that the rate of reaction is proportional to temperature. Consequently, membranes can be selected to provide a relatively low ohmic and ionic resistance while providing for improved strength and resistance in the system for a range of operating temperatures.

Electrolytes

In the methods and systems described herein, the anode electrolyte containing the metal halide contains a mixture of the metal ion in the lower oxidation state and the metal ion in the higher oxidation state in saltwater solution (such as alkali metal halide solution e.g. sodium chloride aqueous solution). In some embodiments, the anode electrolyte that is contacted with the unsaturated hydrocarbon or the saturated hydrocarbon contains the metal ion in the lower oxidation state and the metal ion in the higher oxidation state. In some embodiments, the metal ion in the lower oxidation state and the metal ion in the higher oxidation state are present in a ratio such that the reaction of the metal ion with the unsaturated hydrocarbon or the saturated hydrocarbon to form one or more organic compounds or enantiomers thereof takes place. Some embodiments for the concentrations of the metal halide with the metal ion in the lower oxidation state for various systems have been provided herein.

In addition to the concentration of the metal halide with the metal ion in the lower oxidation state for various systems that have been provided herein, in some embodiments of the methods and systems described herein, the anode electrolyte in the electrochemical, the saltwater in the oxyhalogenation, and the saltwater in the halogenation systems and methods provided herein contain the metal ion in the higher oxidation state in the range of 4-8M. In some embodiments of the methods and systems described herein, the anode electrolyte in the electrochemical, the saltwater in the oxyhalogenation, and the saltwater in the halogenation systems and methods provided herein contain the metal ion in the higher oxidation state in the range of 4-8M, the metal ion in the lower oxidation state in the range provided herein in detail and saltwater, such as alkali metal ions or alkaline earth metal ions, e.g. sodium chloride in the range of 1-5M. The anode electrolyte may optionally contain 0.01-0.1M hydrochloric acid. In some embodiments of the methods and systems described herein, the anode electrolyte reacted with the unsaturated hydrocarbon or the saturated hydrocarbon contains the metal ion in the higher oxidation state in the range of 4-7M, the metal ion in the lower oxidation state in the range provided herein above and sodium chloride in the range of 1-3M. The anode electrolyte may optionally contain 0.01-0.1M hydrochloric acid.

In some embodiments, the anode electrolyte may contain metal ion in the lower oxidation state and negligible or low amounts of the metal ion in the higher oxidation state for higher voltage efficiencies. The metal ion in the higher oxidation state may be supplemented to the exiting metal solution from the electrochemical cell before being fed into the reactor for the reaction with the unsaturated hydrocarbon or the saturated hydrocarbon. Before the metal ion solution is circulated back to the electrochemical cell from the reactor, the metal ion in the higher oxidation state may be removed or separated and the solution predominantly containing the metal ion in the lower oxidation state may be fed to the electrochemical cell. Such separation and/or purification of the metal solution before and after the electrochemical cell has been described herein.

In some embodiments, the aqueous electrolyte including the catholyte or the cathode electrolyte and/or the anolyte or the anode electrolyte, or the third electrolyte disposed between AEM and CEM, in the systems and methods provided herein include, but not limited to, saltwater or fresh water. The saltwater includes, but is not limited to, seawater, brine, and/or brackish water. In some embodiments, the cathode electrolyte in the systems and methods provided herein include, but not limited to, seawater, freshwater, brine, brackish water, hydroxide, such as, sodium hydroxide, or combination thereof. "Saltwater" as used herein includes its conventional sense to refer to a number of different types of aqueous fluids other than fresh water, where the saltwater includes, but is not limited to, water containing alkali metal ions such as, alkali metal halides e.g. sodium chloride, potassium chloride, water containing alkaline earth metal ions such as, alkaline earth metal halides e.g. calcium chloride, brackish water, sea water and brine (including, naturally occurring subterranean brines or anthropogenic subterranean brines and man-made brines, e.g., geothermal plant wastewaters, desalination waste waters, etc), as well as other salines having a salinity that is greater than that of freshwater. Brine is water saturated or nearly saturated with salt and has a salinity that is 50 ppt (parts per thousand) or greater. Brackish water is water that is saltier than fresh water, but not as salty as seawater, having a salinity ranging from 0.5 to 35 ppt. Seawater is water from a sea or ocean and has a salinity ranging from 35 to 50 ppt. The saltwater source may be a naturally occurring source, such as a sea, ocean, lake, swamp, estuary, lagoon, etc., or a man-made source. In some embodiments, the systems provided herein include the saltwater from terrestrial brine. In some embodiments, the depleted saltwater withdrawn from the electrochemical cells is replenished with salt and re-circulated back in the electrochemical cell.

In some embodiments, the electrolyte including the cathode electrolyte and/or the anode electrolyte and/or the third electrolyte, such as, saltwater includes water containing alkali metal halides or alkaline earth metal halides of more than 1% chloride content, such as, NaCl; or more than 10% NaCl; or more than 25% NaCl; or more than 50% NaCl; or more than 70% NaCl; or between 1-99% NaCl; or between 1-70% NaCl; or between 1-50% NaCl; or between 1-25% NaCl; or between 1-10% NaCl; or between 10-99% NaCl; or between 10-50% NaCl; or between 20-99% NaCl; or between 20-50% NaCl; or between 30-99% NaCl; or between 30-50% NaCl; or between 40-99% NaCl; or between 40-50% NaCl; or between 50-90% NaCl; or between 60-99% NaCl; or between 70-99% NaCl; or between 80-99% NaCl; or between 90-99% NaCl; or between 90-95% NaCl. In some embodiments, the above recited percentages apply to sodium fluoride, calcium chloride, ammonium chloride, metal chloride, sodium bromide, sodium iodide, etc. as an electrolyte. The percentages recited herein include wt % or wt/wt % or wt/v %. It is to be understood that all the electrochemical systems described herein that contain sodium chloride can be replaced with other suitable electrolytes, such as, but not limited to, ammonium chloride, sodium bromide, sodium iodide, or combination thereof.

In some embodiments, the cathode electrolyte, such as, saltwater, fresh water, and/or sodium hydroxide do not include alkaline earth metal ions or divalent cations. As used herein, the divalent cations include alkaline earth metal ions, such as but not limited to, calcium, magnesium, barium, strontium, radium, etc. In some embodiments, the cathode electrolyte, such as, saltwater, fresh water, and/or sodium hydroxide include less than 1% w/w divalent cations. In some embodiments, the cathode electrolyte, such as, seawater, freshwater, brine, brackish water, and/or sodium hydroxide include less than 1% w/w divalent cations including, but not limited to, calcium, magnesium, and combination thereof.

In some embodiments, the anode electrolyte includes, but not limited to, fresh water and metal ions. In some embodiments, the anode electrolyte includes, but not limited to, saltwater and metal ions. In some embodiments, the anode electrolyte includes metal ion solution.

In some embodiments of the methods and systems described herein, the anode electrolyte may contain saltwater such as but not limited to, water containing alkali metal or alkaline earth metal ions in addition to the metal ion. The alkaline metal ions and/or alkaline earth metal ions include such as but not limited to, lithium, sodium, potassium, calcium, magnesium, etc. The amount of the alkali metal or alkaline earth metal ions added to the anode electrolyte may be between 0.01-5M; between 0.01-4M; or between 0.01-3M; or between 0.01-2M; or between 0.01-1M; or between 1-5M; or between 1-4M; or between 1-3M; or between 1-2M; or between 2-5M; or between 2-4M; or between 2-3M; or between 3-5M.

In some embodiments of the methods and systems described herein, the anode electrolyte may contain an acid. The acid may be added to the anode electrolyte to bring the pH of the anolyte to 1 or 2 or less. The acid may be hydrochloric acid or sulfuric acid.

In some embodiments, the electrolyte in the electrochemical systems and methods described herein include the aqueous medium containing more than 5 wt % water. In some embodiments, the aqueous medium includes more than 5 wt % water; or more than 5.5 wt % water; or more than 6 wt %; or more than 20 wt % water; or more than 25 wt % water; or more than 50 wt % water; or more than 80 wt % water; or more than 90 wt % water; or about 99 wt % water; or between 5-100 wt % water; or between 5-99 wt % water; or between 5-90 wt % water; or between 5-70 wt % water; or between 5-50 wt % water; or between 5-20 wt % water; or between 5-10 wt % water; or between 6-100 wt % water; or between 6-99 wt % water; or between 6-90 wt % water; or between 6-50 wt % water; or between 6-10 wt % water; or between 10-100 wt % water; or between 10-75 wt % water; or between 10-50 wt % water; or between 20-100 wt % water; or between 25-60 wt % water; or between 26-60 wt % water; or between 25-50 wt % water; or between 26-50 wt % water; or between 25-45 wt % water; or between 26-45 wt % water; or between 20-50 wt % water; or between 50-100 wt % water; or between 50-75 wt % water; or between 50-60 wt % water; or between 70-100 wt % water; or between 70-90 wt % water; or between 80-100 wt % water. In some embodiments, the aqueous medium may comprise a water soluble organic solvent.

In some embodiments of the methods and systems described herein, the amount of total metal ion in the anode electrolyte or the amount of metal halide in the anode electrolyte or the amount of copper halide in the anode electrolyte or the amount of iron halide in the anode electrolyte or the amount of chromium halide in the anode electrolyte or the amount of tin halide in the anode electrolyte or the amount of platinum halide or the amount of metal ion that is contacted with the unsaturated hydrocarbon or the saturated hydrocarbon or the amount of total metal ion and the alkali metal ions (salt) in the anode electrolyte is between 1-12M; or between 1-11M; or between 1-10M; or between 1-9M; or between 1-8M; or between 1-7M; or between 1-6M; or between 1-5M; or between 1-4M; or between 1-3M; or between 1-2M; or between 2-12M; or between 2-11M; or between 2-10M; or between 2-9M; or between 2-8M; or between 2-7M; or between 2-6M; or between 2-5M; or between 2-4M; or between 2-3M; or between 3-12M; or between 3-11M; or between 3-10M; or between 3-9M; or between 3-8M; or between 3-7M; or between 3-6M; or between 3-5M; or between 3-4M; or between 4-12M; or between 4-11M; or between 4-10M; or between 4-9M; or between 4-8M; or between 4-7M; or between 4-6M; or between 4-5M; or between 5-12M; or between 5-11M; or between 5-10M; or between 5-9M; or between 5-8M; or between 5-7M; or between 5-6M; or between 6-13M; or between 6-12M; or between 6-11M; or between 6-10M; or between 6-9M; or between 6-8M; or between 6-7M; or between 7-12M; or between 7-11M; or between 7-10M; or between 7-9M; or between 7-8M; or between 8-12M; or between 8-11M; or between 8-10M; or between 8-9M; or between 9-12M; or between 9-11M; or between 9-10M; or between 10-12M; or between 10-11M; or between 11-12M. In some embodiments, the amount of total ion in the anode electrolyte, as described above, is the amount of the metal ion in the lower oxidation state plus the amount of the metal ion in the higher oxidation state plus the alkali metal halide or alkaline earth metal halide; or the total amount of the metal ion in the higher oxidation state; or the total amount of the metal ion in the lower oxidation state.

In some embodiments, the depleted saltwater from the cell may be circulated back to the cell. In some embodiments, the cathode electrolyte includes 1-90%; 1-50%; or 1-40%; or 1-30%; or 1-15%; or 1-20%; or 1-10%; or 5-90%; or 5-50%; or 5-40%; or 5-30%; or 5-20%; or 5-10%; or 10-90%; or 10-50%; or 10-40%; or 10-30%; or 10-20%; or 15-20%; or 15-30%; or 20-30%, of the sodium hydroxide solution. In some embodiments, the anode electrolyte includes 1-5M; or 1-4.5M; or 1-4M; or 1-3.5M; or 1-3M; or 1-2.5M; or 1-2M; or 1-1.5M; or 2-5M; or 2-4.5M; or 2-4M; or 2-3.5M; or 2-3M; or 2-2.5M; or 3-5M; or 3-4.5M; or 3-4M; or 3-3.5M; or 4-5M; or 4.5-6M metal ion solution. In some embodiments, the anode does not form an oxygen gas. In some embodiments, the anode does not form a chlorine gas.

Depending on the degree of alkalinity desired in the cathode electrolyte, the pH of the cathode electrolyte may be adjusted and in some embodiments is maintained between 6 and 12; or between 7 and 14 or greater; or between 7 and 13; or between 7 and 12; or between 7 and 11; or between 10 and 14 or greater; or between 10 and 13; or between 10 and 12; or between 10 and 11. In some embodiments, the pH of the cathode electrolyte may be adjusted to any value between 7 and 14 or greater, a pH less than 12, a pH 7.0, 7.5, 8.0, 8.5, 9.0, 9.5, 10.0, 10.5, 11.0, 11.5, 12.0, 12.5, 13.0, 13.5, 14.0, and/or greater.

Similarly, in some embodiments of the system, the pH of the anode electrolyte is adjusted and is maintained between 0-7; or between 0-6; or between 0-5; or between 0-4; or between 0-3; or between 0-2; or between 0-1. As the voltage across the anode and cathode may be dependent on several factors including the difference in pH between the anode electrolyte and the cathode electrolyte (as can be determined by the Nernst equation well known in the art), in some embodiments, the pH of the anode electrolyte may be adjusted to a value between 0 and 7, including 0, 0.5, 1.0, 1.5, 2.0, 2.5, 3.0, 3.5, 4.0, 4.5, 5.0, 5.5, 6.0, 6.5 and 7, depending on the desired operating voltage across the anode and cathode. Thus, in equivalent systems, where it is desired to reduce the energy used and/or the voltage across the anode and cathode, e.g., as in the chlor-alkali process, the carbon dioxide or a solution containing dissolved carbon dioxide can be added to the cathode electrolyte to achieve a desired pH difference between the anode electrolyte and cathode electrolyte.

The system may be configured to produce any desired pH difference between the anode electrolyte and the cathode electrolyte by modulating the pH of the anode electrolyte, the pH of the cathode electrolyte, the concentration of hydroxide in the cathode electrolyte, the withdrawal and replenishment of the anode electrolyte, and/or the withdrawal and replenishment of the cathode electrolyte. By modulating the pH difference between the anode electrolyte and the cathode electrolyte, the voltage across the anode and the cathode can be modulated. In some embodiments, the system is configured to produce a pH difference of at least 4 pH units; at least 5 pH units; at least 6 pH units; at least 7 pH units; at least 8 pH units; at least 9 pH units; or between 4-12 pH units; or between 4-9 pH units; or between 3-12 pH units; or between 3-9 pH units; or between 5-12 pH units; or between 5-9 pH units; or between 6-12 pH units; or between 6-9 pH units; or between 7-12 pH units; or between 7-9 pH units; or between 8-12 pH units; or between 8-9 pH units; between the anode electrolyte and the cathode electrolyte. In some embodiments, the system is configured to produce a pH difference of at least 4 pH units between the anode electrolyte and the cathode electrolyte.

In some embodiments, the anode electrolyte and the cathode electrolyte in the electrochemical cell, in the methods and systems provided herein, are operated at room temperature or at elevated temperatures, such as, e.g., at more than 40° C., or more than 50° C., or more than 60° C., or more than 70° C., or more than 80° C., or more, or between 30-70° C., or between 70-150° C.

In some embodiments, the systems provided herein result in low to zero voltage systems that generate alkali as compared to chlor-alkali process or chlor-alkali process with ODC or any other process that oxidizes metal ions from lower oxidation state to the higher oxidation state in the anode chamber. In some embodiments, the systems described herein run at voltage of less than 2.8V; or less than 2.5V; or less than 2V; or less than 1.2V; or less than 1.1V; or less than 1V; or less than 0.9V; or less than 0.8V; or less than 0.7V; or less than 0.6V; or less than 0.5V; or less than 0.4V; or less than 0.3V; or less than 0.2V; or less than 0.1V; or at zero volts; or between 0-1.2V; or between 0-1V; or between 0-0.5 V; or between 0.5-1V; or between 0.5-2V; or between 0-0.1 V; or between 0.1-1V; or between 0.1-2V; or between 0.01-0.5V; or between 0.01-1.2V; or between 1-1.2V; or between 0.2-1V; or 0V; or 0.5V; or 0.6V; or 0.7V; or 0.8V; or 0.9V; or 1V.

As used herein, the "voltage" includes a voltage or a bias applied to or drawn from an electrochemical cell that drives a desired reaction between the anode and the cathode in the electrochemical cell. In some embodiments, the desired reaction may be the electron transfer between the anode and the cathode such that an alkaline solution, water, or hydrogen gas is formed in the cathode electrolyte and the metal ion is oxidized at the anode. In some embodiments, the desired reaction may be the electron transfer between the anode and the cathode such that the metal ion in the higher oxidation state is formed in the anode electrolyte from the metal ion in the lower oxidation state. The voltage may be applied to the electrochemical cell by any means for applying the current across the anode and the cathode of the electrochemical cell. Such means are well known in the art and include, without limitation, devices, such as, electrical power source, fuel cell, device powered by sun light, device powered by wind, and combination thereof. The type of electrical power source to provide the current can be any power source known to one skilled in the art. For example, in some embodiments, the voltage may be applied by connecting the anodes and the cathodes of the cell to an external direct current (DC) power source. The power source can be an alternating current (AC) rectified into DC. The DC power source may have an adjustable voltage and current to apply a requisite amount of the voltage to the electrochemical cell.

In some embodiments, the current applied to the electrochemical cell is at least 50 mA/cm$^2$; or at least 100 mA/cm$^2$; or at least 150 mA/cm$^2$; or at least 200 mA/cm$^2$; or at least 500 mA/cm$^2$; or at least 1000 mA/cm$^2$; or at least 1500 mA/cm$^2$; or at least 2000 mA/cm$^2$; or at least 2500 mA/cm$^2$; or between 100-2500 mA/cm$^2$; or between 100-2000 mA/cm$^2$; or between 100-1500 mA/cm$^2$; or between 100-1000 mA/cm$^2$; or between 100-500 mA/cm$^2$; or between 200-2500 mA/cm$^2$; or between 200-2000 mA/cm$^2$; or between 200-1500 mA/cm$^2$; or between 200-1000 mA/cm$^2$; or between 200-500 mA/cm$^2$; or between 500-2500 mA/cm$^2$; or between 500-2000 mA/cm$^2$; or between 500-1500 mA/cm$^2$; or between 500-1000 mA/cm$^2$; or between 1000-2500 mA/cm$^2$; or between 1000-2000 mA/cm$^2$; or between 1000-1500 mA/cm$^2$; or between 1500-2500 mA/cm$^2$; or between 1500-2000 mA/cm$^2$; or between 2000-2500 mA/cm$^2$.

In some embodiments, the cell runs at voltage of between 0-3V when the applied current is 100-250 mA/cm$^2$ or 100-150 mA/cm$^2$ or 100-200 mA/cm$^2$ or 100-300 mA/cm$^2$ or 100-400 mA/cm$^2$ or 100-500 mA/cm$^2$ or 150-200 mA/cm$^2$ or 200-150 mA/cm$^2$ or 200-300 mA/cm$^2$ or 200-400 mA/cm$^2$ or 200-500 mA/cm$^2$ or 150 mA/cm$^2$ or 200 mA/cm$^2$ or 300 mA/cm$^2$ or 400 mA/cm$^2$ or 500 mA/cm$^2$ or 600 mA/cm$^2$. In some embodiments, the cell runs at between 0-1V. In some embodiments, the cell runs at between 0-1.5V when the applied current is 100-250 mA/cm$^2$ or 100-150 mA/cm$^2$ or 150-200 mA/cm$^2$ or 150 mA/cm$^2$ or 200 mA/cm$^2$. In some embodiments, the cell runs at between 0-1V at an amperic load of 100-250 mA/cm$^2$ or 100-150 mA/cm$^2$ or 150-200 mA/cm$^2$ or 150 mA/cm$^2$ or 200 mA/cm$^2$. In some embodiments, the cell runs at 0.5V at a current or an amperic load of 100-250 mA/cm$^2$ or 100-150 mA/cm$^2$ or 150-200 mA/cm$^2$ or 150 mA/cm$^2$ or 200 mA/cm$^2$.

In some embodiments, the systems and methods provided herein further include a percolator and/or a spacer between the anode and the ion exchange membrane and/or the cathode and the ion exchange membrane. The electrochemical systems containing percolator and/or spacers are described in U.S. Provisional Application No. 61/442,573, filed Feb. 14, 2011, which is incorporated herein by reference in its entirety in the present disclosure.

The systems provided herein are applicable to or can be used for any of one or more methods described herein. In some embodiments, the systems provided herein further include an oxygen gas supply or delivery system operably connected to the cathode chamber. The oxygen gas delivery system is configured to provide oxygen gas to the gas-diffusion cathode. In some embodiments, the oxygen gas delivery system is configured to deliver gas to the gas-diffusion cathode where reduction of the gas is catalyzed to hydroxide ions. In some embodiments, the oxygen gas and water are reduced to hydroxide ions; un-reacted oxygen gas in the system is recovered; and re-circulated to the cathode. The oxygen gas may be supplied to the cathode using any means for directing the oxygen gas from the external source to the cathode. Such means for directing the oxygen gas from the external source to the cathode or the oxygen gas delivery system are well known in the art and include, but not limited to, pipe, duct, conduit, and the like. In some embodiments, the system or the oxygen gas delivery system includes a duct that directs the oxygen gas from the external source to the cathode. It is to be understood that the oxygen gas may be directed to the cathode from the bottom of the cell, top of the cell or sideways. In some embodiments, the oxygen gas is directed to the back side of the cathode where the oxygen gas is not in direct contact with the catholyte. In some embodiments, the oxygen gas may be directed to the cathode through multiple entry ports. The source of oxygen that provides oxygen gas to the gas-diffusion cathode, in the methods and systems provided herein, includes any source of oxygen known in the art. Such sources include, without limitation, ambient air, commercial grade oxygen gas from cylinders, oxygen gas obtained by fractional distillation of liquefied air, oxygen gas obtained by passing air through a bed of zeolites, oxygen gas obtained from electrolysis of water, oxygen obtained by forcing air through ceramic membranes based on zirconium dioxides by either high pressure or electric current, chemical oxygen generators, oxygen gas as a liquid in insulated tankers, or combination thereof. In some embodiments, the source of oxygen may also provide carbon dioxide gas. In some embodiments, the oxygen from the source of oxygen gas may be purified before being administered to the cathode chamber. In some embodiments, the oxygen from the source of oxygen gas is used as is in the cathode chamber.

Separation and Purification of Products and Metals

In some embodiments, the methods and systems described herein include separation and purification of the one or more organic compounds or enantiomers thereof (formed during and/or after the reaction of the unsaturated hydrocarbon or the saturated hydrocarbon with metal halide in higher oxidation state, as described herein) from the metal halide and the separation and purification of the metal halide before circulating the metal halide solution back in the electrochemical cell/oxyhalogenation reactor. In some embodiments, it may be desirable to remove the organics from the water containing metal halide before the metal halide solution is circulated back to the electrochemical cell to prevent the fouling of the membranes in the electrochemical cell. The water may be a mixture of both the metal halide in the lower oxidation state and the metal halide in the higher oxidation state, the ratio of the lower and higher oxidation state will vary depending on the water from the electrochemical cell (where lower oxidation state is converted to higher oxidation state) or the water from the oxyhalogenation reactor and the water after reaction with the unsaturated hydrocarbon or the saturated hydrocarbon (where higher oxidation state is converted to the lower oxidation state). Various separation and purification methods and systems have been described in U.S. patent application Ser. No. 14/446,791, filed Jul. 30, 2014, which is incorporated herein by reference in its entirety in the present disclosure. Some examples of the separation techniques include without limitation, reactive distillation, adsorbents, liquid-liquid separation, liquid-vapor separation, etc.

In some embodiments of the methods and systems described herein, the average temperature of the electrochemical system (and therefore the temperature of the entering and exiting anode electrolyte with the metal halide) is between 55-105° C., or between 65-100° C., or between 70-95° C., or between 80-95° C., or between 70-85° C., or 70° C., or 80° C., or 85° C., or 90° C. In some embodiments, the average temperature of the reactor (and hence the entering anode electrolyte and the unsaturated hydrocarbon or the saturated hydrocarbon such as ethylene gas to the reactor and exiting aqueous solution from the reactor containing the one or more organic compounds and the metal halide) may be between 120-200° C., or between 135-175° C., or between 140-180° C., or between 140-170° C., or between 140-160° C., or between 150-180° C., or between 150-170° C., or between 150-160° C., or between 155-165° C., or 140° C., or 150° C., or 160° C., or 170° C. The heat gradient between the electrochemical system and the reactor allows for one or more heat exchanges between the streams entering and exiting the electrochemical and reactor systems during the process thereby reducing the overall heat requirement of the process or the system. In addition to the temperature gradient between the electrochemical process and the reactor process, there may be heat released or absorbed during various steps of the processes depending on the thermodynamic requirements of the processes. This may lead to hotter or cooler streams during the process which heat may be exchanged during the process to reduce the overall external heat needed during the process.

In some embodiments, the electrochemical cell system, the oxyhalogenation reactor and the halogenation reactor, and the separation/purification systems described herein are connected via heat exchange systems in such a way that the overall process is self-sustainable and may not require additional heat source. In some embodiments, the overall heat exchanges of the process is in such a way that not more than 1 ton steam or not more than 0.7 ton steam or not more than 0.5 ton steam is required per ton of the organic product produced. For example, in some embodiments, the overall heat integration of the process is in such a way that not more than 1 ton steam or not more than 0.7 ton steam or not more than 0.5 ton steam is required per ton of the product produced. The streams in the entire process may be integrated in such a way that the streams from one system may heat or cool the streams of the other systems depending on the temperature requirement.

In some embodiments, the entering and exiting streams of processes stated above include, but not limited to, the anode electrolyte, the unsaturated hydrocarbon or the saturated hydrocarbon e.g. the ethylene or ethane, the aqueous medium comprising the metal halide in the lower and higher oxidation state, steam, water, or combinations thereof. In some embodiments, the one or more heat exchange(s) between the entering and exiting streams of processes includes the heat exchange between the exiting anode electrolyte from the electrochemical process, the exiting saltwater from the oxyhalogenation process and the exiting saltwater from the halogenation reactor comprising the one or more organic compounds or enantiomers thereof and the metal halide. In some embodiments of the aforementioned embodiments, the integration of the one or more heat exchange(s) between the entering and exiting streams of processes, reduces the external heat requirement to less than 1 ton of steam per ton of the organic compound/product produced. For example, in some embodiments of the aforementioned embodiments, the integration of the one or more heat exchange(s) between the entering and exiting streams of processes, reduces the external heat requirement to less than 1 ton of steam per ton of the product produced. Various examples of the one or more heat exchange(s) between the entering and exiting streams of processes are described herein below. In some embodiments of the foregoing methods, the method further comprises recirculating the water comprising metal halide with the metal ion in the lower oxidation state and the metal halide with the metal ion in the higher oxidation state back to the anode electrolyte or the oxyhalogenation reactor.

The heat exchange system can be any unit configured to exchange heat between the streams. The heat exchange unit may be a double walled hollow tube, pipe or a tank to let the two streams pass each other counter-currently inside the tube separated by a wall so that the heat exchange may take place. In some embodiments, the tube may comprise one or more smaller tubes such that the streams flow counter currently through several hollow tubes inside one main tube. The material of the tube or the pipe may be corrosion resistant such as made from titanium. In some embodiments, the inner tube is made from titanium and not the outer tube or vice versa depending on the stream passing through the tube. For example only, the stream from the electrochemical system containing the metal ions may need a corrosion resistant material but the tube carrying hot water may not need to be corrosion resistant.

While the exiting hotter stream of the catalysis reactor may be used to heat the relatively cooler stream exiting from the electrochemical system (and in turn cool itself down), both the exiting hot streams from the electrochemical as well as the reactor system can be used to heat the ethylene gas and/or distillation columns or other columns in the separation/purification systems of the invention. Similarly, the ethylene gas may be used to cool the condenser portion of the distillation columns in the system. Example of another hot stream is the sodium hydroxide solution generated in the cathode compartment of the electrochemical system which may be used to heat ethylene gas entering the reactor, heat the solution entering the distillator of the vapor-liquid separation system, heat the fractionation distillation column of the scrubber system, or combinations thereof. In some embodiments, cold water may be needed to cool the stream such as to cool the condenser portion of the distillation column. In some embodiments, steam may be needed to heat the stream but as noted above, no more than 1 ton of steam may be needed per ton of the organic product produced in the system or the process.

The metal separation or the metal separator system may include, but not limited to, precipitation, nanofiltration, kinetic dissolution, or combinations thereof. In some embodiments, the metal ions are separated by precipitation technique. In the methods and systems provided herein, the electrochemical cells are run at lower temperature than the reactors. Therefore, the metal solution exiting the reactor may need to be cooled down before being fed into the electrochemical system. In some embodiments, the cooling of the metal solution may result in the precipitation of the metal ions. In some embodiments, the concentration of the metal halide with the metal ion in the lower oxidation state between the electrochemical, oxyhalogenation, as well as the halogenation systems, as provided in detail herein, may avoid the precipitation of the metal halide in the electrochemical cell. Depending on the solubility differences between the metal ions in the lower oxidation state and the metal ions in the higher oxidation state, the metal ions in the two different oxidations states may be separated. For example only, in the Cu(I)/Cu(II) solution system, the reactor may operate at ~150° C. while the electrochemical system may operate at much lower temperature, e.g. ~70° C. Therefore, the copper solution needs to be cooled before feeding into the electrochemical cell. It was observed that the cooling of the copper solution resulted in the precipitation of the Cu(II) salt as compared to the Cu(I) salt. The Cu(I) salt solution thus obtained may be fed into the electrochemical cell. The solid containing the Cu(II) may be used to supplement the metal solution exiting the electrochemical cell and entering the reactor.

In some embodiments, the metal ions are separated by nanofiltration. Nanofiltration (NF) is a membrane filtration process which uses diffusion through a membrane, under pressure differentials that may be considerable less than those for reverse osmosis. NF membranes may have a slightly charged surface, with a negative charge at neutral pH. This surface charge may play a role in the transportation mechanism and separation properties of the membrane. For example only, Sterlitech CF042 membrane cell is a lab scale cross flow filtration unit. In this unit, a single piece of rectangular NF membrane is installed in the base of the cell and a polytetrafluoroethylene (PTFE) support membrane is used as a permeate carrier. In a typical operation, a feed stream is pumped from the feed vessel to the feed inlet, which is located on the cell bottom. Flow continues through a manifold into the membrane cavity. Once in the cavity, the solution flows tangentially across the membrane surface. A portion of the solution permeates the membrane and flows through the permeate carrier, which is located on top of the cell. The permeate flows to the center of the cell body top, is collected in a manifold and then flows out of the permeate outlet connection into a collection vessel. The concentrate stream, which contains the material rejected by the membrane, continues sweeping over the membrane then flows out of the concentrate tube back into the feed vessel. Examples of other NF membranes, without limitation include, Dow NF (neutral), Dow NF90 (neutral), Dow NF270 (neutral), TriSep XN45 (neutral), Koch HFM-183 (positively charged), Koch HFP-707 (negatively charged), CEM 2030, FAA130, and FAS130.

In some embodiments, the metal ions are separated by kinetic or transient dissolution technique. In this technique, metal ions that have different kinetics of dissolution can be separated. For example, Cu(II) dissolves faster than Cu(I).

In some embodiments, the reactor and/or separator components in the systems of the invention may include a control station, configured to control the amount of the unsaturated hydrocarbon or the saturated hydrocarbon e.g. the ethylene or ethane introduced into the halogenation reactor, the amount of the anode electrolyte introduced into the halogenation or the oxyhalogenation reactor, the amount of the water containing the organics and the metal ions into the separator, the adsorption time over the adsorbents, the temperature and pressure conditions in the reactor and the separator, the flow rate in and out of the reactor and the separator, the regeneration time for the adsorbent in the separator, the time and the flow rate of the water going back to the electrochemical cell, etc.

The control station may include a set of valves or multi-valve systems which are manually, mechanically or digitally controlled, or may employ any other convenient flow regulator protocol. In some instances, the control station may include a computer interface, (where regulation is computer-assisted or is entirely controlled by computer) configured to provide a user with input and output parameters to control the amount and conditions, as described above.

The methods and systems of the invention may also include one or more detectors configured for monitoring the flow of the unsaturated hydrocarbon or the saturated hydrocarbon e.g. the ethylene gas or the concentration of the metal ion in the aqueous medium/water/saltwater or the concentration of the organics in the aqueous medium/water/saltwater, etc. Monitoring may include, but is not limited to, collecting data about the pressure, temperature and composition of the aqueous medium and gases. The detectors may be any convenient device configured to monitor, for example, pressure sensors (e.g., electromagnetic pressure sensors, potentiometric pressure sensors, etc.), temperature sensors (resistance temperature detectors, thermocouples, gas thermometers, thermistors, pyrometers, infrared radiation sensors, etc.), volume sensors (e.g., geophysical diffraction tomography, X-ray tomography, hydroacoustic surveyers, etc.), and devices for determining chemical makeup of the aqueous medium or the gas (e.g, IR spectrometer, NMR spectrometer, UV-vis spectrophotometer, high performance liquid chromatographs, inductively coupled plasma emission spectrometers, inductively coupled plasma mass spectrometers, ion chromatographs, X-ray diffractometers, gas chromatographs, gas chromatography-mass spectrometers, flow-injection analysis, scintillation counters, acidimetric titration, and flame emission spectrometers, etc.).

In some embodiments, detectors may also include a computer interface which is configured to provide a user with the collected data about the aqueous medium, metal ions and/or the organics. For example, a detector may determine the concentration of the aqueous medium, metal ions and/or the organics and the computer interface may provide a summary of the changes in the composition within the aqueous medium, metal ions and/or the organics over time. In some embodiments, the summary may be stored as a computer readable data file or may be printed out as a user readable document.

In some embodiments, the detector may be a monitoring device such that it can collect real-time data (e.g., internal pressure, temperature, etc.) about the aqueous medium, metal ions and/or the organics. In other embodiments, the detector may be one or more detectors configured to determine the parameters of the aqueous medium, metal ions and/or the organics at regular intervals, e.g., determining the composition every 1 minute, every 5 minutes, every 10 minutes, every 30 minutes, every 60 minutes, every 100 minutes, every 200 minutes, every 500 minutes, or some other interval.

The following examples are put forth so as to provide those of ordinary skill in the art with a complete disclosure and description of how to make and use the present invention, and are not intended to limit the scope of what the inventors regard as their invention nor are they intended to represent that the experiments below are all or the only experiments performed. Various modifications of the invention in addition to those described herein will become apparent to those skilled in the art from the foregoing description and accompanying figures. Such modifications fall within the scope of the appended claims. Efforts have been made to ensure accuracy with respect to numbers used (e.g. amounts, temperature, etc.) but some experimental errors and deviations should be accounted for. Unless indicated otherwise, parts are parts by weight, molecular weight is weight average molecular weight, temperature is in degrees Centigrade, and pressure is at or near atmospheric.

In the examples and elsewhere, some of the abbreviations have the following meanings:

| | |
|---|---|
| AEM = | anion exchange membrane |
| EDC = | ethylene dichloride |
| g = | gram |
| HCl = | hydrochloric acid |
| h or hr = | hour |
| l or L = | liter |
| M = | molar |
| $kA/m^2$ = | kiloamps/meter square |
| mg = | milligram |
| min = | minute |
| ml = | milliliter |
| mV = | millivolt |
| NaCl = | sodium chloride |
| NaOH = | sodium hydroxide |
| psi = | pounds per square inch |
| psig = | pounds per square inch guage |
| STY = | space time yield |
| V = | voltage |

EXAMPLES

Example 1

Formation of One or More Organic Compounds from Unsaturated Hydrocarbon

Formation of EDC from Ethylene Using Copper Chloride

This experiment is directed to the formation of ethylene dichloride (EDC) from ethylene using cupric chloride. The experiment was conducted in a pressure vessel. The pressure vessel contained an outer jacket containing the catalyst, i.e. cupric chloride solution and an inlet for bubbling ethylene gas in the cupric chloride solution. The concentration of the reactants was, as shown in Table 1 below. The pressure vessel was heated to 160° C. and ethylene gas was passed into the vessel containing 200 mL of the solution at 300 psi for between 30 min-1 hr in the experiments. The vessel was cooled to 4° C. before venting and opening. The product formed in the solution was extracted with ethyl acetate and was then separated using a separatory funnel. The ethyl acetate extract containing the EDC was subjected to gas-chromatography (GC).

TABLE 1

| Time (hrs) | $CuCl_2$ | CuCl | NaCl | HCl (M) | EDC (mg) | Chloroethanol (mg) | Cu Utilization (EDC) | STY | Mass Selectivity: EDC/(EDC + ClEtOH) % |
|---|---|---|---|---|---|---|---|---|---|
| 0.5 | 6 | 0.5 | 1 | 0.03 | 3,909.26 | 395.13 | 8.77% | 0.526 | 90.82% |
| 0.5 | 4.5 | 0.5 | 2.5 | 0.03 | 3,686.00 | 325.50 | 11.03% | 0.496 | 91.89% |

Formation of Dichloropropane from Propylene Using Copper Chloride

This experiment is directed to the formation of 1,2-dichloropropane (DCP) from propylene using cupric chloride. The experiment was conducted in a pressure vessel. The pressure vessel contained an outer jacket containing the catalyst, i.e. cupric chloride solution and an inlet for bubbling propylene gas in the cupric chloride solution. A 150 mL solution of 5M $CuCl_2$, 0.5M CuCl, 1M NaCl, and 0.03M HCl was placed into a glass-lined 450 mL stirred pressure vessel. After purging the closed container with $N_2$, it was heated to 160° C. After reaching this temperature, propylene was added to the container to raise the pressure from the autogenous pressure, mostly owing from water vapor, to a pressure of 130 psig. After 15 minutes, more propylene was added to raise the pressure from 120 psig to 140 psig. After an additional 15 minutes, the pressure was 135 psig. At this time, the reactor was cooled to 14° C., depressurized, and opened. Ethyl acetate was used to rinse the reactor parts and then was used as the extraction solvent. The product was analyzed by gas chromatography which showed 0.203 g of 1,2-dichloropropane that was recovered in the ethyl acetate phase.

Example 2

Electrochemical Reaction

This example illustrates the electrochemical reaction when the corrugated anode and PK membrane was used in the electrochemical cell. The cell configuration on the 40 $cm^2$ active area lab cell was of Ti-base corrugation bridged with coated Ti mesh anode, Ni flynet meshed cathode with platinum group metal catalyst coating, FAA-3-PK-30 anion exchange membrane (FuMA-Tech), and N2030 cation exchange membrane (Dupont). The cell conditions were an anolyte composed of 4.5 M $CuCl_2$, 1.5M CuCl, 2.5M NaCl, a brine feed of 300 g/NaCl at a pH of 2, and a catholyte of 30 wt % sodium hydroxide. The operating temperature of the cell was 90° C. The run time for the electrochemical reaction was 30 min. These conditions achieved conversion of CuCl to $CuCl_2$ at a cell voltage of 2.35V at 3 $kA/m^2$.

Example 3

Oxyhalogenation Reaction with Varying Cu(I) Concentrations

This example illustrates oxyhalogenation of the metal halide from the lower oxidation state to the higher oxidation state. Various anolyte compositions shown in Table II below were weighed into de-ionized water and placed into split-septa glass vials.

TABLE II

| Initial Compositions | | | | |
|---|---|---|---|---|
| Sample | 1 | 2 | 3 | 4 |
| Cu(I) [M] | 0.5 | 1.0 | 1.5 | 1.0 |
| Cu(II) [M] | 5.5 | 5.5 | 5.5 | 5.5 |
| NaCl [M] | 2.5 | 2.5 | 2.5 | 3.0 |

For Cu(I) and Cu(II), the initial materials were CuCl and $CuCl_2$ respectively. The compositions were then oxidized in a parallel, high-throughput reactor system. The reaction atmosphere was clean, dry air at a pressure of 250 psig and the reaction temperature was approximately 160° C. Reaction time was either 30 min. or 60 min. After the reaction was completed, the reaction contents were cooled to ambient temperature and the resulting solutions were titrated for Cu(II) and total copper concentrations by standard literature techniques. The final Cu(I) concentration was then calculated by difference.

To account for the loss of water through the split septa during the experiment, the final Cu(I) concentration was renormalized based on the ratio of the initial total copper concentration and the (higher) final copper concentration. The change in copper concentration was then calculated directly. Where multiple measurements were taken, the results shown below represent the average measurement. The results are as follows in Table III.

TABLE III

| Sample | 1 | | 2 | | 3 | | 4 | |
|---|---|---|---|---|---|---|---|---|
| Initial Cu(I) [M] | 0.5 | | 1.0 | | 1.5 | | 1.0 | |
| Time (minutes) | 30 | 60 | 30 | 60 | 30 | 60 | 30 | 60 |
| Cu(I) Reacted [M] | 0.263 | 0.380 | 0.772 | 0.878 | 0.978 | 1.296 | 0.865 | 0.874 |

In each case, the results show that the amount of Cu(I) oxidized increases with the initial concentration of Cu(I) and the reaction time, as expected. The results also indicate that the presence of additional chloride (in this case in the form of NaCl) accelerates the conversion of CuCl at least at reaction time of 30 minutes.

Example 4

Oxyhalogenation Reaction with Varying HCl Concentrations, Temperature, and Pressure Kinetic experiments were run in a high throughput system (HTS), that held up to eight sample vials and allowed heating and pressurizing them simultaneously. With anolyte containing 1M CuCl, 5MCuCl2, and 2M NaCl, time series experiments at three different HCl levels and three different (T, p) set-points were conducted. Samples were prepared in duplicate and analyzed via cerium titration in duplicate as well.

The vials were filled with the aforementioned anolyte and a stir-bar was placed in each vial. They were capped and placed in an appropriate tray. For open vial experiments, their septa were slit to allow pressurization and depressurization. For closed vial experiments, at least one open vial filled with water was placed in the tray to ensure equal pressure inside and outside of the vials. The tray was placed in the bottom half of a clamp-shell-reactor and sealed with an o-ring against the top half. The reactor was secured with ten bolts, placed upon a heated stir-plate and covered with an insulating cover. For open vial experiments, pressure was supplied from an air cylinder.

After a set reaction time, the reactor was placed on an aluminum heat sink and rapidly cooled down first with water and from 100° C. downwards with ice. Samples were prepared for either titration or extraction.

Figure 5:
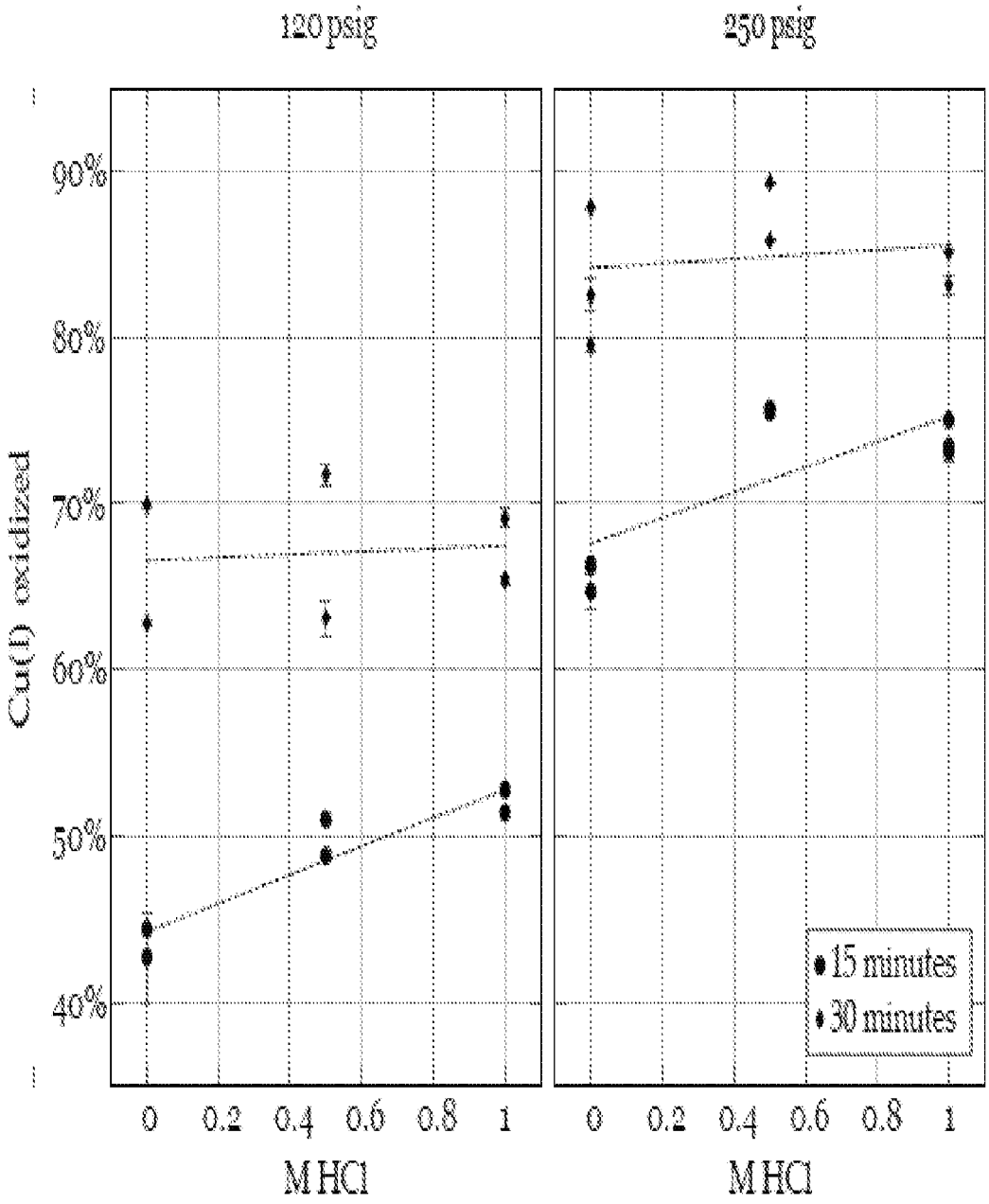
FIG. 5 is a graph illustrating effects of oxidant concentrations and pressure on the oxyhalogenation reaction, as described in Example 4.

As shown in FIG. 5, after reaction times of 15 minutes, the samples showed an increased conversion of Cu(I) to Cu(II) with higher HCl concentrations. After a reaction time of 30 minutes though, this difference leveled out for this anolyte concentration, however, the conversion of Cu(I) to Cu(II) increased between individual samples. Also can be seen in FIG. 5 that an increase in the oxygen partial pressure from 120 psig to 250 psig at 100° C. temperature, increased both reaction speed and reaction endpoint.

Figure 6:
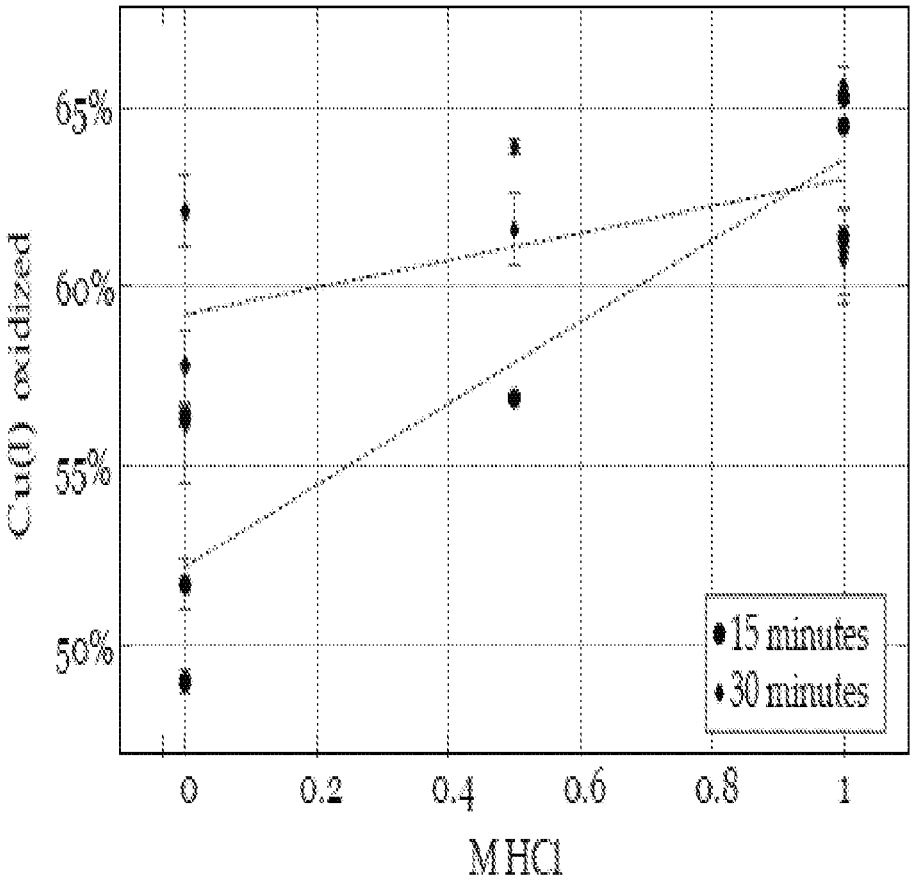
FIG. 6 is a graph illustrating effects of temperature on the oxyhalogenation reaction, as described in Example 4.

The temperature effect was also observed, as shown in FIG. 6. Higher temperature of 150° C. compared to 100° C. above (at 120 psig), increased the reaction speed.

What is claimed is:

1. A method, comprising:

(i) contacting an anode with an anode electrolyte wherein the anode electrolyte comprises metal halide and saltwater; contacting a cathode with a cathode electrolyte; applying a voltage to the anode and the cathode and oxidizing the metal halide with metal ion in a lower oxidation state to a higher oxidation state at the anode;

(ii) halogenating an unsaturated hydrocarbon or a saturated hydrocarbon with the metal halide with the metal ion in the higher oxidation state in the saltwater to result in one or more organic compounds or enantiomers thereof and the metal halide with the metal ion in the lower oxidation state; and (iii) oxyhalogenating the metal halide with the metal ion in the lower oxidation state to the higher oxidation state in presence of an oxidant;

wherein the step (iii) is in series with the step (i).

2. The method of claim 1, wherein the oxidizing, the halogenating and the oxyhalogenating steps are carried out in saltwater.

3. The method of claim 2, wherein the saltwater comprises alkali metal halide.

4. The method of claim 3, wherein the alkali metal halide is sodium chloride or potassium chloride.

5. The method of claim 1, wherein the oxidant is HX gas, or HX solution and a gas comprising oxygen, wherein X is a halogen selected from fluoro, chloro, iodo, and bromo.

6. The method of claim 5, wherein the HX is HCl and the oxyhalogenation is oxychlorination.

7. The method of claim 1, wherein when the oxyhalogenating step (iii) is in series with the step (i), the method further comprises delivering the anode electrolyte comprising the saltwater and the metal halide with the metal ion in the lower and the higher oxidation state from the step (i) to the step (iii) wherein the step (iii) oxyhalogenates the metal halide with the metal ion from the lower oxidation state to the higher oxidation state in the saltwater.

8. The method of claim 7, further comprising delivering the metal halide with the metal ion in the higher oxidation state and the saltwater of the oxyhalogenation step (iii) to the halogenating step (ii) for the halogenation of the unsaturated hydrocarbon or the saturated hydrocarbon.

9. The method of claim 8, further comprising separating the one or more organic compounds or enantiomers thereof from the metal halide with the metal ion in the lower oxidation state in the saltwater after the halogenating step (ii) and delivering the metal halide with the metal ion in the lower oxidation state to the anode electrolyte.

10. The method of claim 9, wherein concentration of the metal halide with the metal ion in the lower oxidation state exiting the electrochemical reaction and entering the oxyhalogenation reaction is between about 0.5-2M; concentration of the metal halide with the metal ion in the lower oxidation state exiting the oxyhalogenation reaction and entering the halogenation reaction is between about 0.1-1.8M; concentration of the metal halide with the metal ion in the lower oxidation state exiting the halogenation reaction and entering the electrochemical reaction is between about 0.6-2.5M; or combinations thereof.

11. The method of claim 1, wherein the oxidant is $X_2$ gas alone; or HX gas and/or HX solution in combination with gas comprising oxygen or ozone; hydrogen peroxide; HXO or salt thereof; $HXO_3$ or salt thereof; $HXO_4$ or salt thereof; or combinations thereof, wherein each X independently is a halogen selected from fluoro, chloro, iodo, and bromo.

12. The method of claim 1, wherein the yield of the one or more organic compounds is more than 90 wt % and/or the space time yield (STY) of the one or more organic compounds is more than 0.5.

13. The method of claim 1, wherein metal ion in the metal halide is copper and the unsaturated hydrocarbon is ethylene, propylene, or butylene which reacts with the metal halide with the metal ion in the higher oxidation state to form ethylene dichloride, propylene dichloride or dichlorobutane, respectively.

14. The method of claim 1, wherein the unsaturated hydrocarbon is a C2-C10 alkene or the saturated hydrocarbon is C2-C10 alkane.

15. A system, comprising:

an electrochemical cell comprising an anode in contact with an anode electrolyte wherein the anode electrolyte comprises metal halide and saltwater; a cathode in contact with a cathode electrolyte; and a voltage source configured to apply a voltage to the anode and the cathode wherein the anode is configured to oxidize the metal halide with the metal ion from a lower oxidation state to a higher oxidation state;

a halogenation reactor operably connected to the electrochemical cell and an oxyhalogenation reactor wherein the halogenation reactor is configured to receive the anode electrolyte comprising the metal halide with the metal ion in the higher oxidation state from the electrochemical cell and/or configured to receive the metal halide solution with the metal ion in the higher oxidation state from the oxyhalogenation reactor and halogenate an unsaturated hydrocarbon or a saturated hydrocarbon with the metal halide with the metal ion in the higher oxidation state to result in one or more organic compounds or enantiomers thereof and the metal halide solution with the metal ion in the lower oxidation state; and the oxyhalogenation reactor operably connected to the electrochemical cell and/or the halogenation reactor and configured to oxyhalogenate the metal halide with the metal ion from the lower oxidation state to the higher oxidation state in presence of an oxidant, wherein the oxyhalogenation reactor is in series with the electrochemical cell.

16. The system of claim 15, wherein the electrochemical cell, the halogenation reactor and the oxyhalogenation reactor are all configured to carry out the reactions in saltwater.

* * * * *